US011244613B2

(12) United States Patent
Jinta

(10) Patent No.: US 11,244,613 B2
(45) **Date of Patent: *Feb. 8, 2022**

(54) DISPLAY UNIT, METHOD OF MANUFACTURING THE SAME, AND ELECTRONIC APPARATUS

(71) Applicant: SONY CORPORATION, Tokyo (JP)

(72) Inventor: Seiichiro Jinta, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/821,201

(22) Filed: Mar. 17, 2020

(65) Prior Publication Data

US 2020/0219444 A1 Jul. 9, 2020

Related U.S. Application Data

(63) Continuation of application No. 16/400,881, filed on May 1, 2019, now Pat. No. 10,643,534, which is a continuation of application No. 16/012,401, filed on Jun. 19, 2018, now Pat. No. 10,319,299, which is a continuation of application No. 15/604,958, filed on May 25, 2017, now Pat. No. 10,019,945, which is a continuation of application No. 15/406,883, filed on Jan. 16, 2017, now Pat. No. 9,697,773, which is a (Continued)

(30) Foreign Application Priority Data

Nov. 19, 2012 (JP) ..... 2012-253065

(51) Int. Cl.
*G09G 3/3233* (2016.01)

(52) U.S. Cl.
CPC ... *G09G 3/3233* (2013.01); *G09G 2300/0426* (2013.01); *G09G 2300/0452* (2013.01); *G09G 2300/0465* (2013.01); *G09G 2300/0819* (2013.01); *G09G 2300/0842* (2013.01); *G09G 2300/0866* (2013.01); *G09G 2310/08* (2013.01); *G09G 2340/04* (2013.01)

(58) Field of Classification Search
None
See application file for complete search history.

(56) References Cited

U.S. PATENT DOCUMENTS

2006/0145978 A1 7/2006 Takatori et al.
2007/0146252 A1 6/2007 Miller et al.
2009/0322730 A1 12/2009 Yamamoto et al.
(Continued)

FOREIGN PATENT DOCUMENTS

CN 1670804 A 9/2005
CN 101419770 A 4/2009
(Continued)

OTHER PUBLICATIONS

Office Action for KR Patent Application No. 10-2013-0129116, dated Apr. 29, 2020, 07 pages of Office Action and 6 pages of English Translation.

(Continued)

*Primary Examiner* — Duane N Taylor, Jr.
(74) *Attorney, Agent, or Firm* — Chip Law Group

(57) ABSTRACT

A method of manufacturing a display unit in which the method includes: forming a transistor on a substrate, in which a first direction to be scanned by an ion implantation apparatus intersects with a second direction to be scanned by an Excimer Laser Anneal apparatus; and forming a display element.

12 Claims, 39 Drawing Sheets

Related U.S. Application Data continuation of application No. 14/077,251, filed on Nov. 12, 2013, now Pat. No. 9,576,528.

(56) References Cited

U.S. PATENT DOCUMENTS

| | | | |
|---|---|---|---|
| 2010/0073338 | A1 | 3/2010 | Miller et al. |
| 2014/0146027 | A1 | 5/2014 | Tsuge |

FOREIGN PATENT DOCUMENTS

| | | | |
|---|---|---|---|
| CN | 101587681 | A | 11/2009 |
| JP | 2008-083084 | A | 4/2008 |
| JP | 2009-157305 | A | 7/2009 |
| JP | 2009-204664 | A | 9/2009 |
| JP | 2011-164133 | A | 8/2011 |
| KR | 10-2009-0041331 | A | 4/2009 |

OTHER PUBLICATIONS

Non-Final Office Action for U.S. Appl. No. 16/400,881, dated May 23, 2019, 05 pages.
Final Office Action for U.S. Appl. No. 16/400,881, dated Aug. 16, 2019, 07 pages.
Advisory Action for U.S. Appl. No. 16/400,881, dated Oct. 24, 2019, 02 pages.
Notice of Allowance for U.S. Appl. No. 16/400,881, dated Dec. 11, 2019, 08 pages.
Notice of Allowance for U.S. Appl. No. 16/400,881, dated Mar. 9, 2020, 05 pages.
Non-Final Office Action for U.S. Appl. No. 16/012,401, dated Sep. 18, 2018, 08 pages.
Notice of Allowance for U.S. Appl. No. 16/012,401, dated Jan. 30, 2019, 08 pages.
Non-Final Office Action for U.S. Appl. No. 15/604,958, dated Aug. 18, 2017, 15 pages.
Final Office Action for U.S. Appl. No. 15/604,958, dated Dec. 28, 2017, 07 pages.
Notice of Allowance for U.S. Appl. No. 15/604,958, dated Mar. 14, 2018, 07 pages.
Notice of Allowance for U.S. Appl. No. 15/406,883, dated Mar. 2, 2017, 08 pages.
Non-Final Office Action for U.S. Appl. No. 14/077,251, dated Apr. 23, 2015, 14 pages.
Non-Final Office Action for U.S. Appl. No. 14/077,251, dated Dec. 2, 2015, 14 pages.
Final Office Action for U.S. Appl. No. 14/077,251, dated Aug. 13, 2015, 14 pages.
Final Office Action for U.S. Appl. No. 14/077,251, dated May 19, 2016, 15 pages.
Advisory Action for U.S. Appl. No. 14/077,251, dated Oct. 20, 2015, 03 pages.
Advisory Action for U.S. Appl. No. 14/077,251, dated Aug. 8, 2016, 02 pages.
Notice of Allowance for U.S. Appl. No. 14/077,251, dated Oct. 12, 2016, 07 pages.
Office Action for KR Patent Application No. 10-2013-0129116, dated Sep. 27, 2019, 05 pages of Office Action and 04 pages of English Translation.
Office Action for CN Patent Application No. 201910194355.1, dated Oct. 11, 2021, 9 pages of English translation and 7 pages of Office Action.

SCAN SIGNAL WSA

POWER CONTROL SIGNAL DS1A

POWER SIGNAL DS2A

SIGNAL Sig

GATE VOLTAGE Vg

SOURCE VOLTAGE Vs
DS2A
Vccp
Sig
Vg
VsigR
Vofs
Vth
Vcath
Vs
Vini

SIGNAL Sig

GATE VOLTAGE Vg

SOURCE VOLTAGE Vs
DS2A
Vccp
Sig
Vg
VsigG
Vofs
Vth
Vcath
Vs
Vini
t1
t2
t3
t4
t5
P1
P2
P3
P4

1H

SCAN SIGNAL WSA

SCAN SIGNAL WSB

POWER CONTROL SIGNAL DS1
DS2A
Vccp

POWER SIGNAL DS2

SIGNAL Sig

GATE VOLTAGE Vg

SOURCE VOLTAGE Vs
Sig
Vg
Vth
Vs
VsigW
VsigR
Vofs
Vcath
Vini
DS2A
Vccp

GATE VOLTAGE Vg

SOURCE VOLTAGE Vs
Sig
Vg
Vth
Vs
VsigW
VsigR
Vofs
Vcath
Vini
t21
t22
t23
t24
t26
t25
t27
P1
P2
P3
P4

1H
FIG. 45A SCAN SIGNAL WSA
FIG. 45B SCAN SIGNAL WSB
FIG. 45C POWER CONTROL SIGNAL DS1
FIG. 45D POWER SIGNAL DS2
FIG. 45E SIGNAL Sig
FIG. 45F GATE VOLTAGE Vg
FIG. 45G SOURCE VOLTAGE Vs
FIG. 45H GATE VOLTAGE Vg
FIG. 45I SOURCE VOLTAGE Vs
DS2
Vccp
Sig
Vg
VsigW
VsigR
Vofs
Vth
Vcath
Vs
Vini
t41
t42
t43
t44
t45
t46
t47
t48
P1
P2
P3
P4

DISPLAY UNIT, METHOD OF MANUFACTURING THE SAME, AND ELECTRONIC APPARATUS

CROSS-REFERENCE TO RELATED APPLICATIONS

The present application is a continuation application of U.S. patent application Ser. No. 16/400,881, filed May 1, 2019, which is a continuation application of U.S. patent application Ser. No. 16/012,401, filed Jun. 19, 2018, now U.S. Pat. No. 10,319,299, which is a continuation application of U.S. patent application Ser. No. 15/604,958, filed May 25, 2017, now U.S. Pat. No. 10,019,945, which is a continuation application of U.S. patent application Ser. No. 15/406,883, filed Jan. 16, 2017, now U.S. Pat. No. 9,697,773, which is a continuation application of U.S. patent application Ser. No. 14/077,251, filed Nov. 12, 2013, now U.S. Pat. No. 9,576,528, which claims priority from prior Japanese Priority Patent Application JP 2012-253065 filed in the Japan Patent Office on Nov. 19, 2012, the entire contents of which are hereby incorporated by reference.

BACKGROUND

The present disclosure relates to a display unit having a current driven type display element, a method of manufacturing the display unit, and an electronic apparatus including the display unit.

In recent years, in a field of a display unit which displays images, a display unit (organic EL display unit) using a current driven type optical element in which a light emitting luminance varies according to a value of a flowing current, for example, using an organic EL (Electro Luminescence) element is developed as a light emitting element, and commercialization thereof advances. Unlike a liquid crystal element, a light emitting element is a self light emitting element, and therefore backlight is unnecessary. Consequently, as compared to a liquid crystal display unit in which backlight is necessary, an organic EL display unit has characteristics in which visibility of an image is high, power consumption is low, and a response speed of an element is high.

Not only in a fixed type television receiver but also in a mobile terminal such as a smartphone, display of a high definition image is desired in a display unit. According to the above, a variety of technologies are developed in order to improve a resolution of display units. In Japanese Unexamined Patent Application Publication No. 2008-83084, for example, a display unit is disclosed in which three sub-pixels of red (R), green (G), and blue (B) adjacent in a horizontal direction share a switching transistor (power supply transistor) in an organic EL display unit having sub-pixels of a so-called 5Tr1C configuration. In this display unit, three sub-pixels share a power supply transistor as described above to reduce the number of elements and to improve a resolution.

SUMMARY

As described above, in a display unit, a display of high definition images is desired and an improvement in a resolution is expected.

It is desirable to provide a display unit, a method of manufacturing the display unit, and an electronic apparatus, each capable of improving a resolution.

A display unit according to an embodiment of the present disclosure includes: a plurality of unit pixels each including a display element and a driving transistor that supplies a driving current to the display element, in which the unit pixels are arrayed to be scanned and driven in a first direction; and a single power line extending in a second direction that intersects with the first direction, in which the single power line is provided to be assigned for a pair of unit pixels that are two unit pixels of the plurality of unit pixels and are adjacent to each other in the first direction.

A method of manufacturing a display unit according to an embodiment of the present disclosure includes: forming a transistor on a substrate, in which a first direction to be scanned by an ion implantation apparatus intersects with a second direction to be scanned by an Excimer Laser Anneal apparatus; and forming a display element.

An electronic apparatus according to an embodiment of the present disclosure is provided with a display unit and a control section configured to perform operation control of the display unit. The display unit includes: a plurality of unit pixels each including a display element and a driving transistor that supplies a driving current to the display element, in which the unit pixels are arrayed to be scanned and driven in a first direction; and a single power line extending in a second direction that intersects with the first direction, in which the single power line is provided to be assigned for a pair of unit pixels that are two unit pixels of the plurality of unit pixels and are adjacent to each other in the first direction.

Some examples of the electronic apparatus may include a TV apparatus, a digital camera, a personal computer, a video camera, and a portable terminal device such as a mobile phone.

In the display unit, the method of manufacturing the display unit, and the electronic apparatus according to the above-described respective embodiments of the present disclosure, the plurality of unit pixels are scanned and driven in the first direction. The single power line is provided to be assigned for the pair of unit pixels that are two unit pixels of the plurality of unit pixels and are adjacent to each other in the first direction.

According to the display unit, the method of manufacturing the display unit, and the electronic apparatus of the above-described respective embodiments of the present disclosure, the single power line is provided to be assigned for the pair of unit pixels that are two unit pixels adjacent to each other in the first direction. Therefore, it is possible to improve a resolution.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

DETAILED DESCRIPTION

Hereinafter, an embodiment of the present disclosure is described in detail with reference to the accompanying drawings. Here, descriptions are made in the following order.

1. Reference example
2. Embodiment
3. Application example

1. Reference Example

Configuration Example

Figure 1:
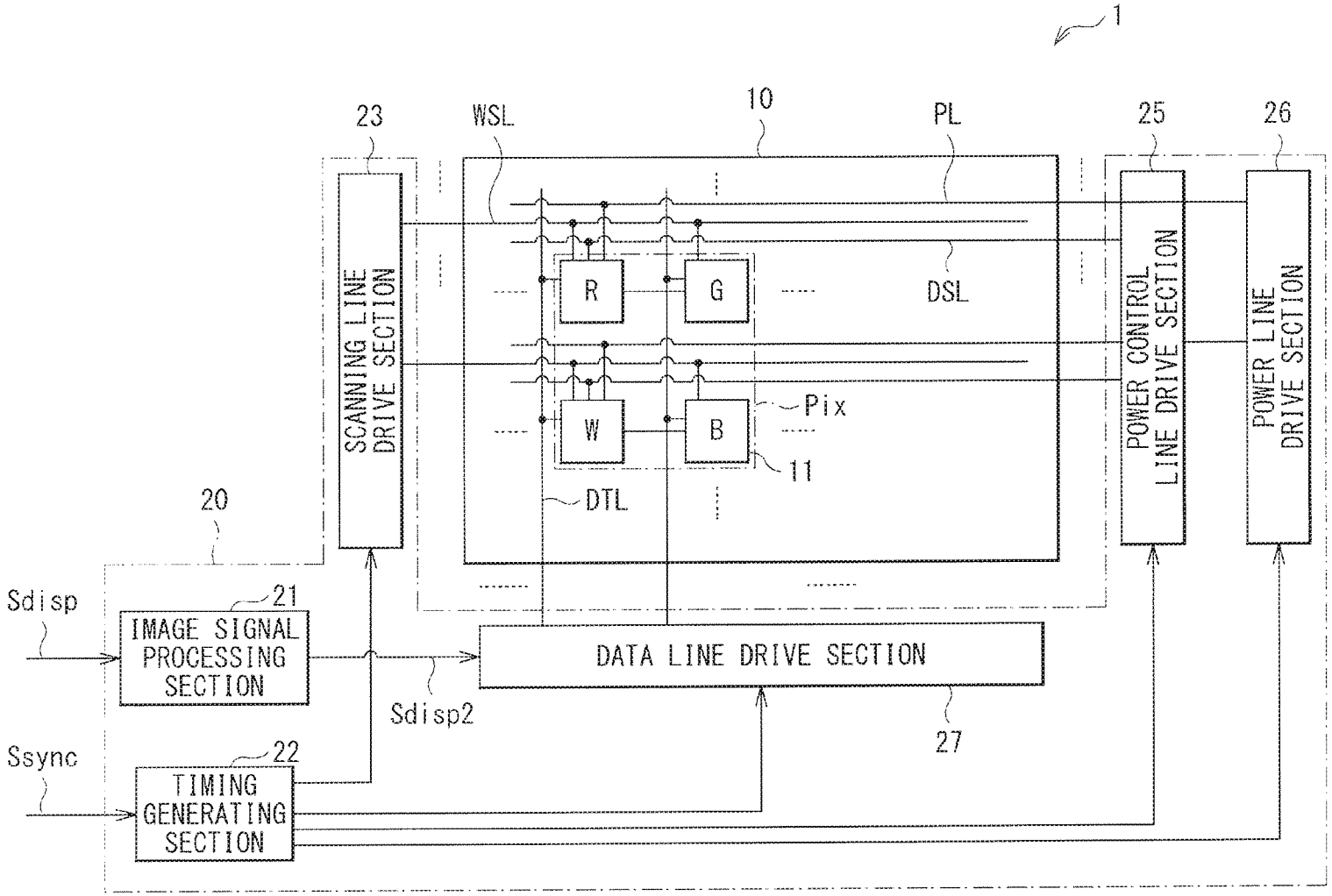
FIG. 1 is a block diagram illustrating one configuration example of a display unit according to a reference example.

Before a display unit according to an embodiment is described, a reference example is first described. FIG. 1 illustrates one configuration example of the display unit according to the reference example. The display device 1 is an active matrix type display unit using light emitting elements. This display unit 1 includes a display section 10 and a drive section 20.

The display section 10 has a plurality of pixels Pix arranged in a matrix shape. Each pixel Pix has four sub-pixels 11 of red (R), green (G), blue (B), and white (W). Further, the display section 10 has a plurality of scanning lines WSL, power lines PL, and power control lines DSL extended in a row direction, and has a plurality of data lines DTL extended in a column direction. One ends of the scanning lines WSL, the power lines PL, the power control lines DSL, and the data lines DTL are connected to the drive section 20. Each of the above-described sub-pixels 11 is arranged at an intersection of the scanning line WSL and the data line DTL.

Figure 2:
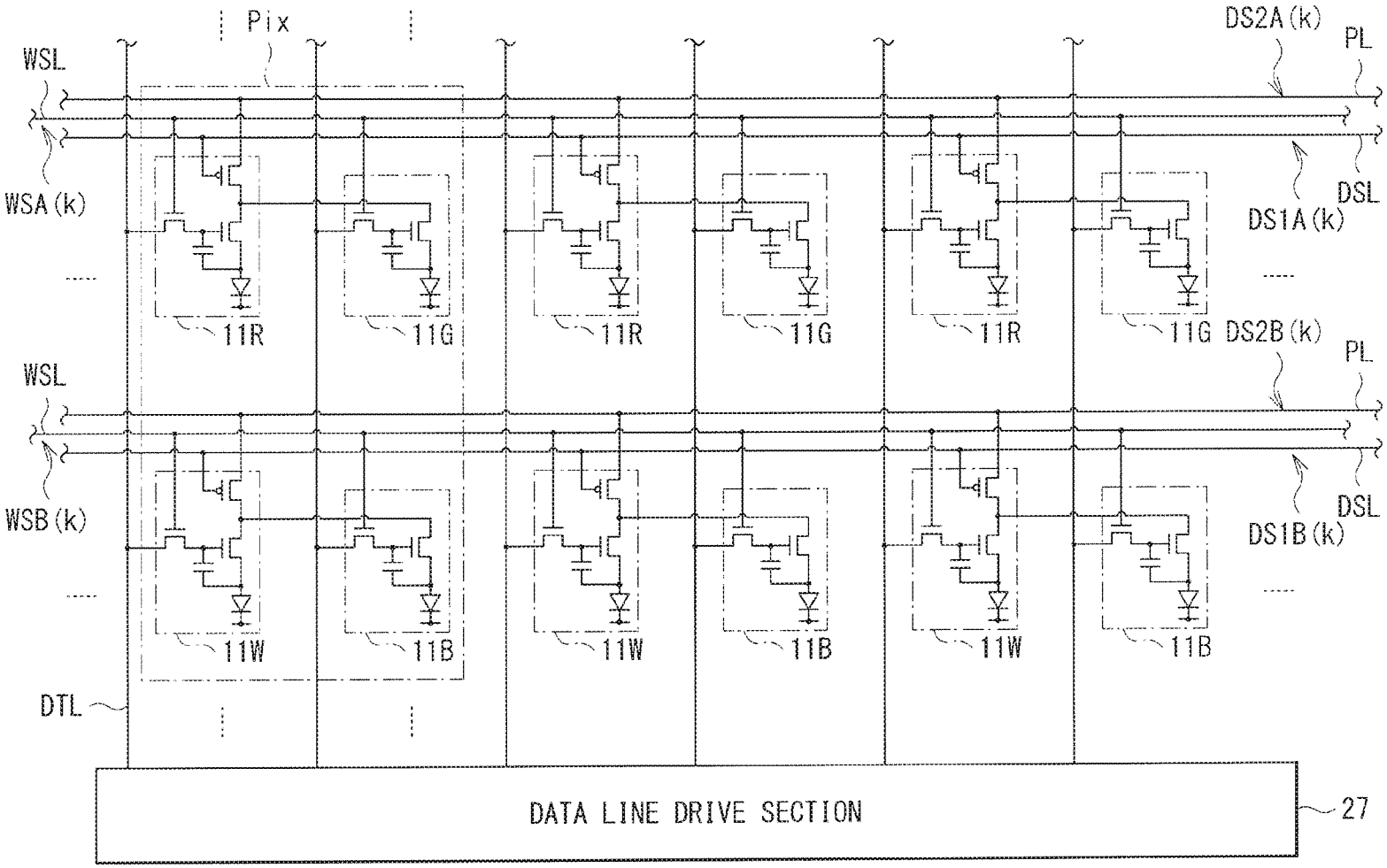
FIG. 2 is a circuit diagram illustrating a circuit configuration example of a display section illustrated in FIG. 1.

FIG. 2 illustrates one example of a circuit configuration of the display section 10. FIG. 2 illustrates k-th row pixels Pix in the display section 10. The pixel Pix has four sub-pixels 11 (11R, 11G, 11B, and 11W) of red (R), green (G), blue (B), and white (W). In this example, the four sub-pixels 11R, 11G, 11B, and 11W are arranged in two rows and two columns in the pixel Pix. Specifically, in the pixel Pix, the sub-pixel 11R of red (R) is arranged at the upper left, the sub-pixel 11G of green (G) is arranged at the upper right, the sub-pixel 11W of white (W) is arranged at the lower left, and the sub-pixel 11B of blue (B) is arranged at the lower right. In the four sub-pixels 11R, 11G, 11B, and 11W, the sub-pixels 11R and 11W are connected to the scanning line WSL, the power line PL, the power control line DSL, and the data line DTL. On the other hand, the sub-pixels 11G and 11B are connected to the scanning line WSL and the data line DTL. The sub-pixels 11R and 11G are connected to the same scanning line WSL, and the sub-pixels 11W and 11B are connected to the same scanning line WSL. Further, the sub-pixels 11R and 11W are connected to the same data line DTL, and the sub-pixels 11G and 11B are connected to the same data line DTL. As described in detail later, the sub-pixel 11R is connected to the sub-pixel 11G, and the sub-pixel 11W is connected to the sub-pixel 11B.

Figure 3:
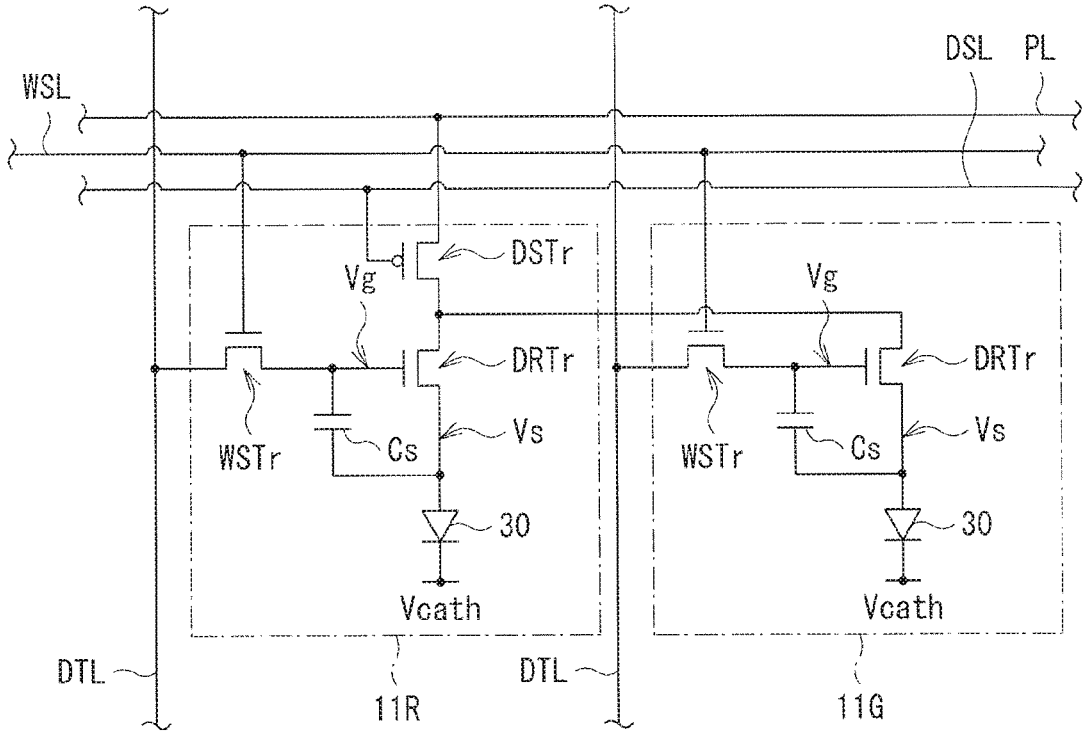
FIG. 3 is a circuit diagram illustrating a circuit configuration example of sub-pixels in the display section illustrated in FIG. 1.

FIG. 3 illustrates one example of a circuit configuration of the sub-pixels 11R and 11G. Further, much the same is true on the sub-pixels 11W and 11B. The sub-pixel 11R has a writing transistor WSTr, a driving transistor DRTr, a power supply transistor DSTr, a capacitor Cs, and a light emitting element 30. The sub-pixel 11G has the writing transistor WSTr, the driving transistor DRTr, the capacitor Cs, and the light emitting element 30. The sub-pixels 11R and 11G share the power supply transistor DSTr. That is, each of the sub-pixels 11R and 11G are configured by three transistors (a writing transistor WSTr, a driving transistor DRTr, and a power supply transistor DSTr) and one capacitor Cs. In a so-called "3Tr1C" configuration, the sub-pixels 11R and 11G are configured so as to share the power supply transistor DSTr. In this example, in the sub-pixels 11R and 11G, the sub-pixel 11R has the power supply transistor DSTr; however, not limited thereto. In place of the above, for example, the sub-pixel 11G may have the power supply transistor DSTr.

The writing transistor WSTr and the driving transistor DRTr may be configured, for example, by N channel MOS (Metal Oxide Semiconductor) type TFTs (Thin Film Transistor). Further, the power supply transistor DSTr may be configured, for example, by a P channel MOS type TFT; however, not limited thereto. In place of the above, for example, a writing transistor WSTr may be configured by a P channel MOS type TFT. In addition, a power supply transistor DSTr may be configured by an N channel MOS type TFT. These transistors may be formed, for example, by using an LTPS (Low Temperature Poly Silicon) process. Since a high mobility μ is, for example, achieved in this LTPS process, a transistor is made small and a high resolution is achieved. A formation method is not limited to the LTPS process. In place of the above, for example, the above transistors may be formed by using an amorphous silicon (a-Si) TFT process or an oxide TFT process.

In each of the sub-pixels 11R and 11G, in the writing transistor WSTr, a gate is connected to the scanning line WSL, a source is connected to the data line DTL, and a drain is connected to a gate of the driving transistor DRTr and one end of the capacitor Cs. In the driving transistor DRTr, the gate is connected to the drain of the writing transistor WSTr and the one end of the capacitor Cs, a drain is connected to a drain of the power supply transistor DSTr in the sub-pixel 11R, and a source is connected to the other end of the capacitor Cs and an anode of the light emitting element 30. In the sub-pixel 11R, in the power supply transistor DSTr, a gate is connected to the power control line DSL, a source is connected to the power line PL, and the drain is connected to the drain of the driving transistor DRTr in the sub-pixel 11R and a drain of the driving transistor DRTr in the sub-pixel 11G.

Figure 4A:
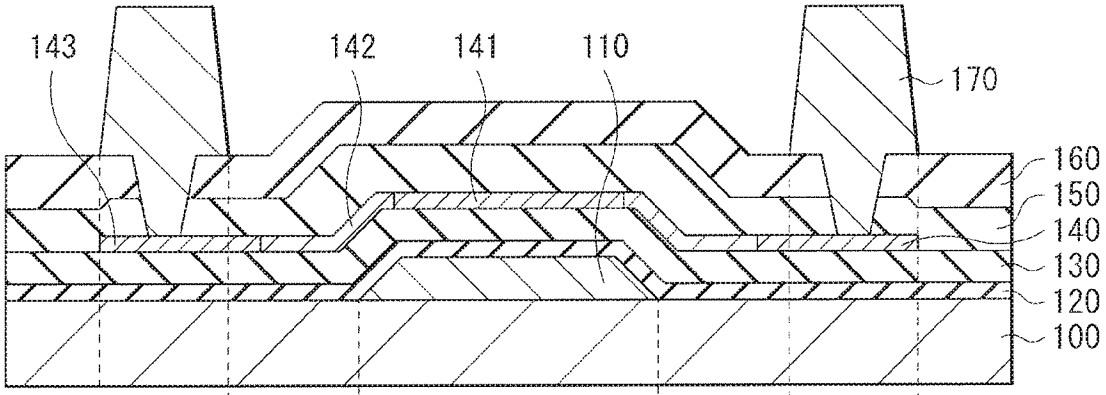
FIGS. 4A and 4B are explanatory views illustrating one configuration example of transistors in the display section illustrated in FIG. 1.
Figure 4B:
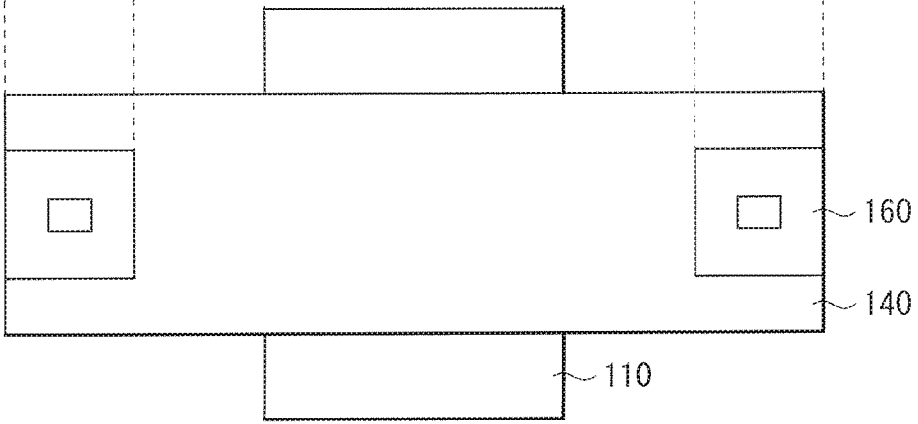

FIGS. 4A and 4B illustrate one configuration example of the TFT, in which FIG. 4A illustrates a cross-sectional view, and FIG. 4B illustrates an essential-part plan view. The TFT has a gate electrode 110 and a polysilicon layer 140. The gate electrode 110 is formed on a substrate 100 which may be made of glass. The gate electrode 110 may be made of, for example, molybdenum Mo. Over the gate electrode 110 and the substrate 100, insulating layers 120 and 130 are formed in this order. The insulating layer 120 may be formed, for example, by silicon nitride (SiNx) and the insulating layer 130 may be formed, for example, by silicon dioxide (SiO2). The polysilicon layer 140 is formed on the insulating layer 130. As described later, an amorphous silicon layer is formed on the insulating layer 130 and is subjected to an annealing treatment by using an ELA (Excimer Laser Anneal) apparatus, and thereby the polysilicon layer 140 is formed. The polysilicon layer 140 is configured by a channel region 141, an LDD (Lightly Doped Drain) 142, and a contact region 143. As described later, ions are implanted by using an ion implantation apparatus or an ion doping apparatus, and thereby the above regions are formed. As described above, the gate electrode 110 is formed under the polysilicon layer 140 in this example. That is, this TFT includes a so-called bottom-gate structure. Over the polysilicon layer 140 and the insulating layer 130, insulating layers 150 and 160 are formed in this order. Similarly to the insulating layer 130, the insulating layer 150 may be formed, for example, by silicon dioxide (SiO2). Similarly to the insulating layer 120, the insulating layer 160 may be formed, for example, by silicon nitride (SiNx). On the insulating layer 160, wiring 170 is formed. In the insulating layers 150 and 160, an opening is formed in a region corresponding to the contact region 143 of the polysilicon layer 140. Further, the wiring 170 is formed so as to be connected to the contact region 143 through this opening.

As described later, in the display section 20, the driving transistors DRTr in a pair of sub-pixels 11 in which the power supply transistor DSTr is shared are formed so as to be provided side-by-side in the scanning direction through an ion implantation apparatus and in the direction to be intersected with the scanning direction through an ELA apparatus. Specifically, as described later, in this example, the driving transistors DRTr in the sub-pixels 11R and 11G belonging to the same pixel Pix are provided side-by-side as described above. Further, the driving transistors DRTr in the sub-pixels 11W and 11B belonging to the same pixel Pix are provided side-by-side as described above. As described later, this makes it possible to allow characteristics (particularly, the threshold voltage Vth) of these driving transistors DRTr to be the same level as each other. That is, characteristics of each transistor formed in the display section 20 are varied within a plane. However, through such an arrangement, characteristics of the driving transistors DRTr in the sub-pixels 11R and 11G belonging to the same pixel Pix are made substantially the same. In addition thereto, characteristics of the driving transistors DRTr in the sub-pixels 11W and 11B belonging to the same pixel Pix are made substantially the same.

As described in FIG. 3, in each of the sub-pixels 11R and 11G, the one end of the capacitor Cs is connected to the gate of the driving transistor DRTr and the drain of the writing transistor WSTr. Further, the other end thereof is connected to the source of the driving transistor DRTr and the anode of the light emitting element 30.

The light emitting element 30 is a light emitting element which emits light of a color (red, green, blue, or white) corresponding to each of the sub-pixels 11R, 11G, 11B, and 11W, and which is configured by an organic EL element. The anode thereof is connected to the source of the driving transistor DRTr and the other end of the capacitor Cs, and a cathode thereof is supplied with a cathode voltage Vcath by the drive section 20.

Figure 5:
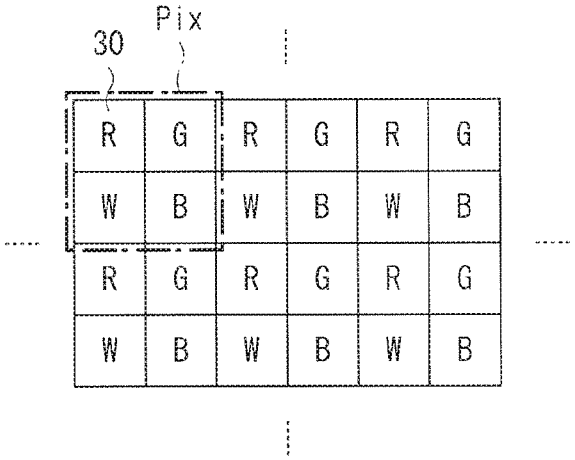
FIG. 5 is an explanatory view illustrating an arrangement of light emitting elements illustrated in FIG. 3.
Figure 6:
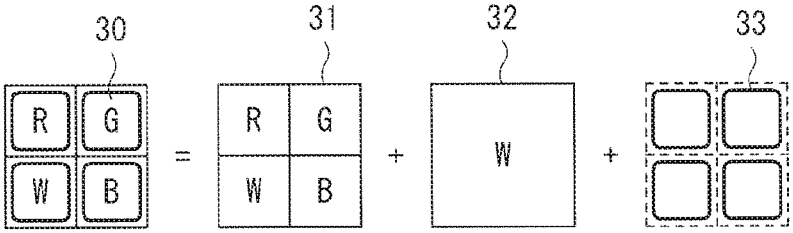
FIG. 6 is a schematic diagram illustrating a configuration of the light emitting elements illustrated in FIG. 3.
Figure 7:
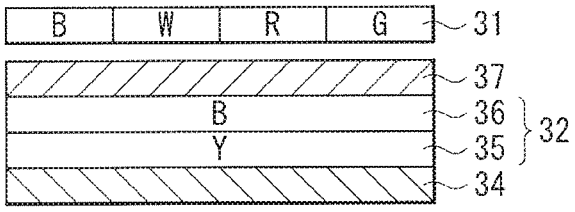
FIG. 7 is a cross-sectional view illustrating an essential-part cross-sectional structure of the light emitting elements illustrated in FIG. 3.

FIG. 5 illustrates an arrangement of the light emitting elements 30 in the display section 10. FIG. 6 schematically illustrates a configuration of the light emitting elements 30 in the pixel Pix. FIG. 7 illustrates an essential-part cross-sectional structure of the light emitting elements 30.

As illustrated in FIGS. 6 and 7, the light emitting element 30 is configured by a light emitting layer 32 and color filters 31. The light emitting layer 32 is formed between an anode electrode layer 34 and a cathode electrode layer 37. In this example, the light emitting layer 32 may be formed by laminating a yellow light-emitting layer 35 which emits light of yellow (Y) and a blue light-emitting layer 36 which emits light of blue (B), thereby emitting light of white (W). Light emitted from the light emitting layer 32 passes through the color filter 31 and is outputted from a display surface of the display section 10. In each of the sub-pixels 11R, 11G, 11B, and 11W, an opening 33 is provided and light having passed through the opening 33 is outputted from the display surface. In the case of laminating the light emitting layers as described above, an order thereof may be changed. Specifically, in this example, the blue light-emitting layer 36 of the light emitting layer 32 is arranged on the cathode electrode layer 37 side and the yellow light-emitting layer 35 thereof is arranged on the anode electrode layer 34 side; however, not limited thereto. In place of the above, for example, the yellow light-emitting layer 35 may be arranged on the cathode electrode layer 37 side and the blue light-emitting layer 36 may be arranged on the anode electrode layer 34 side. Further, a type of the light emitting element 30 is not particularly limited. For example, it may be a so-called top emission type light emitting element which emits light from the light emitting layer 32 in the direction opposite to a substrate on which elements and wiring are formed, or a so-called bottom emission type light emitting element which emits light from the light emitting layer 32 in the direction of the substrate.

Figure 8:
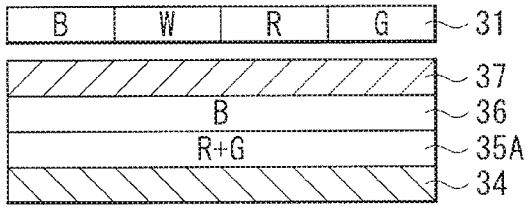
FIG. 8 is a cross-sectional view illustrating an essential-part cross-sectional structure of a light emitting element according to a modification example.

In this example, the yellow light-emitting layer 35 may be configured by a material which emits light of yellow (Y); however, not limited thereto. In place of the above, as illustrated in FIG. 8, for example, a material which emits light of green (G) may be doped in a material which emits light of red (R) to configure a yellow light-emitting layer 35A. Also in this example, an order of laminating light emitting layers may be changed.

As illustrated in FIG. 1, the drive section 20 drives the display section 10, based on image signals Sdisp and synchronization signals Ssync supplied from the outside. This drive section 20 includes an image signal processing section 21, a timing generating section 22, a scanning line drive section 23, a power control line drive section 25, a power line drive section 26, and a data line drive section 27.

The image signal processing section 21 performs a predetermined signal process to the image signals Sdisp supplied from the outside so as to generate image signals Sdisp2. Examples of the predetermined signal process may include a gamma correction and an overdrive correction.

Based on the synchronization signals Ssync supplied from the outside, the timing generating section 22 supplies control signals to the scanning line drive section 23, the power control line drive section 25, the power line drive section 26, and the data line drive section 27, and controls them to perform operations in synchronization with each other.

According to the control signals supplied from the timing generating section 22, the scanning line drive section 23 sequentially applies scan signals WS to the plurality of scanning lines WSL, thereby sequentially selecting the sub-pixels 11. Specifically, as illustrated in FIG. 2, the scanning line drive section 23 supplies the scan signals WSA to the sub-pixels 11R and 11G, and supplies the scan signals WSB to the sub-pixels 11W and 11B, thereby sequentially selecting sub-pixel 11.

According to the control signals supplied from the timing generating section 22, the power control line drive section 25 sequentially applies power control signals DS1 to the plurality of the power control lines DSL, thereby controlling a light emission operation and a light extinction operation of the sub-pixels 11. Specifically, as illustrated in FIG. 2, the power control line drive section 25 supplies power control signals DS1A to the sub-pixels 11R and 11G, and supplies power control signals DS1B to the sub-pixels 11W and 11B, thereby controlling the sub-pixels 11.

According to the control signals supplied from the timing generating section 22, the power line drive section 26 sequentially applies power signals DS2 to the plurality of the power lines PL, thereby controlling a light emission operation and a light extinction operation of the sub-pixels 11.

Specifically, as illustrated in FIG. 2, the power line drive section 26 supplies power signals DS2A to the sub-pixels 11R and 11G, and supplies power signals DS2B to the sub-pixels 11W and 11B, thereby controlling the sub-pixels 11. The power signals DS2 transit between a voltage Vccp and a voltage Vini. As described later, the voltage Vini is a voltage which initializes the sub-pixels 11 and the voltage Vccp is a voltage which causes a current Ids to flow through the driving transistor DRTr and causing the light emitting element 30 to emit light.

According to the image signals Sdisp2 supplied from the image signal processing section 21 and the control signals supplied from the timing generating section 22, the data line drive section 27 generates signals Sig including a pixel voltage Vsig which instructs a light emission luminance of each sub-pixel 11 and a voltage Vofs which performs a Vth correction to be described later, and applies them to each data line DTL.

Through this configuration, as described later, the drive section 20 performs correction (Vth correction) for suppressing an influence exerted on an image quality by element variations of the driving transistors DRTr on four sub-pixels 11 (11R, 11G, 11B, and 11W) included in the pixel Pix in one horizontal period (1H). Then, the drive section 20 performs writing of the pixel voltage Vsig on the sub-pixels 11, and the light emitting element 30 emits light with luminance according to the written pixel voltage Vsig.

[Operation and Action]

Continuously, operations and actions of the display unit 1 according to the reference example are described.

(Overall Operation Outline)

First, an overall operation outline of the display unit 1 is described with reference to FIG. 1. The image signal processing section 21 performs a predetermined signal process on the image signals Sdisp supplied from the outside to generate the image signals Sdisp2. Based on the synchronization signals Ssync supplied from the outside, the timing generating section 22 supplies the control signals to the scanning line drive section 23, the power control line drive section 25, the power line drive section 26, and the data line drive section 27, and controls them to perform operations in synchronization with each other. According to the control signals supplied from the timing generating section 22, the scanning line drive section 23 sequentially applies the scan signals WS (WSA, WSB) to the plurality of scanning lines WSL, thereby sequentially selecting the sub-pixels 11. According to the control signals supplied from the timing generating section 22, the power control line drive section 25 sequentially applies the power control signals DS1 (DS1A and DS1B) to the plurality of power control lines DSL, thereby controlling a light emission operation and a light extinction operation of the sub-pixels 11. According to the control signals supplied from the timing generating section 22, the power line drive section 26 sequentially applies the power signals DS2 (DS2A and DS2B) to the plurality of power lines PL, thereby controlling a light emission operation and a light extinction operation of the sub-pixels 11. According to the image signals Sdisp2 supplied from the image signal processing section 21 and the control signals supplied from the timing generating section 22, the data line drive section 27 generates the signals Sig including the pixel voltage Vsig corresponding to a luminance of each sub-pixel 11 and the voltage Vofs which performs the Vth correction operation, and applies them to each data line DTL. The display section 10 performs display, based on the scan signals WS, the power control signals DS1, the power signals DS2, and the signals Sig supplied from the drive section 20.

(Detailed Operation)

Next, detailed operations of the display unit 1 are described.

Figures 9A, 9B, 9C, 9D:
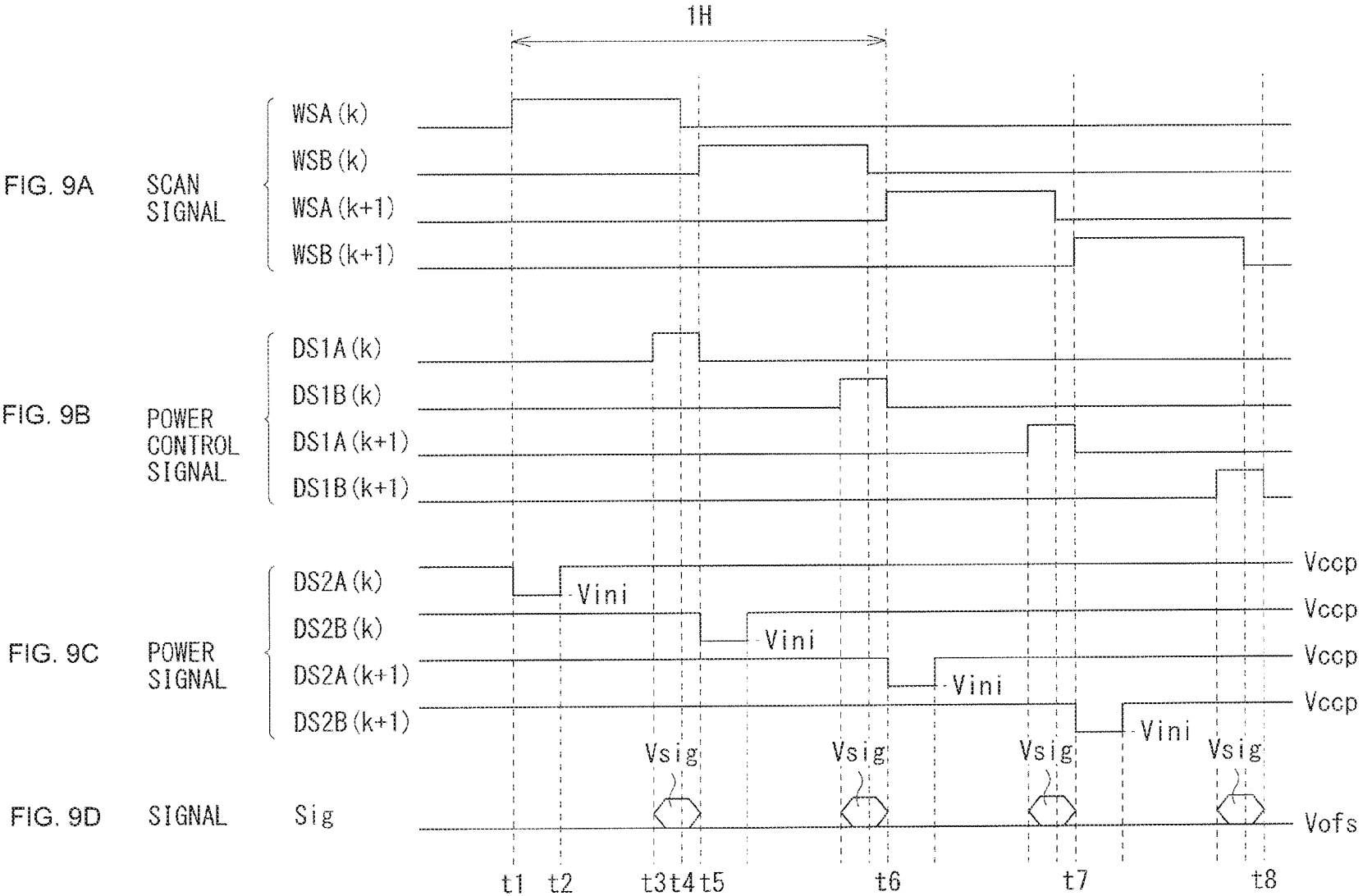
FIGS. 9A, 9B, 9C, and 9D are timing waveform diagrams illustrating one operation example of a drive section illustrated in FIG. 1.

FIGS. 9A, 9B, 9C, and 9D illustrates a timing chart of operations of the drive section 20, in which FIG. 9A illustrates waveforms of the scan signals WS (WSA and WSB), FIG. 9B illustrates waveforms of the power control signals DS1 (DS1A and DS1B), FIG. 9C illustrates waveforms of the power signals DS2 (DS2A and DS2B), and FIG. 9D illustrates a waveform of the signal Sig. In FIG. 9A, scan signals WSA(k) and WSB(k) are the scan signals WS which drives k-th row pixels Pix, and scan signals WSA(k+1) and WSB(k+1) are the scan signals WS which drives (k+1)-th row pixels Pix. Much the same is true on the power control signal DS1 (FIG. 9B) and the power signal DS2 (FIG. 9C).

The scanning line drive section 23 of the drive section 20 sequentially applies the scan signal WS having a pulse shape to the scanning line WSL (FIG. 9A). On this occasion, the scanning line drive section 23 sequentially applies a pulse to two scanning lines WSL in one horizontal period (1H). To the power line PL, the power line drive section 26 applies the power signal DS2 at the voltage Vini only in a predetermined period (timing t1 and t2, etc.) after start timing of a pulse of the scan signal WS and at the voltage Vccp in the other period (FIG. 9C). To the power control line DSL, the power control line drive section 25 applies the power control signal DS1 at a high level only in a predetermined period (timing t3 to t5, etc.) including a terminal timing of a pulse of the scan signal WS and at a low level in the other period (FIG. 9B). To the data line DTL, the data line drive section 27 applies the pixel voltage Vsig in a period (timing t3 to t5, etc.) at which the power control signal DS1 becomes a high level, and applies the voltage Vofs in the other period (FIG. 9D).

In this way, the drive section 20 drives the sub-pixels 11R and 11G in the k-th row pixels Pix in a first-half period (timing t1 to t5) in one horizontal period (timing t1 to t6), and drives the sub-pixels 11W and 11B in the k-th row pixels Pix in a second-half period (timing t5 and t6) thereof. Similarly, the drive section 20 drives the sub-pixels 11R and 11G in the (k+1)-th row pixels Pix in a first-half period (timing t6 and t7) in the next one horizontal period (timing t6 to t8), and drives the sub-pixels 11W and 11B in the (k+1)-th row pixels Pix in a second-half period (timing t7 and t8) thereof.

Figures 10A, 10B, 10C, 10D, 10E, 10F, 10G, 10H, 10I:
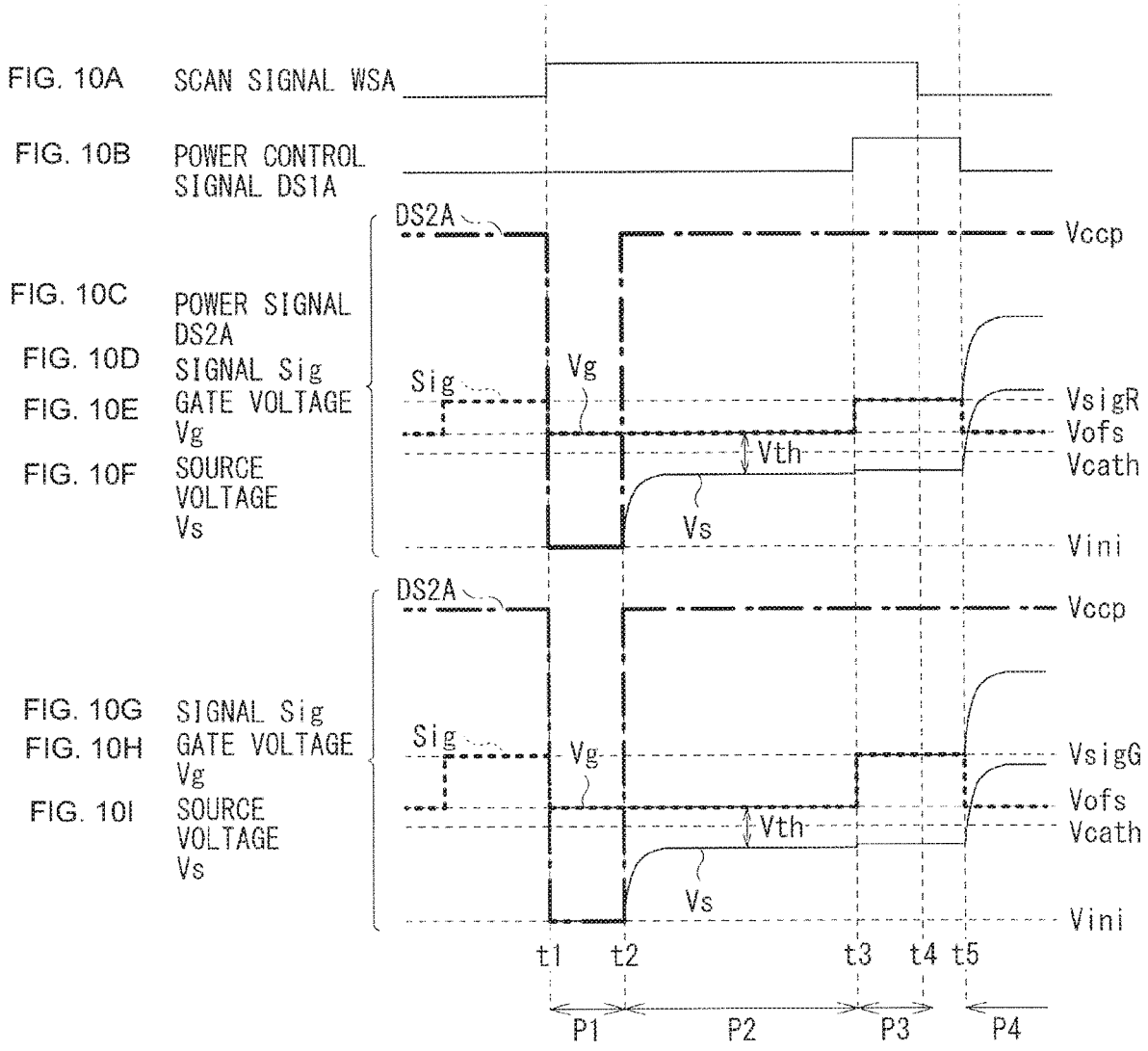
FIGS. 10A, 10B, 10C, 10D, 10E, 10F, 10G, 10H, and 10I are timing waveform diagrams illustrating one operation example of the drive unit illustrated in FIG.

FIGS. 10A, 10B, 10C, 10D, 10E, 10F, 10G, 10H, and 10I are timing chart illustrating operations of the sub-pixels 11R and 11G in a period of timing t1 to t5, in which FIG. 10A illustrates a waveform of the scan signal WSA, FIG. 10B illustrates a waveform of the power control signal DS1A, FIG. 10C illustrates a waveform of the power signal DS2A, FIG. 10D illustrates a waveform of the signal Sig supplied to the sub-pixel 11R, FIG. 10E illustrates a waveform of a gate voltage Vg of the driving transistor DRTr in the sub-pixel 11R, FIG. 10F illustrates a waveform of a source voltage Vs of the driving transistor DRTr in the sub-pixel 11R, FIG. 10G illustrates a waveform of the signal Sig supplied to the sub-pixel 11G, FIG. 10H illustrates a waveform of the gate voltage Vg of the driving transistor DRTr in the sub-pixel 11G, and FIG. 10I illustrates a waveform of the source voltage Vs of the driving transistor DRTr in the sub-pixel 11G. In FIGS. 10C, 10D, 10E, and 10F, each waveform is illustrated by using the same voltage axis, and similarly, each waveform is illustrated by using the same voltage axis in FIGS. 10G, 10H, and 10I. For convenience of description, the same waveform as that of the power signal DS2A (FIG. 10C) is illustrated on the same voltage axis as those of FIGS. 10G, 10H, and 10I.

In the first-half period in one horizontal period (1H), the drive section 20 initializes the sub-pixels 11R and 11G (initialization period P1), performs the Vth correction operation for suppressing an influence exerted on an image quality by element variations of the driving transistor DRTr (Vth correction period P2), and writes the pixel voltage Vsig in the sub-pixels 11R and 11G (writing period P3). Then, the light emitting elements 30 in the sub-pixels 11R and 11G emit light with luminance according to the written pixel voltage Vsig (light emitting period P4). Similarly, in the second-half period in one horizontal period (1H), the drive section 20 performs the initialization operation, the Vth correction operation, and the writing operation of the pixel voltage Vsig on the sub-pixels 11W and 11B. Then, the light emitting elements 30 in the sub-pixels 11W and 11B emit light. Drive operations performed on the sub-pixels 11R and 11G are described in detail below.

In the period of timing t1 and t2 (initialization period P1), the drive section 20 first initializes the sub-pixels 11R and 11G. Specifically, at the timing t1, the data line drive section 27 first sets the signals Sig supplied to the sub-pixels 11R and 11G to the voltage Vofs (FIGS. 10D and 10G). Further, the scanning line drive section 23 varies a voltage of the scan signal WSA from a low level to a high level (FIG. 10A). Thereby, the writing transistors WSTr in the sub-pixels 11R and 11G are turned on, and the gate voltages Vg of the driving transistors DRTr in the sub-pixels 11R and 11G are set to the voltages Vofs (FIGS. 10E and 10H). At the same time as the above, the power line drive section 26 varies the power signal DS2A from the voltage Vccp to the voltage Vini (FIG. 10C). Thereby, the driving transistors DRTr are turned on, and source voltages Vs of the driving transistors DRTr are set to the voltages Vini (FIGS. 10F and 10I). As a result, in the sub-pixels 11R and 11G, gate-source voltages Vgs (=Vofs-Vini) of the driving transistors DRTr are set to voltages larger than threshold voltages Vth of the driving transistors DRTr, and the sub-pixels 11R and 11G are initialized.

Next, the drive section 20 performs the Vth correction operation in a period of timing t2 and t3 (Vth correction period P2). Specifically, the power line drive section 26 varies the power signal DS2A from the voltage Vini to the voltage Vccp at the timing t2 (FIG. 10C). Thereby, the driving transistors DRTr in the sub-pixels 11R and 11G perform operations at saturation regions, a current Ids flows from the drain to the source, and the source voltages Vs rise up (FIGS. 10F and 10I). On this occasion, the source voltage Vs is lower than the voltage Vcath of the cathode of the light emitting element 30. Consequently, the light emitting element 30 maintains a reverse bias state and a current is prevented from flowing in the light emitting element 30. In this way, the source voltage Vs rises up to reduce the gate-source voltage Vgs, thereby reducing the current Ids. Through a negative feedback operation described above, the current Ids converges to "0" (zero). In other words, the gate-source voltages Vgs of the driving transistors DRTr in the sub-pixels 11R and 11G converge so as to be equal to the threshold voltages Vth of the driving transistors DRTr (Vgs=Vth).

Operations of this Vth correction are described in detail below. The current Ids which flows from the drain to the source of the driving transistor DRTr is represented by using the next expression.

[MATH. 1]

$$Ids(t) = \frac{\beta}{2}(Vgs(t) - Vth)^2 \qquad (1)$$

$$\beta \equiv \frac{W}{L} \cdot Cox \cdot \mu$$

Here, a symbol "t" represents time using as a reference the timing t2 (FIGS. 10A, 10B, 100, 10D, 10E, 10F, 10G, 10H, and 10I) at which the Vth correction operation is started. Further, in the driving transistor DRTr, W represents a gate width, L represents a gate length, Cox represents an oxide film capacity, and μ represents mobility.

This current Ids is supplied to the other end of the capacitor Cs, and a voltage (=Vgs) between both ends of the capacitor Cs varies. This behavior is represented by the next expression.

[MATH. 2]

$$Ids(t) = -Cs\frac{dVgs(t)}{dt} \qquad (2)$$

By using the expressions (1) and (2), the next expression is obtained about a time change of the gate-source voltage Vgs.

[MATH. 3]

$$Vgs(t) - Vth = \frac{1}{\frac{1}{Vgs(0) - Vth} + \frac{\beta}{2Cs} \cdot 1} \qquad (3)$$

In this way, in the Vth correction period P2, as time elapses, the gate-source voltage Vgs is gradually reduced as represented by the expression (3). When a sufficiently long time elapses, a right-hand side of the expression (3) is substantially equal to "0" (zero). Therefore, the gate-source voltage Vgs becomes the same level as that of the threshold voltage Vth.

Next, in a period (a writing period P3) of the timing t3 and t4, the drive section 20 performs a writing operation of the pixel voltage Vsig to the sub-pixels 11R and 11G. Specifically, at the timing t3, the power control line drive section 25 first varies a voltage of the power control signal DS1A from a low level to a high level (FIG. 10B). Thereby, the power supply transistor DSTr is turned off. At the same time as the above, the data line drive section 27 sets the signals Sig supplied to the sub-pixels 11R and 11G to the pixel voltages Vsig (VsigR and VsigG) (FIGS. 10D and 10G). Thereby, the gate voltages Vg of the driving transistors DRTr in the sub-pixels 11R and 11G rise up from the voltages Vofs to the pixel voltages Vsig (VsigR and VsigG) (FIGS. 10D and 10G). Also, the source voltages Vs of the driving transistors DRTr in the sub-pixels 11R and 11G somewhat rise up again accordingly (FIGS. 10F and 10I). As a result, the gate-source voltages Vgs of the driving transistors DRTr in the sub-pixels 11R and 11G are set to voltages according to the pixel voltages Vsig. On this occasion, in the case where the pixel voltages Vsig are other than voltages corresponding to black display, this gate-source voltage Vgs becomes larger than the threshold voltage Vth (Vgs>Vth). Consequently, the driving transistors DRTr are turned on, and the source voltages Vs of these driving transistors DRTr become substantially equal to each other.

Figure 11A:
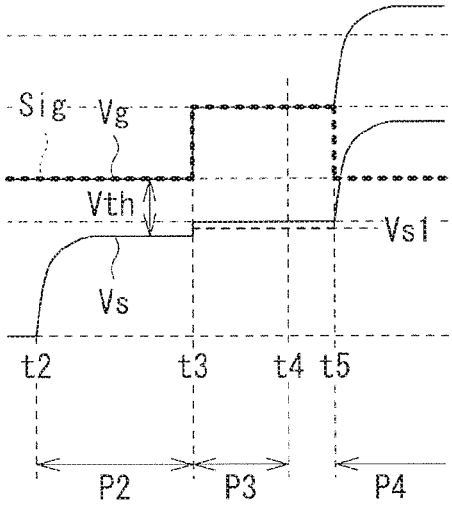
FIGS. 11A and 11B are timing waveform diagrams illustrating one operation example in a writing period of the display unit illustrated in FIG. 1.
Figure 11B:
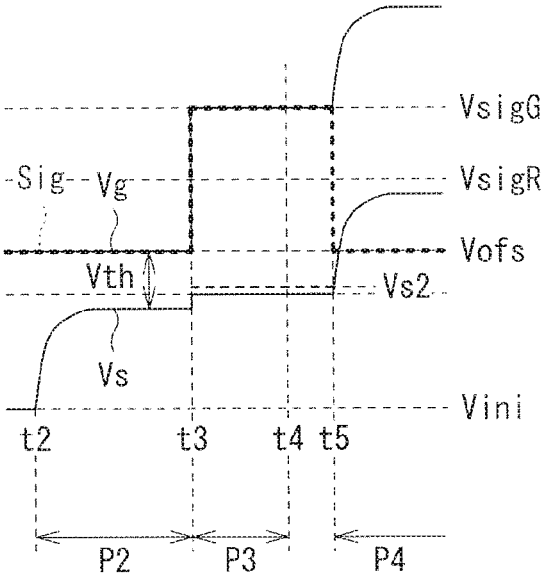

FIGS. 11A and 11B are timing charts illustrating a writing operation of the pixel voltage Vsig performed on the sub-pixels 11R and 11G, in which FIG. 11A illustrates operations performed on the sub-pixel 11R, and FIG. 11B illustrates operations performed on the sub-pixel 11G. In this example, the pixel voltage VsigR written in the sub-pixel 11R is lower than the pixel voltage VsigG written in the sub-pixel 11G. Also in such a case, in the writing period P3, the source voltage of the driving transistor DRTr in the sub-pixel 11R is substantially equal to the source voltage of the driving transistor DRTr in the sub-pixel 11G. That is, suppose that the power supply transistor DSTr is not shared and the sub-pixels 11R and 11G each have the power supply transistor DSTr. In this case, the source voltages Vs of the driving transistors DRTr are at levels according to the pixel voltages Vsig. At this time, in the case where the pixel voltage Vsig is low, the source voltage Vs of the driving transistor DRTr is equal to a lower voltage Vs1 (FIG. 11A). In the case where the pixel voltage Vsig is high, the source voltage Vs of the driving transistor DRTr is equal to a higher voltage Vs2 (FIG. 11B). On the other hand, in the display section 10, the sources of two driving transistors DRTr in the sub-pixels 11R and 11G are connected via the two driving transistors DRTr. Therefore, the source voltages Vs are substantially equal to each other. This means that in the sub-pixels 11R and 11G, a sub-pixel (the sub-pixel 11R in this example) which is lower in the pixel voltage Vsig emits light darker and a sub-pixel (the sub-pixel 11G in this example) which is higher in the pixel voltage Vsig emits light brighter. Accordingly, in consideration of this behavior, the data line drive section 27 may desirably correct the pixel voltage Vsig so that a sub-pixel may emit light with intended luminance.

Next, at the timing t4, the scanning line drive section 23 varies the voltage of the scan signal WSA from a high level to a low level (FIG. 10A). Thereby, the writing transistors WSTr in the sub-pixels 11R and 11G are turned off, and the gates of the driving transistors DRTr are in floating states. Therefore, subsequently, voltages between terminals of the capacitors Cs, namely, the gate-source voltages Vgs of the driving transistors DRTr are maintained.

In a period (light emitting period P4) at the timing t5 or later, the drive section 20 then causes the sub-pixels 11R and 11G to emit light. Specifically, at the timing t5, the power control line drive section 25 varies the power control signal DS1A from a high level to a low level (FIG. 10B). Thereby, the power supply transistor DSTr is turned on and the current Ids flows through the driving transistors DRTr in the sub-pixels 11R and 11G. As the current Ids flows through the driving transistors DRTr, the source voltages Vs of the driving transistors DRTr rise up (FIGS. 10F and 10I). The gate voltages Vg of the driving transistors DRTr rise up accordingly (FIGS. 10E and 10H). Through such a bootstrap operation, when the source voltage Vs of the driving transistor DRTr becomes larger than the sum (Vel+Vcath) of a threshold voltage Vel and the voltage Vcath of the light emitting element 30, a current flows between the anode and the cathode of the light emitting element 30, and the light emitting element 30 emits light. That is, in accordance with element variations of the light emitting element 30, the source voltage Vs rises up and the light emitting element 30 emits light.

As described above, the initialization operation, the Vth correction operation, and the writing operation in the pixel voltage Vsig in the sub-pixels 11R and 11G in the first-half period (timing t1 to t5) in one horizontal period (timing t1 to t6) are described. Similarly, in the continuous second-half period (timing t5 and t6 in FIGS. 9A, 9B, 9C, and 9D), the sub-pixels 11W and 11B perform the initialization operation, the Vth correction operation, and the writing operation of the pixel voltage Vsig.

Then, in the display unit 1, after a predetermined period (one frame period) elapses, the light emitting period P3 moves to the writing period P1. The drive section 20 repeatedly drives this series of operations.

(About Arrangement of Driving Transistor DRTr)

As illustrated in FIGS. 2 and 3, in the display unit 1, the plurality of sub-pixels 11 (two sub-pixels 11 in this example) share the power supply transistor DSTr. In the plurality of sub-pixels 11 involved with the share of this power supply transistor DSTr, desirably, the threshold voltages Vth in the driving transistors DRTr may be substantially equal to each other. Specifically, in this example, desirably, the threshold voltages Vth of the driving transistors DRTr in the sub-pixels 11R and 11G belonging to the same pixel Pix may be substantially equal to each other. At the same time, desirably, the threshold voltages Vth of the driving transistors DRTr in the sub-pixels 11W and 11B belonging to the same pixel Pix may be substantially equal to each other. Otherwise, for example, there may be a possibility that in the period of timing t3 and t4, the source voltages Vs of the driving transistors DRTr in the sub-pixels 11R and 11G may become substantially equal to each other, which may cause results of the Vth correction operation which is previously performed to be disturbed and may cause reduction in an image quality.

Variations in the threshold voltage Vth of the driving transistor DRTr may receive a large influence, for example, by a formation step of the polysilicon layer 140 among formation steps of transistors. In this step, an amorphous silicon layer is first formed on the insulating layer (FIGS. 4A and 4B). Then, an annealing treatment is performed on the amorphous silicon layer by using an ELA apparatus, and thereby the polysilicon layer 140 is formed. Then, ions are implanted into the channel region 141 and the LDD 142 of this polysilicon layer 140 by using an ion implantation apparatus. Further, ions are implanted into the contact region 143 by using an ion doping apparatus. In the process using the ELA apparatus and the process using the ion implantation apparatus, an influence is exerted on variations of the threshold voltage Vth in transistors.

Figure 12:
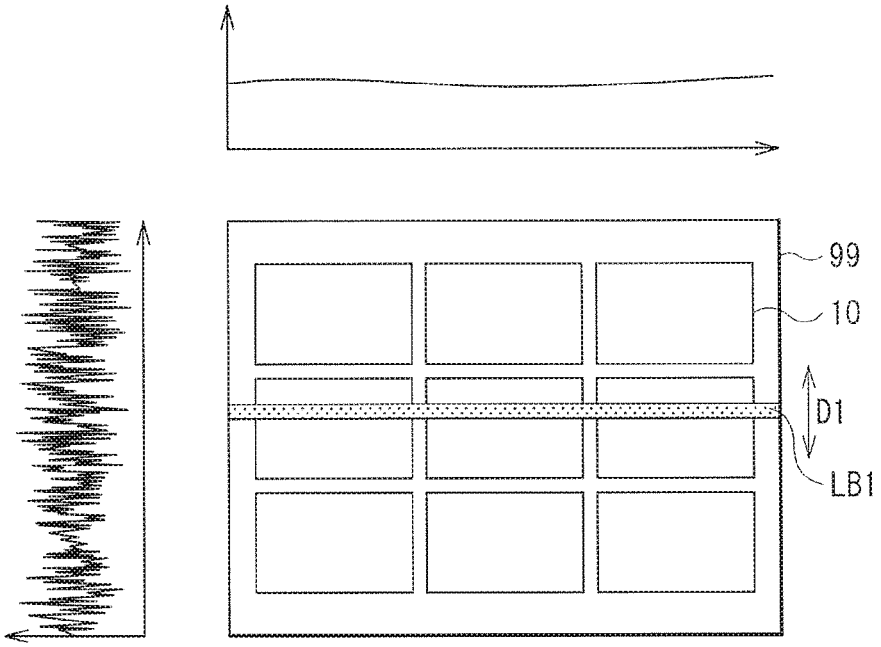
FIG. 12 is a schematic diagram illustrating a variation of a threshold voltage Vth due to a process through an ELA apparatus.
Figure 13:
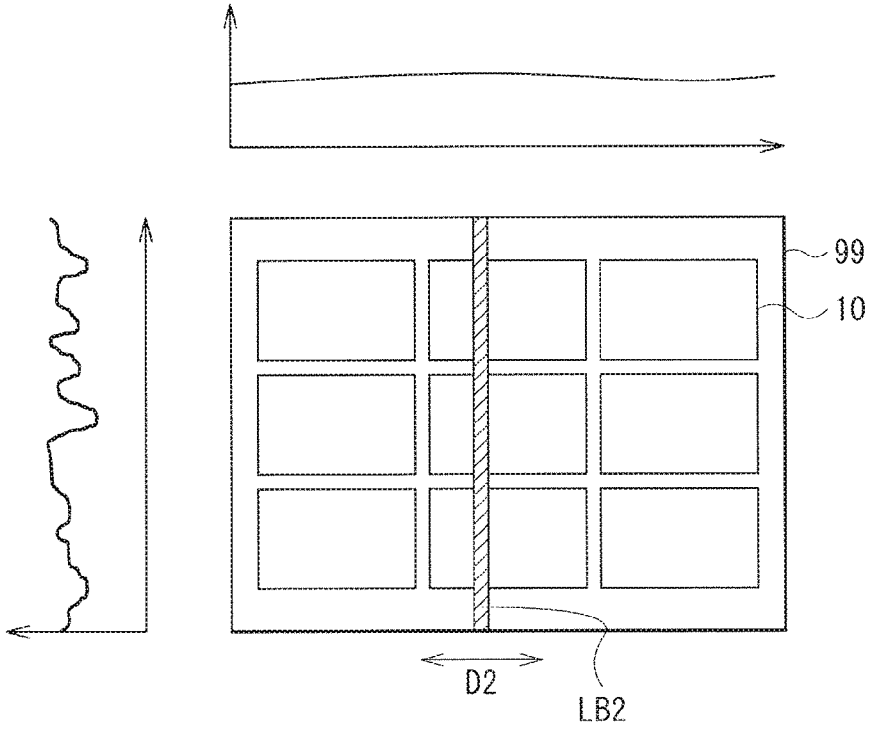
FIG. 13 is a schematic diagram illustrating a variation of a threshold voltage Vth due to a process through an ion implantation apparatus.

FIG. 12 schematically illustrates variations of the threshold voltage Vth due to the process using an ELA apparatus. FIG. 13 schematically illustrates variations of the threshold voltage Vth due to the process using an ion implantation apparatus. FIGS. 12 and 13 illustrate a case of forming a plurality of display sections 10 on a large glass substrate 99.

As illustrated in FIG. 12, an ELA apparatus scans the glass substrate 99 in the scanning direction D1 while switching a strip type laser beam (beam LB1) on and off, for example, in about several hundreds Hz, thus performing a process on the entire glass substrate 99. At this time, there is a possibility that laser energy is varied in each shot and characteristics of transistors adjacent in the scanning direction D1 are varied accordingly. In this case, in the scanning direction D1 (longitudinal direction of FIG. 12), the threshold voltage Vth of transistors is largely varied as compared to a direction (horizontal direction of FIG. 12) orthogonal to the scanning direction D1.

Also, as illustrated in FIG. 13, an ion implantation apparatus scans the glass substrate 99 in the scanning direction D2 while switching a strip type laser beam (beam LB2) on, thus performing a process to the entire glass substrate 99. As described above, an ion implantation apparatus constantly emits laser beams, and therefore, unlike a case of an ELA apparatus described above, variations in transistors adjacent in the scanning direction D2 are hard to be caused. On the other hand, in the long axis direction (direction orthogonal to the scanning direction D2) of the strip type laser beam, laser energy is possibly uneven and characteristics of the transistor adjacent in this long axis direction are possibly varied. In this case, in the direction (longitudinal direction of FIG. 13) orthogonal to the scanning direction D2, the threshold voltages Vth of transistors are largely varied as compared to the scanning direction D2 (transverse direction of FIG. 13).

To address such an issue, as illustrated in FIGS. 12 and 13, setting the scanning direction D1 through an ELA apparatus and the scanning direction D2 through an ion implantation apparatus to be orthogonal to each other makes it possible to suppress variations in the threshold voltages Vth of transistors in the transverse direction of FIGS. 12 and 13.

Figure 14:
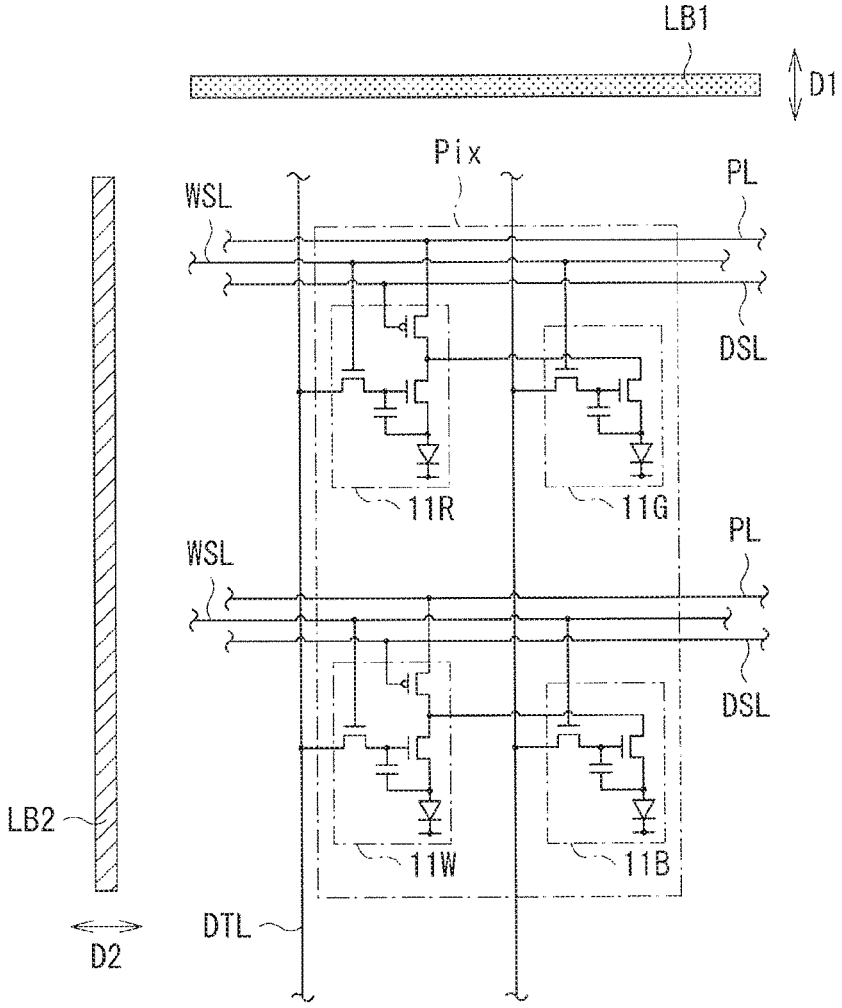
FIG. 14 is an explanatory view illustrating an arrangement of sub-pixels illustrated in FIG. 2.
Figure 15:
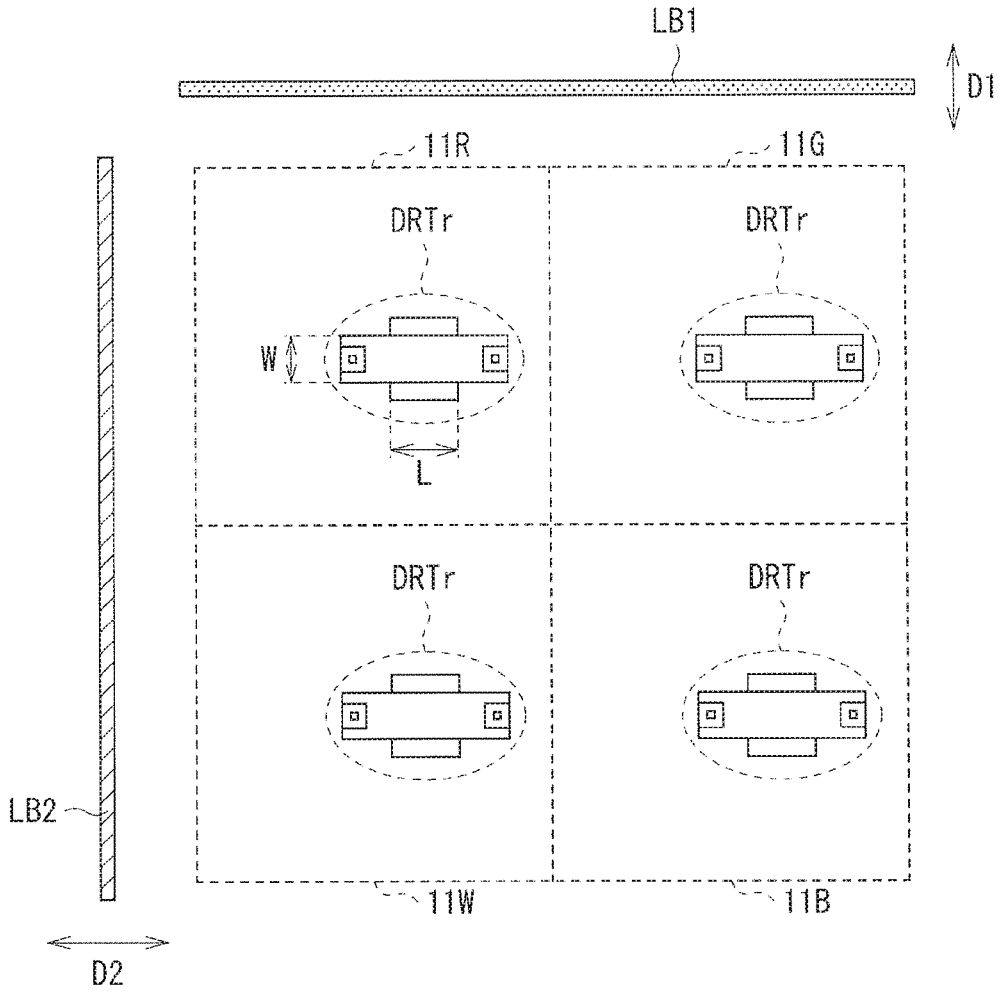
FIG. 15 is an explanatory view illustrating an arrangement of driving transistors in the sub-pixels illustrated in FIG. 2.

FIG. 14 illustrates a relationship between the scanning directions D1 and D2 and an arrangement of the sub-pixels 11 in the display section 10. FIG. 15 illustrates a relationship between the scanning directions D1 and D2 and an arrangement of the driving transistors DRTr in each sub-pixel 11.

As illustrated in FIG. 14, in the display section 10, the sub-pixels 11R and 11G belonging to the same pixel Pix are provided side-by-side in a direction orthogonal to the scanning direction D1 and in the same direction (transverse direction of FIG. 14) as the scanning direction D2. Similarly, the sub-pixels 11W and 11B belonging to the same pixel Pix are provided side-by-side in a direction orthogonal to the scanning direction D1 and in the same direction (transverse direction of FIG. 14) as the scanning direction D2.

More specifically, as illustrated in FIG. 15, the driving transistors DRTr in the sub-pixels 11R and 11G belonging to the same pixel Pix are provided side-by-side in a direction orthogonal to the scanning direction D1 and in the same direction (transverse direction of FIG. 15) as the scanning direction D2. Similarly, the driving transistors DRTr in the sub-pixels 11W and 11B belonging to the same pixel Pix are provided side-by-side in a direction orthogonal to the scanning direction D1 and in the same direction (transverse direction of FIG. 15) as the scanning direction D2. Each driving transistor DRTr is arranged so that a length (L) direction thereof is matched with the scanning direction D2.

Thereby, the threshold voltages Vth of the driving transistors DRTr in the sub-pixels 11R and 11G belonging to the same pixel Pix become substantially equal to each other. At the same time, the threshold voltages Vth of the driving transistors DRTr in the sub-pixels 11W and 11B belonging to the same pixel Pix become substantially equal to each other.

Comparative Example

Next, a display unit 1R according to a comparative example is described. The comparative example has a configuration in which the power supply transistor DSTr is not shared and each sub-pixel 11 has the power supply transistor DSTr. The other configurations are the same as those of the reference example (FIG. 1).

Figure 16:
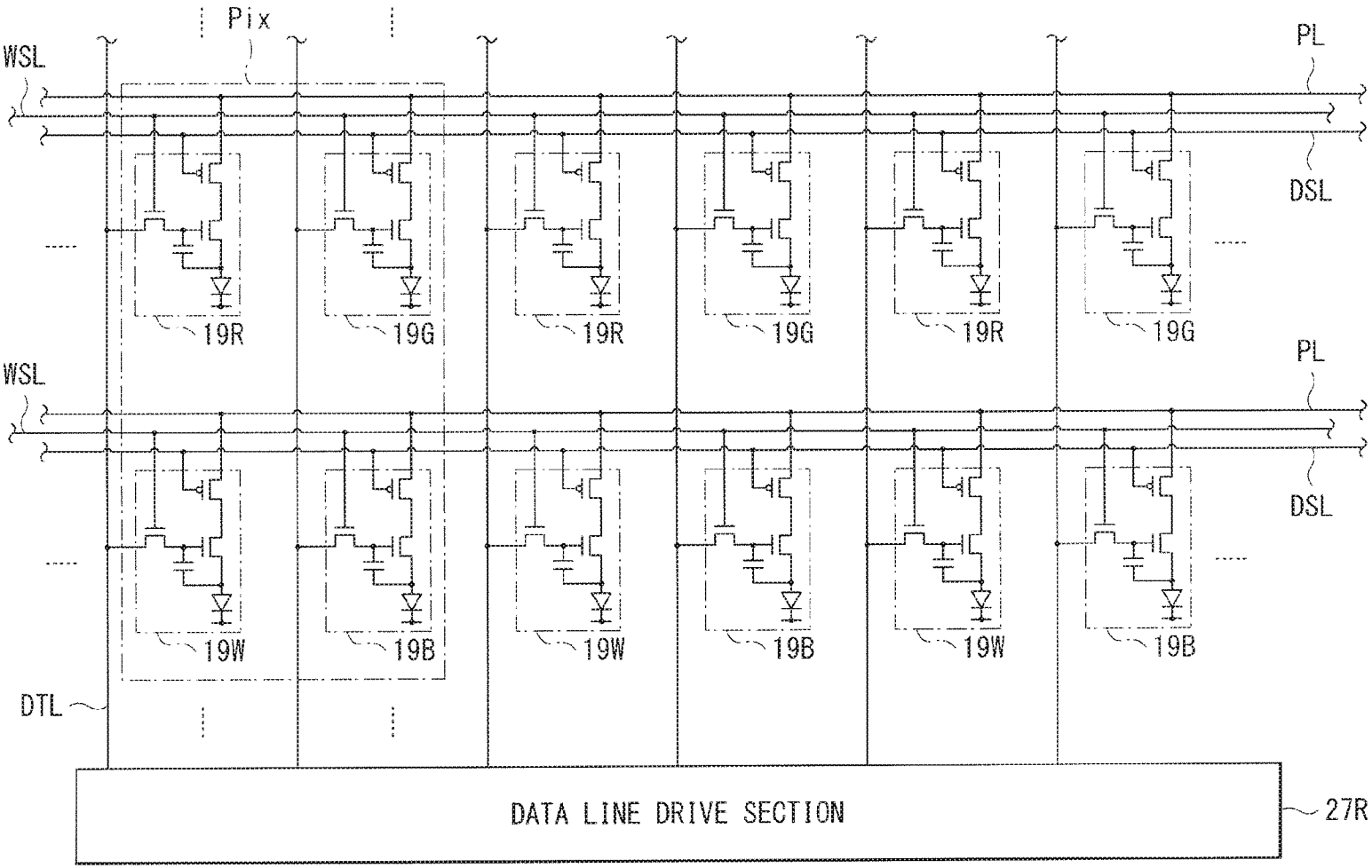
FIG. 16 is a circuit diagram illustrating a circuit configuration example of a display section according to a comparative example.

FIG. 16 illustrates one example of a circuit configuration of a display section 10R according to the display unit 1R. In the display section 10R, four sub-pixels 19R, 19G, 19B, and 19W included in the pixel Pix each have a so-called "3Tr1C" configuration. That is, in the display section 10 (FIG. 2) according to the reference example, the sub-pixels 11G and 11B each omit the provision of the power supply transistor DSTr, and share the power supply transistors DSTr of the sub-pixels 11R and 11W. However, in the display section 10R according to the comparative example, the sub-pixels 19G and 19B each also have the power supply transistor DSTr, similarly to the sub-pixels 19R and 19W.

In this way, in the display section 10R according to the comparative example, since all of the sub-pixels 19 have the so-called "3Tr1C" configuration, the number of transistors is large. This increases the area of the pixel Pix, making it difficult to improve the resolution.

In contrast, in the display section 10 according to the reference example, among four sub-pixels 11 included in the pixel Pix, the power supply transistor DSTr is eliminated in each of the two sub-pixels 11G and 11B, and the sub-pixels 11G and 11B share the power supply transistors DSTr of the sub-pixels 11R and 11W, thereby making it possible to reduce the number of transistors. Consequently, the area of the pixel Pix is made small, and the resolution of the display unit 1 is improved.

[Effect]

As described above, in the reference example, the power supply transistor is shared by the plurality of sub-pixels. Therefore, it is possible to improve the resolution of the display unit.

Further, in the reference example, since the plurality of sub-pixels adjacent to each other in a horizontal direction share the power supply transistor, operations are made simple.

Further, in the reference example, the scanning direction through an ELA apparatus and that through an ion implantation apparatus intersect with each other. Consequently, variations in characteristics are suppressed of the transistors in the direction that intersects with the scanning direction through the ELA apparatus and in the same direction as the scanning direction through the ion implantation apparatus.

In addition, in the reference example, the driving transistors in the plurality of sub-pixels that are associated with the share of the power supply transistor are provided side-by-side in the direction that intersects with the scanning direction through the ELA apparatus and in the same direction as the scanning direction through the ion implantation apparatus. Consequently, the threshold voltages of their driving transistors are made substantially equal to each other and reduction in an image quality is suppressed.

Another Reference Example 1-1

In the reference example, the pixel Pix is configured by the four sub-pixels 11 of red (R), green (G), blue (B), and white (W); however, not limited thereto. The present reference example is described in detail below.

Figure 17:
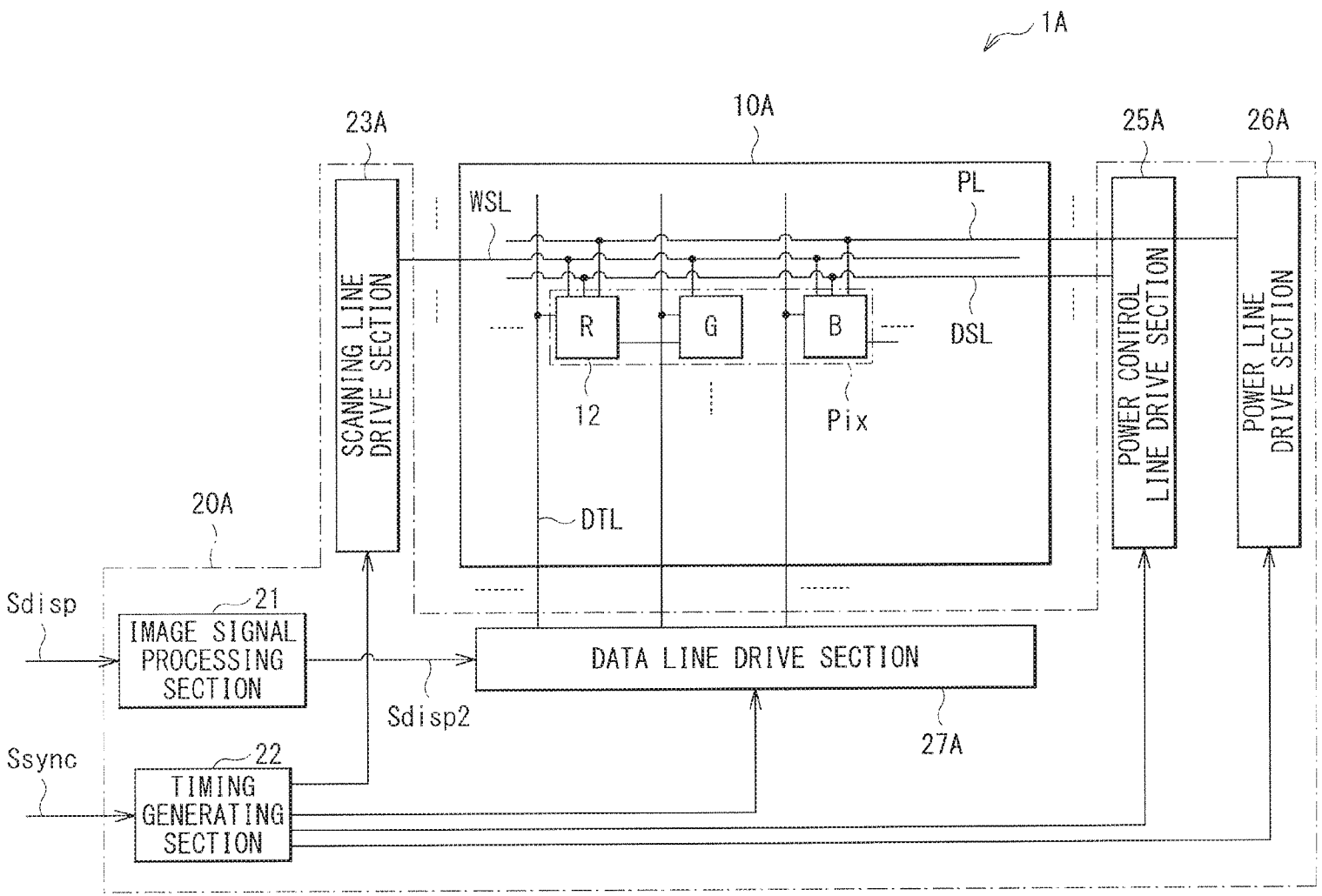
FIG. 17 is a block diagram illustrating one configuration example of a display unit according to another reference example.

FIG. 17 illustrates one configuration example of a display unit 1A according to the present reference example. The display unit 1A includes a display section 10A and a drive section 20A. Each pixel Pix of the display section 10A has three sub-pixels 12 of red (R), green (G), and blue (B). The drive section 20A includes a scanning line drive section 23A, a power control line drive section 25A, a power line drive section 26A, and a data line drive section 27A.

Figure 18:
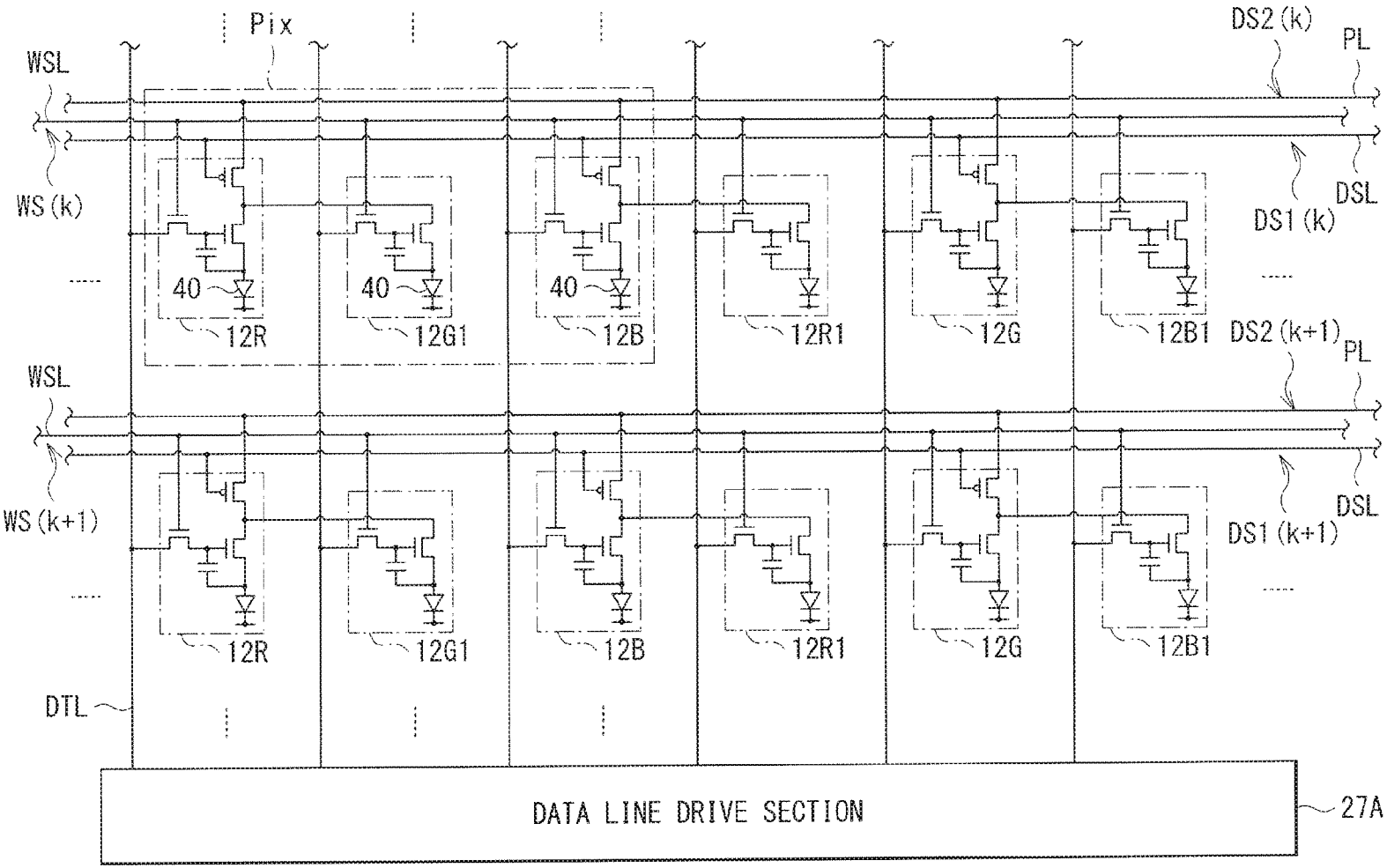
FIG. 18 is a circuit diagram illustrating a circuit configuration example of a display section illustrated in FIG. 17.

FIG. 18 illustrates one example of a circuit configuration of k-th row and (k+1)-th row pixels Pix in the display section 10A. In the display section 10A, three sub-pixels 12R, 12G, and 12B each having the power supply transistor DSTr of red (R), green (G), and blue (B) and three sub-pixels 12R1, 12G1, and 12B1 each having no power supply transistor DSTr of red (R), green (G), and blue (B) are arranged side-by-side. Specifically, the sub-pixels 12R, 12G1, 12B, 12R1, 12G, and 12B1 are repeatedly arranged in this order in the horizontal direction. Similarly to the display section 10 according to the reference example described above, in this display section 10A, two sub-pixels 12 adjacent in the horizontal direction are configured so as to share the power supply transistor DSTr. Further, three sub-pixels 12R, 12G1, and 12B configure the pixel Pix, or three sub-pixels 12R1, 12G, and 12B1 configure the pixel Pix.

Figure 19:
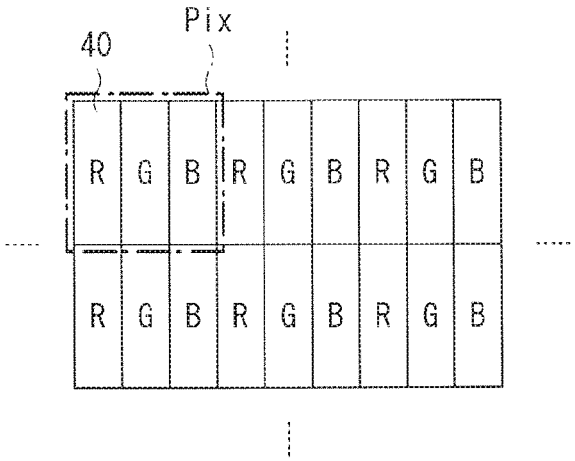
FIG. 19 is an explanatory view illustrating an arrangement of light emitting elements illustrated in FIG. 18.
Figure 20:
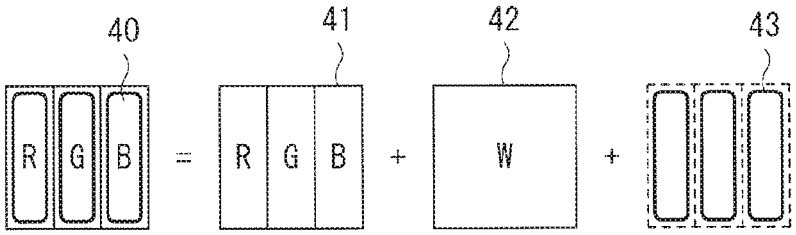
FIG. 20 is a schematic diagram illustrating a configuration of the light emitting elements illustrated in FIG. 18.
Figure 21:
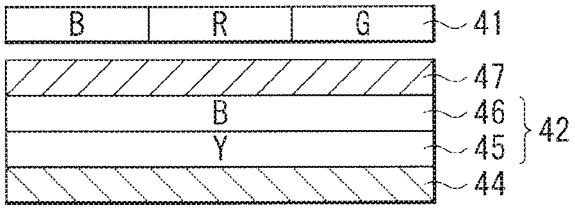
FIG. 21 is a cross-sectional view illustrating an essential-part cross-sectional structure of the light emitting elements illustrated in FIG. 18.
Figure 22:
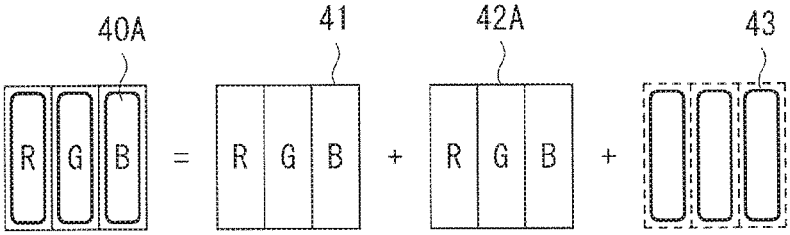
FIG. 22 is a schematic diagram illustrating a configuration of the light emitting elements illustrated in FIG. 18.
Figure 23:
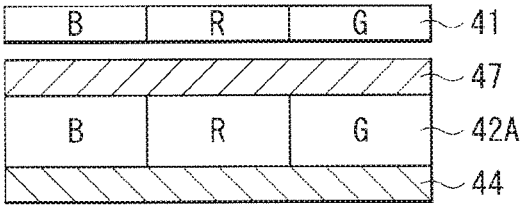
FIG. 23 is a cross-sectional view illustrating an essential-part cross-sectional structure of the light emitting elements illustrated in FIG. 18.

FIG. 19 illustrates an arrangement of light emitting elements 40 in the display section 10A. FIG. 20 schematically illustrates a configuration of the light emitting elements 40. FIG. 21 illustrates an essential-part cross-sectional structure of the light emitting elements 40. Color filters 41 and openings 43 are formed in accordance with three light emitting elements 40 of red (R), green (G), and blue (B). Similarly to the light emitting layer 32, a light emitting layer 42 is formed by laminating a yellow light-emitting layer 45 and a blue light-emitting layer 46, and emits light of white (W). When light emitting layers are laminated as described above, an order of the light emitting layers may be changed. It is to be noted that a configuration of the light emitting layers 42 is not limited thereto. In place of the above, for example, as in light emitting layers 42A illustrated in FIGS. 22 and 23, a red light-emitting layer, a green light-emitting layer, and a blue light-emitting layer may be formed in regions corresponding to the color filters 41 of red (R), green (G), and blue (B), respectively.

Figures 24A, 24B, 24C, 24D:
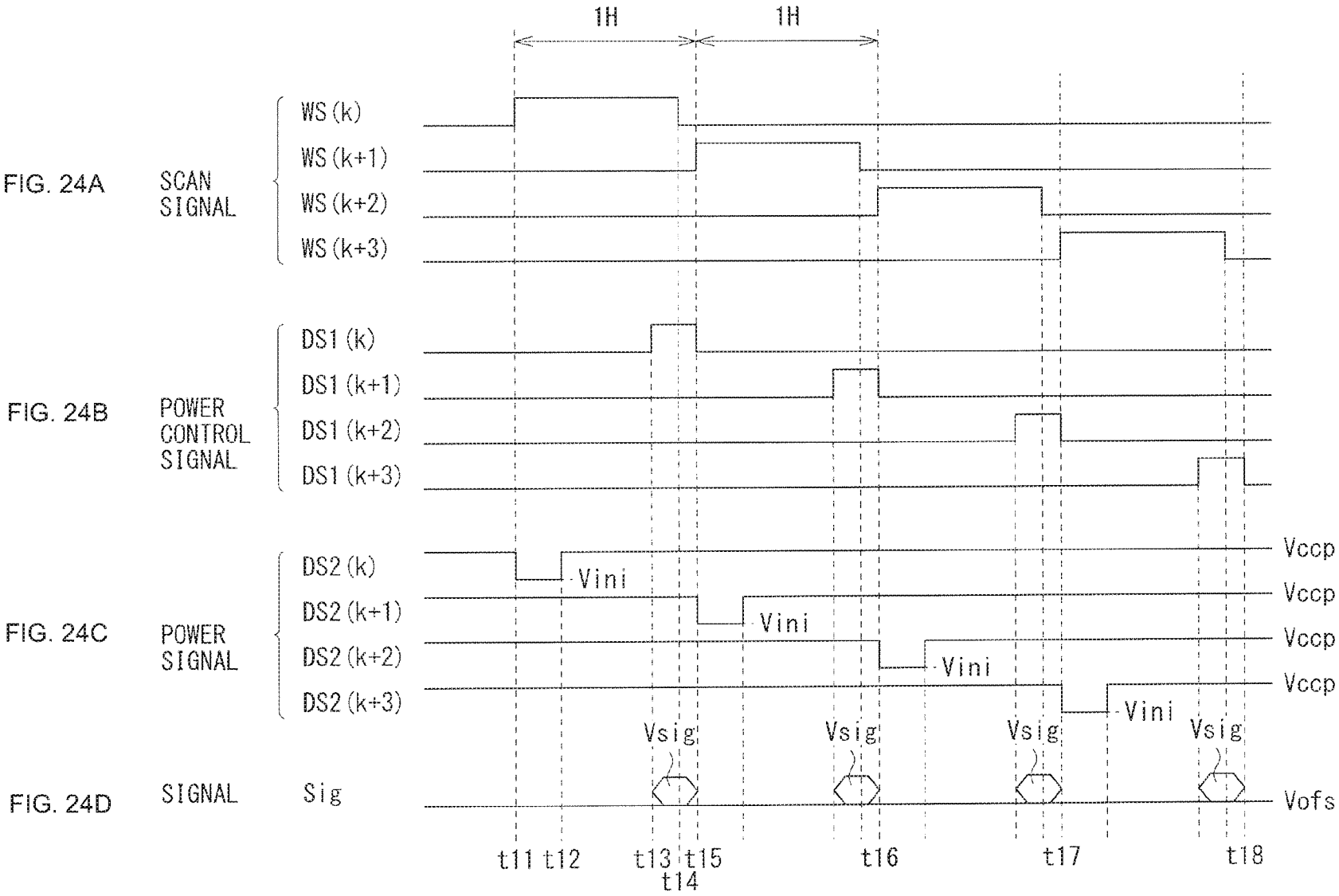
FIGS. 24A, 24B, 24C, and 24D are timing waveform diagrams illustrating one operation example of a drive section illustrated in FIG. 18.

FIGS. 24A, 24B, 24C and 24D are timing charts illustrating operations of the drive section 20A, in which FIG. 24A illustrates waveforms of the scan signals WS, FIG. 24B illustrates waveforms of the power control signals DS1, FIG. 24C illustrates waveforms of the power signals DS2, and FIG. 24D illustrates a waveform of the signal Sig. In FIG. 24A, a scan signal WS(k) is the scan signal WS which drives k-th row pixels Pix, a scan signal WS(k+1) is the scan signal WS which drives (k+1)-th row pixels Pix, a scan signal WS(k+2) is the scan signal WS which drives (k+2)-th row pixels Pix, and a scan signal WS(k+3) is the scan signal WS which drives (k+3)-th row pixels Pix. Much the same is true on the power control signal DS1 (FIG. 24B) and the power signal DS2 (FIG. 24C).

The scanning line drive section 23A of the drive section 20A sequentially applies the scan signal WS having a pulse shape to the scanning line WSL (FIG. 24A). On this occasion, the scanning line drive section 23 applies a pulse to one scanning line WSL in one horizontal period (1H). Similarly to a case (FIGS. 9A, 9B, 9C, and 9D) of the reference example described above, the power control line drive section 25A, the power line drive section 26A, and the data line drive section 27A supply each signal to the display section 10A in synchronization with the scan signal WS.

In this way, the drive section 20A drives sub-pixels 13 in the k-th row pixels Pix in the period of timing t1 to t5, and drives sub-pixels 13 in the (k+1)-th row pixels Pix in the period of timing t5 and t6. Similarly, the drive section 20A drives sub-pixels 13 in the (k+2)-th row pixels Pix in the period of timing t6 and t7, and drives sub-pixels 13 in the (k+3)-th row pixels Pix in the period of timing t7 and t8.

Figure 25:
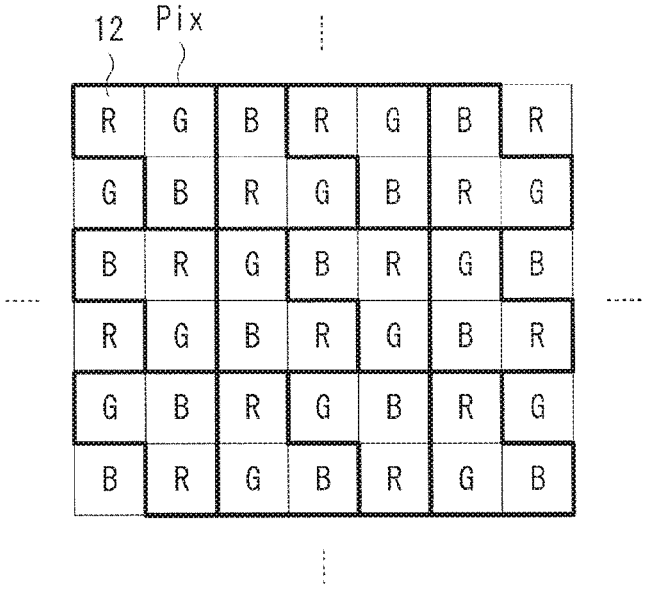
FIG. 25 is an explanatory view illustrating one example of an arrangement of pixels according to another reference example.
Figure 26:
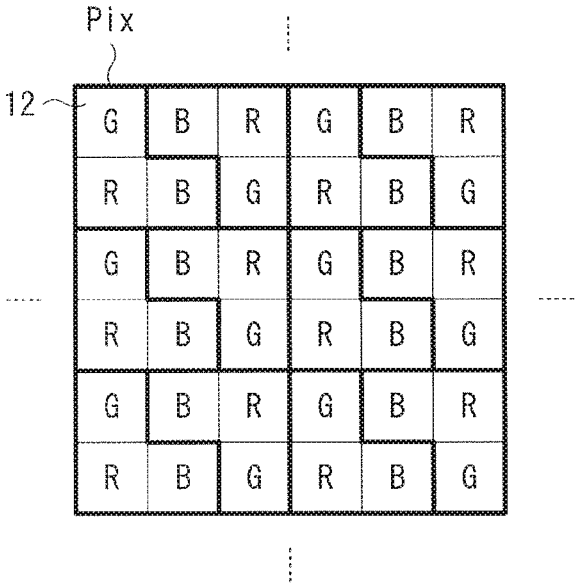
FIG. 26 is an explanatory view illustrating one example of an arrangement of a pixel according to another reference example.
Figure 27:
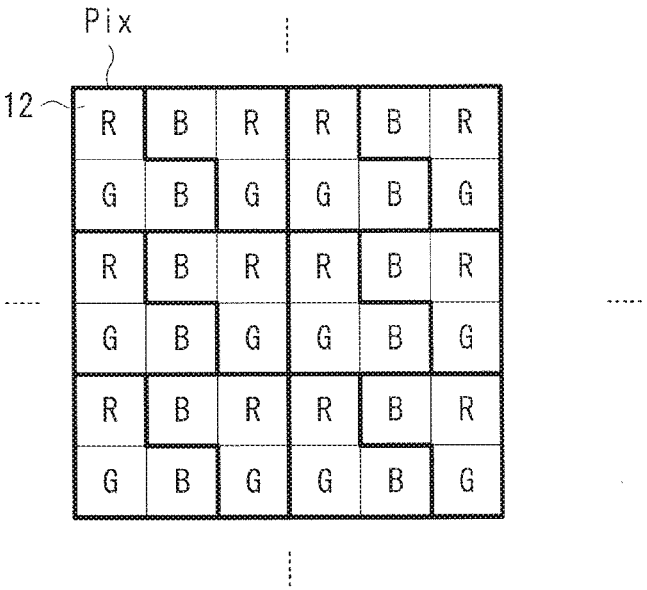
FIG. 27 is an explanatory view illustrating one example of an arrangement of a pixel according to another reference example.

In the display unit 1A, three sub-pixels 12 belonging to the same pixel Pix are arranged in the horizontal direction; however, not limited thereto. In place of the above, for example, as illustrated in FIGS. 25 to 27, they may be arranged so as to be extended over two rows. In these examples, for example, two sub-pixels among the three sub-pixels 12 may be arranged so as to be adjacent in the horizontal direction, and the other among the three sub-pixels 12 may be arranged so as to be adjacent to one of the two sub-pixels 12 in the vertical direction. Further, in FIGS. 26 and 27, the sub-pixel 12 of blue (B), which is low in visibility, may be arranged so as to line up in the vertical direction. Even in this case, similarly to the display section 10A, the two sub-pixels 12 adjacent in the horizontal direction are configured so as to share the power supply transistor DSTr.

Figure 28:
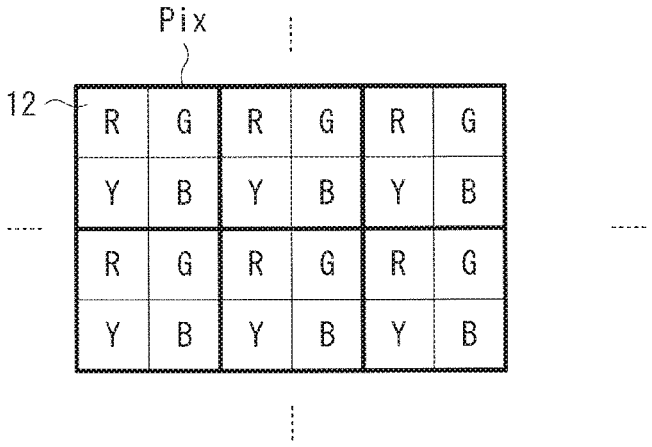
FIG. 28 is an explanatory view illustrating one example of an arrangement of a pixel according to another reference example.

Further, in the reference example described above, the pixel Pix is configured by four sub-pixels 11 of red (R), green (G), blue (B), and white (W); however, not limited thereto. In place of the above, for example, as illustrated in FIG. 28, the pixel Pix may be configured by four sub-pixels 12 of red (R), green (G), blue (B), and yellow (Y).

Another Reference Example 1-2

Figure 29:
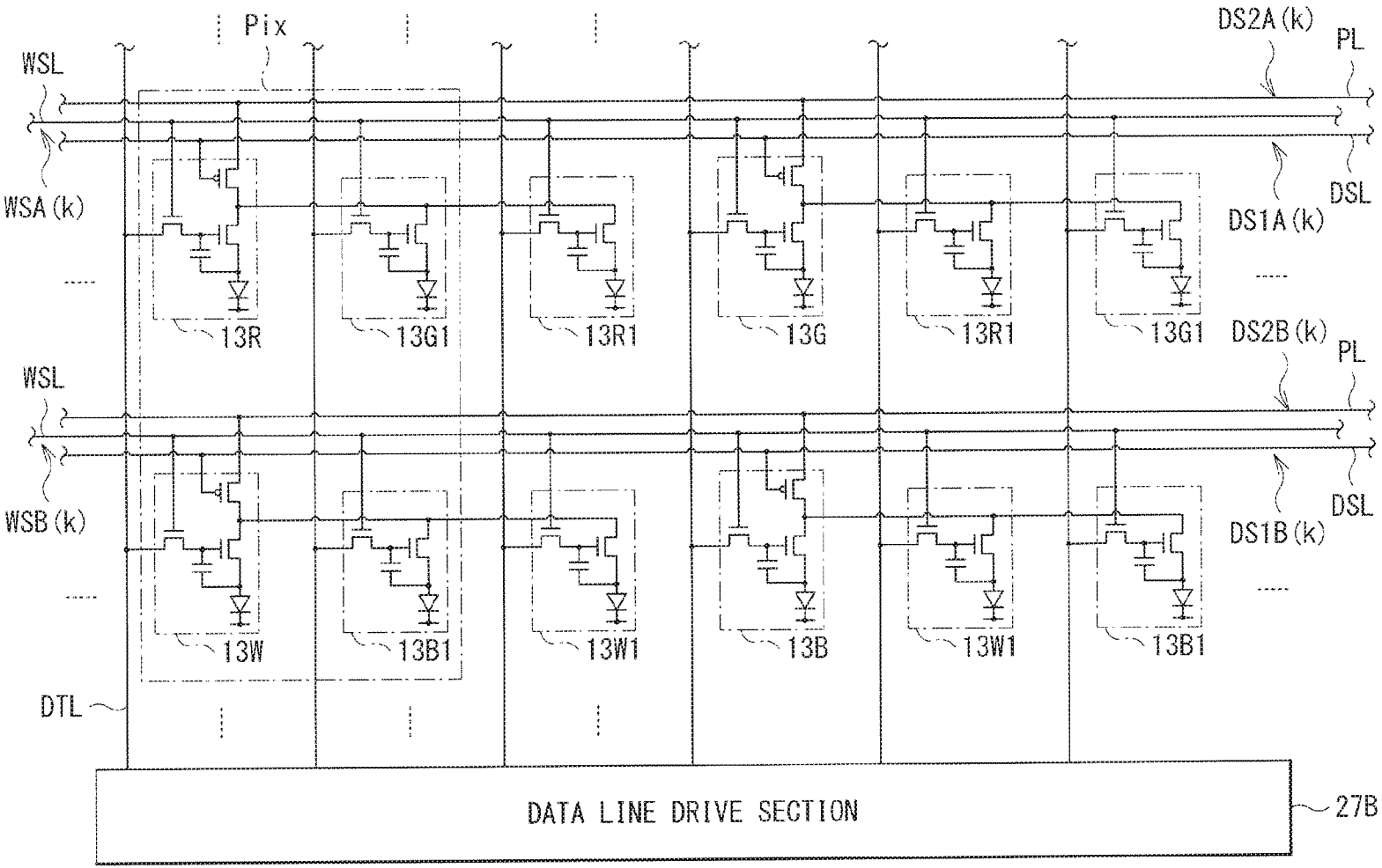
FIG. 29 is a circuit diagram illustrating a circuit configuration example of a display section according to another reference example.

In the reference example described above, two sub-pixels 11 adjacent in the horizontal direction share the power supply transistor DSTr; however, not limited thereto. In place of the above, three or more sub-pixels may share the power supply transistor DSTr. In FIG. 29, an example of a case where three sub-pixels 13 share the power supply transistor DSTr is illustrated.

Another Reference Example 1-3

Figure 30:
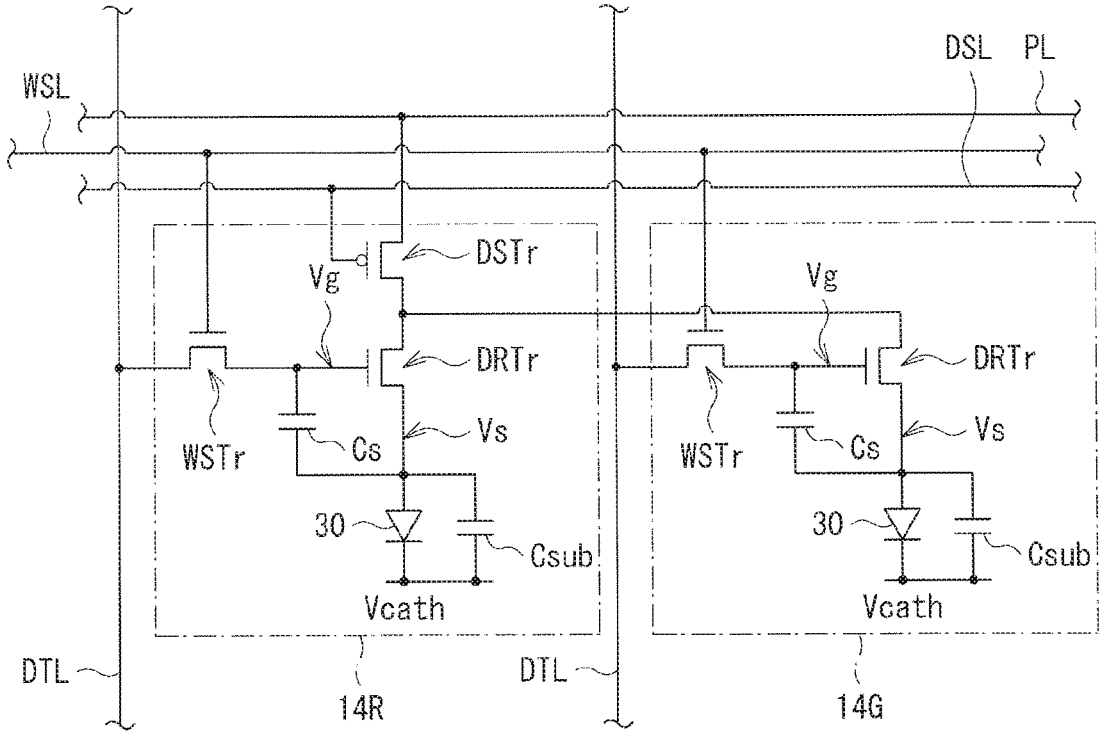
FIG. 30 is a circuit diagram illustrating a circuit configuration example of sub-pixels in the display section illustrated in FIG. 29.

In the reference example described above, the light emitting element 30 is connected to the source terminal of the driving transistor DRTr; however, not limited thereto. As illustrated in FIG. 30, for example, a capacitor Csub may be further connected to the source terminal of the driving transistor DRTr. In this example, this capacitor Csub is connected in parallel to the light emitting element 30; however, not limited thereto. In place of the above, for example, one end of the capacitor Csub may be connected to the anode of the light emitting element 30 and a DC voltage may be applied to the other end of the capacitor Csub.

Another Reference Example 1-4

In the reference example described above, in a configuration of the TFT, the gate electrode 110 is formed under the polysilicon layer 140; however, not limited thereto. In place of the above, for example, the gate electrode may be formed over the polysilicon layer. The present reference example is described in detail below.

Figure 31A:
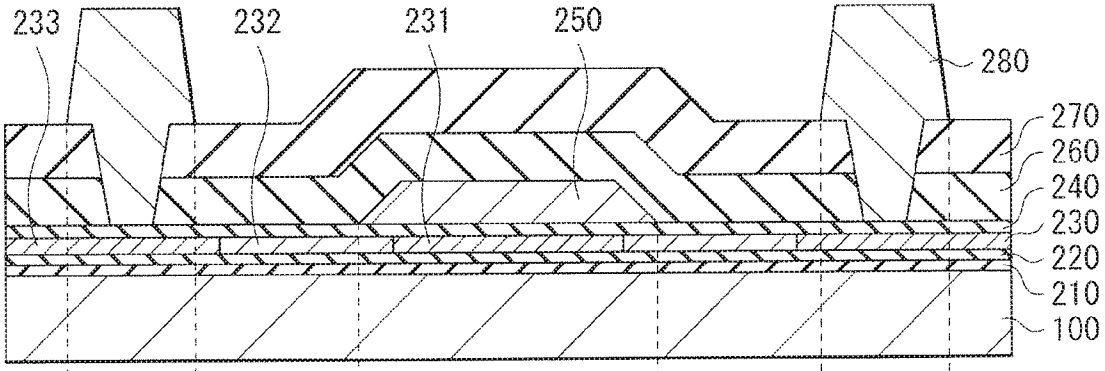
FIGS. 31A and 31B are explanatory views illustrating one configuration example of a transistor according to another reference example.
Figure 31B:
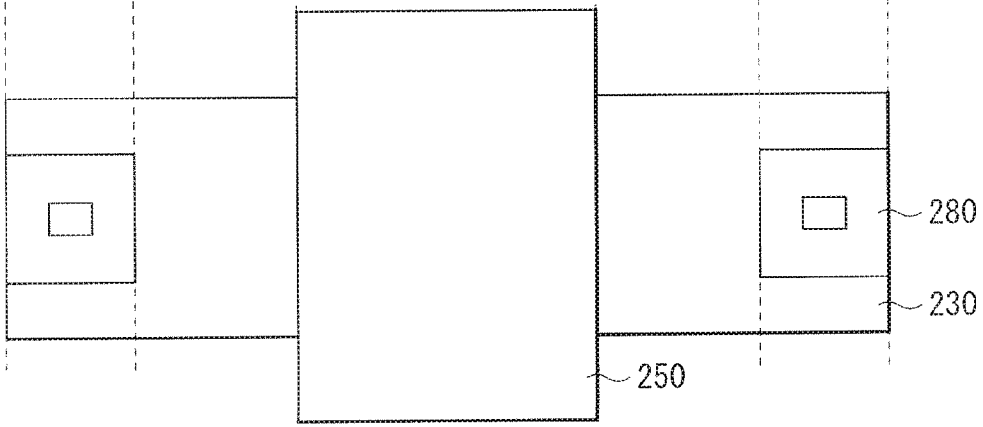

FIGS. 31A and 31B illustrates one configuration example of the TFT, in which FIG. 31A illustrates a cross-sectional view, and FIG. 31B illustrates an essential-part plan view. The TFT includes a gate electrode 250 and a polysilicon layer 230. The polysilicon layer 230 is formed over insulating layers 210 and 220 formed over the substrate 100. The insulating layer 210 may be formed, for example, by silicon nitride (SiNx), and the insulating layer 220 may be formed, for example, by silicon dioxide (SiO2). Similarly to a case of the reference example described above, the polysilicon layer 230 is configured by a channel region 231, an LDD 232, and a contact region 233. An insulating layer 240 is formed on this polysilicon layer 230. This insulating layer 240 may be formed, for example, by silicon dioxide (SiO2). The gate electrode 250 is formed on the insulating layer 240. The gate electrode 250 may be formed, for example, by molybdenum Mo. In this way, in this example, the gate electrode 250 is formed over the polysilicon layer 230. That is, this TFT has a so-called a top-gate structure. Over the gate electrode 250 and the insulating layer 240, insulating layers 260 and 270 are formed in this order. The insulating layer 260 may be formed, for example, by silicon dioxide (SiO2), and the insulating layer 270 may be formed, for example, by silicon nitride (SiNx). On the insulating layer 270, wiring 280 is formed. In the insulating layers 240, 260, and 270, an opening is formed in a region corresponding to the contact region 233 of the polysilicon layer 230. Further, through this opening, the wiring 280 is formed so as to be connected to the contact region 233.

Another Reference Example 1-5

Figure 32:
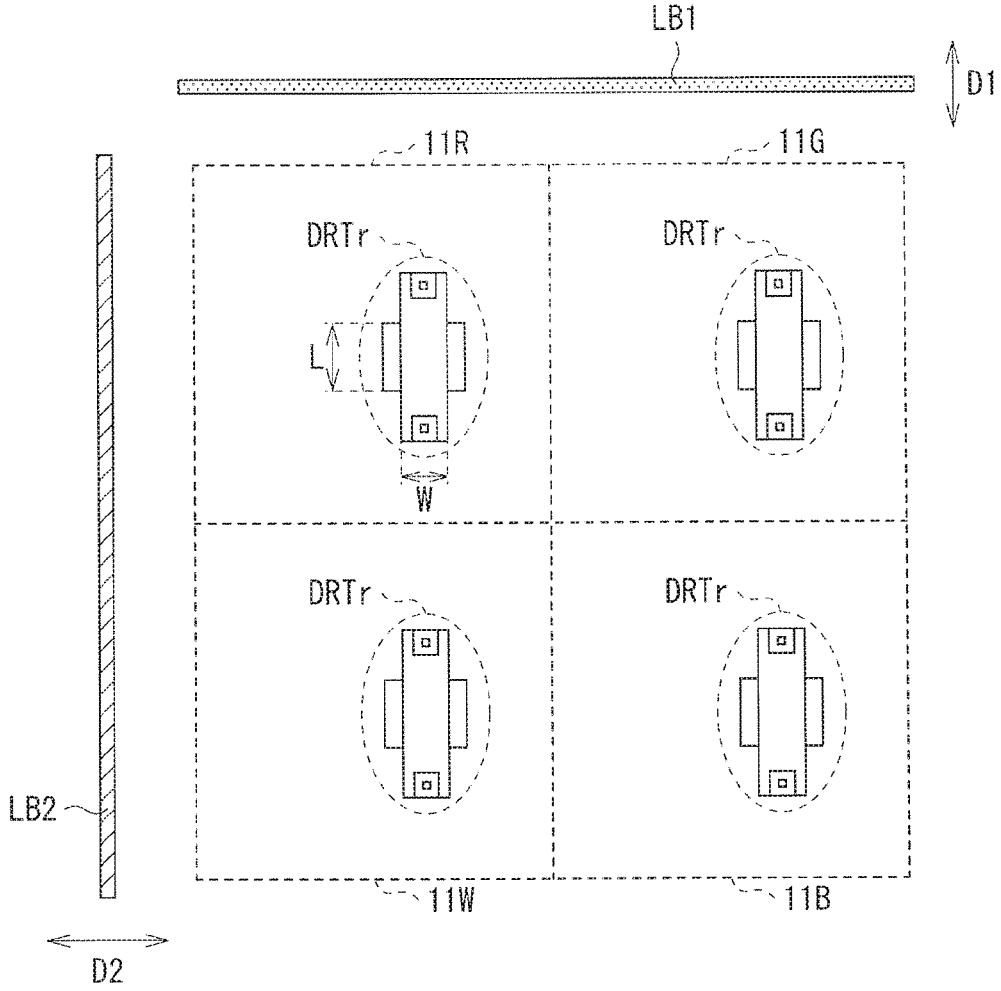
FIG. 32 is an explanatory view illustrating an arrangement of driving transistors in sub-pixels according to another reference example.

In the reference example described above, the driving transistor DRTr is arranged so that a length (L) direction may be matched with the scanning direction D2; however, not limited thereto. In place of the above, for example, as illustrated in FIG. 32, the driving transistor DRTr may be arranged so that a width (W) direction may be matched with the scanning direction D2.

2. Embodiment

Next, a display unit 2 according to an embodiment is described. In the present embodiment, two sub-pixels adjacent in the vertical direction are configured so as to share the power supply transistor DSTr. Here, a method of manufacturing the display unit according to an embodiment of the present disclosure is embodied by the present embodiment, and therefore is described collectively. Components which are substantially the same as those of the display unit 1 according to the reference example are indicated by the same reference numerals as in the display unit 1, and descriptions are omitted where appropriate.

Figure 33:
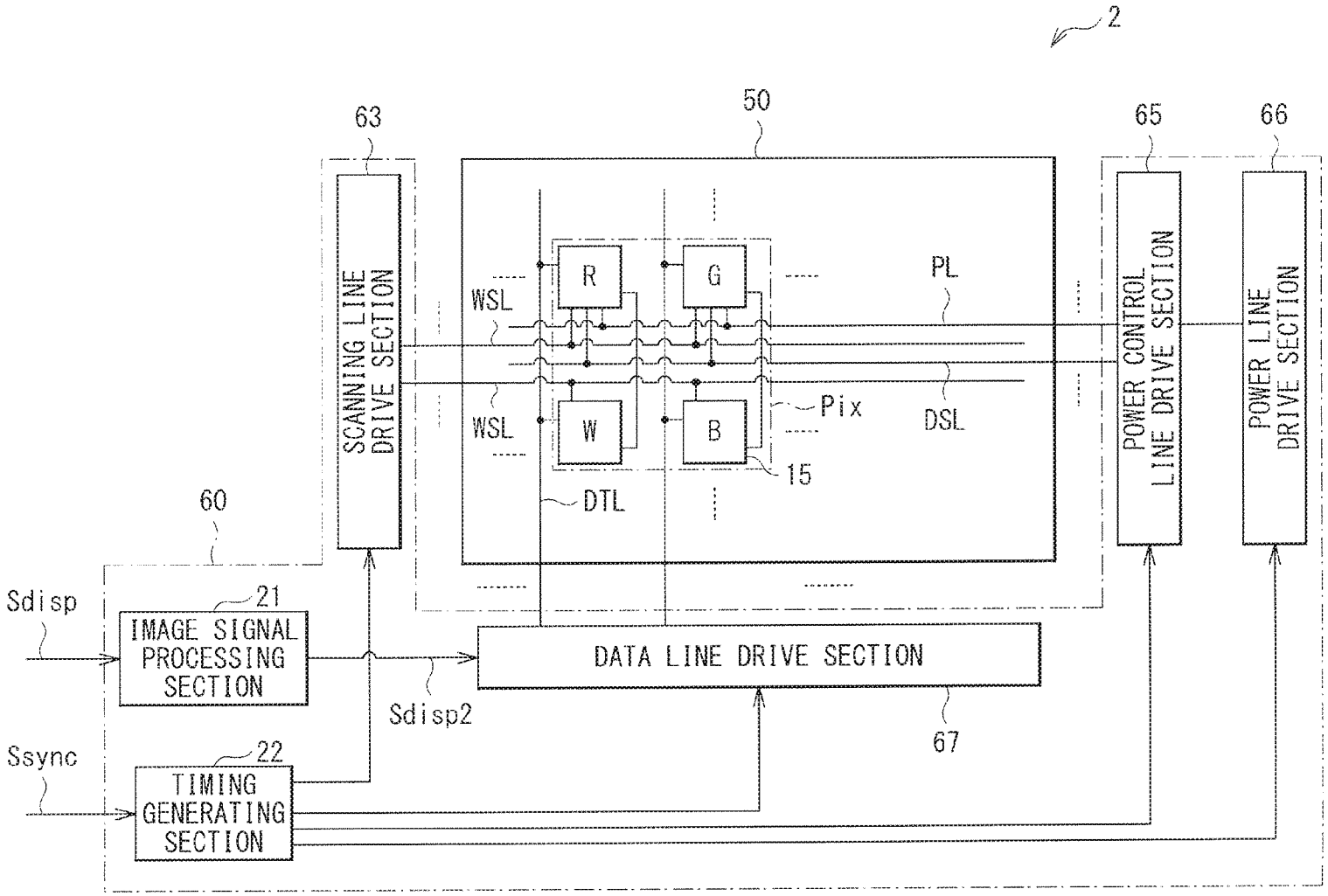
FIG. 33 is a block diagram illustrating one configuration example of a display unit according to an embodiment.

FIG. 33 illustrates one configuration example of the display unit 2 according to the present embodiment. The display unit 2 includes a display section 50 and a drive section 60. Each pixel Pix of the display section 50 has four sub-pixels 15 of red (R), green (G), blue (B), and white (W). The drive section 60 includes a scanning line drive section 63, a power control line drive section 65, a power line drive section 66, and a data line drive section 67.

Figure 34:
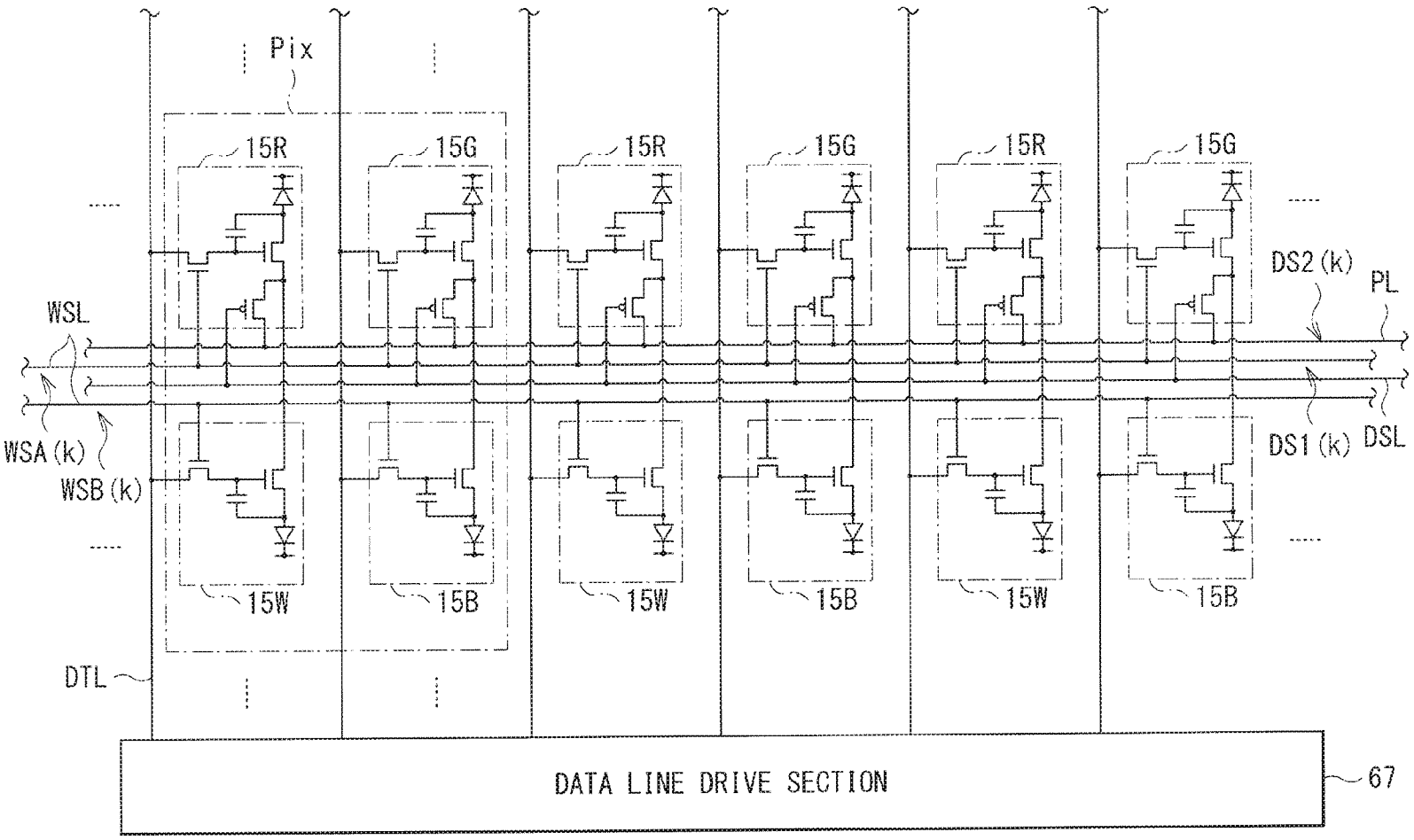
FIG. 34 is a circuit diagram illustrating a circuit configuration example of a display section illustrated in FIG. 33.

FIG. 34 illustrates one example of a circuit configuration of k-th row pixels Pix in the display section 50. The pixel Pix has four sub-pixels 15 (15R, 15G, 15B, and 15W) of red (R), green (G), blue (B), and white (W). Similarly to the display section 10 according to the reference example described above, the four sub-pixels 15R, 15G, 15B, and 15W are arranged in the pixel Pix in two rows and two columns. Among the four sub-pixels 15R, 15G, 15B, and 15W, the sub-pixels 15R and 15G are connected to the scanning line WSL, the power line PL, the power control line DSL, and the data line DTL, and the sub-pixels 15W and 15B are connected to the scanning line WSL and the data line DTL. A row including the sub-pixels 15R and a row including the sub-pixels 15W share the power line PL and the power control line DSL. As described in detail later, the sub-pixel 15R is connected to the sub-pixel 15W, and the sub-pixel 15G is connected to the sub-pixel 15B.

Figure 35:
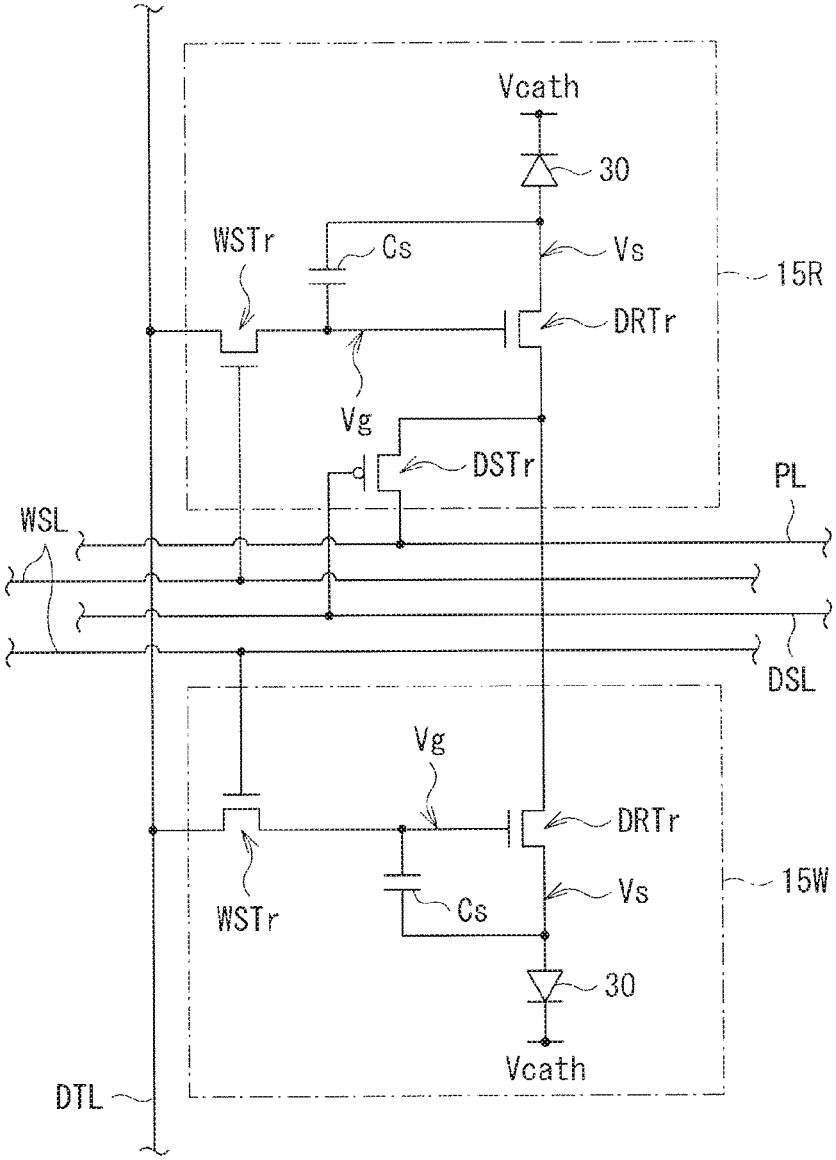
FIG. 35 is a circuit diagram illustrating a circuit configuration example of sub-pixels in the display section illustrated in FIG. 33.

FIG. 35 illustrates one example of a circuit configuration of the sub-pixels 15R and 15W. Further, much the same is true on the sub-pixels 15G and 15B. The sub-pixel 15R has the writing transistor WSTr, the driving transistor DRTr, the power supply transistor DSTr, the capacitor Cs, and the light emitting element 30. The sub-pixel 15W has the writing transistor WSTr, the driving transistor DRTr, the capacitor Cs, and the light emitting element 30. The sub-pixels 15R and 15W share the power supply transistor DSTr. That is, the display section 10 according to the reference example described above is configured so that two sub-pixels 11 adjacent in the horizontal direction may share the power supply transistor DSTr. On the other hand, the display section 50 according to the present embodiment is configured so that two sub-pixels 15 adjacent in the vertical direction may share the power supply transistor DSTr. Through the configuration, it is possible to reduce the number of the power supply transistors DSTr, the power lines PL, and the power control lines DSL, and therefore resolution of the display unit 2 is improved. Here, in this example, in the sub-pixels 15R and 15W, the sub-pixel 15R has the power supply transistor DSTr; however, not limited thereto. In place of the above, for example, the sub-pixel 15W may have the power supply transistor DSTr.

In each of the sub-pixels 15R and 15W, in the writing transistor WSTr, each gate is connected to the scanning line WSL, each source is connected to the data line DTL, and each drain is connected to each gate of the driving transistors DRTr and each one end of the capacitors Cs. In the driving transistor DRTr, each gate is connected to each drain of the writing transistors WSTr and each one end of the capacitors Cs, each drain is connected to a drain, etc., of the power supply transistor DSTr of the sub-pixel 15R, and each source is connected to each other end of the capacitors Cs and each anode of the light emitting elements 30. In the sub-pixel 15R, in the power supply transistor DSTr, a gate is connected to the power control line DSL, a source is connected to the power line PL, and the drain is connected to the drain of the driving transistor DRTr of the sub-pixel 15R and the drain of the driving transistor DRTr of the sub-pixel 15W.

As illustrated in FIG. 34, the scanning line drive section 63 supplies the scan signal WSA to the sub-pixels 15R and 15G, and supplies the scan signal WSB to the sub-pixels 15W and 15B, thereby sequentially selecting the sub-pixel 15. As illustrated in FIG. 34, the power control line drive section 65 supplies the power control signal DS1 to the sub-pixel 15, thereby controlling a light emission operation and a light extinction operation of the sub-pixel 15. As illustrated in FIG. 34, the power line drive section 66 supplies the power signal DS2 to the sub-pixel 15, thereby controlling a light emission operation and a light extinction operation of the sub-pixel 15. The data line drive section 67 generates the signal Sig including the pixel voltage Vsig which instructs a light emission luminance of each sub-pixel 15 and the voltage Vofs which performs the Vth correction operation.

Here, the light emitting element 30 corresponds to one specific example of a "display element" in one embodiment of the disclosure. The sub-pixels 15R, 15G, 15B, and 15W each correspond to one specific example of a "unit pixel" in one embodiment of the disclosure. The sub-pixels 15R and 15W, and the sub-pixels 15G and 15B each correspond to one specific example of a "pair of unit pixels" in one embodiment of the disclosure.

Figures 36A, 36B, 36C, 36D:
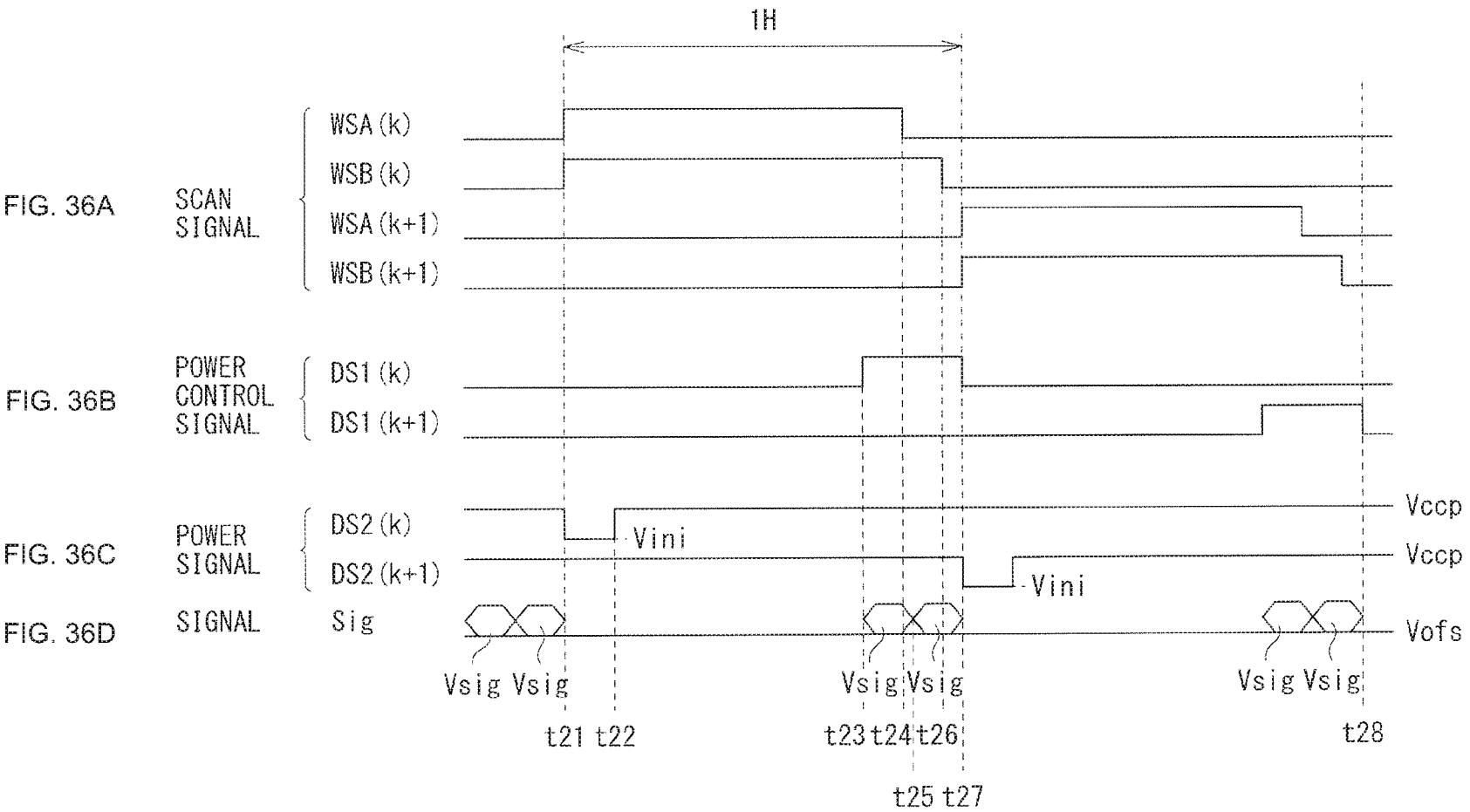
FIGS. 36A, 36B, 36C, and 36D are timing waveform diagrams illustrating one operation example of a drive section illustrated in FIG. 33.

FIGS. 36A, 36B, 36C and 36D are timing chart illustrating operations of the drive section 60, in which FIG. 36A illustrates waveforms of the scan signals WS (WSA, WSB), FIG. 36B illustrates waveforms of the power control signals DS1, FIG. 36C illustrates waveforms of the power signals DS2, and FIG. 36D illustrates a waveform of the signal Sig.

The scanning line drive section 63 of the drive section 60 applies pulses to two scanning lines WSL in one horizontal period (1H) (FIG. 36A). In two pulses, start timing (timing t21, etc.) is almost the same; however, end timing is varied (timing t24 and t26, etc.). To the power line PL, the power line drive section 66 applies the power signal DS2 at the voltage Vini only in a predetermined period (timing t21 and t22, etc.) after start timing of pulses of the scan signal WS and at the voltage Vccp in the other period (FIG. 36C). To the power control line DSL, the power control line drive section 65 applies the power control signal DS1 at a high level only in a predetermined period (timing t23 to t27, etc.) including terminal timing (timing t24 and t26, etc.) of two pulses of the scan signals WS and at a low level in the other period (FIG. 36B). To the data line DTL, the data line drive section 67 applies the pixel voltage Vsig in a period (timing t23 to t27, etc.) at which the power control signal DS1 becomes a high level and applies the voltage Vofs in the other period (FIG. 36D). On this occasion, among four sub-pixels 15 in the pixel Pix, the data line drive section 67 sequentially outputs the pixel voltage Vsig of two sub-pixels 15 connected to the same data line DTL in a period at which the power control signal DS1 is at a high level. Specifically, the data line drive section 67 outputs the pixel voltage VsigR to be written in the sub-pixel 15R and the pixel voltage VsigW to be written in the sub-pixel 15W, in this order, to the data line DTL to which the sub-pixels 15R and 15W are connected. Further, the data line drive section 67 outputs the pixel voltage VsigG to be written in the sub-pixel 15G and the pixel voltage VsigB to be written in the sub-pixel 15B, in this order, to the data line DTL to which the sub-pixels 15G and 15B are connected.

In this way, the drive section 60 drives the sub-pixels 15R, 15G, 15B, and 15W in the k-th row pixels Pix in the period of timing t21 to t27. Similarly, the drive section 60 drives the sub-pixels 15R, 15G, 15B, and 15W in the (k+1)-th row pixels Pix in the period of timing t27 and t28.

Figures 37A, 37B, 37C, 37D, 37E, 37F, 37G, 37H, 37I:
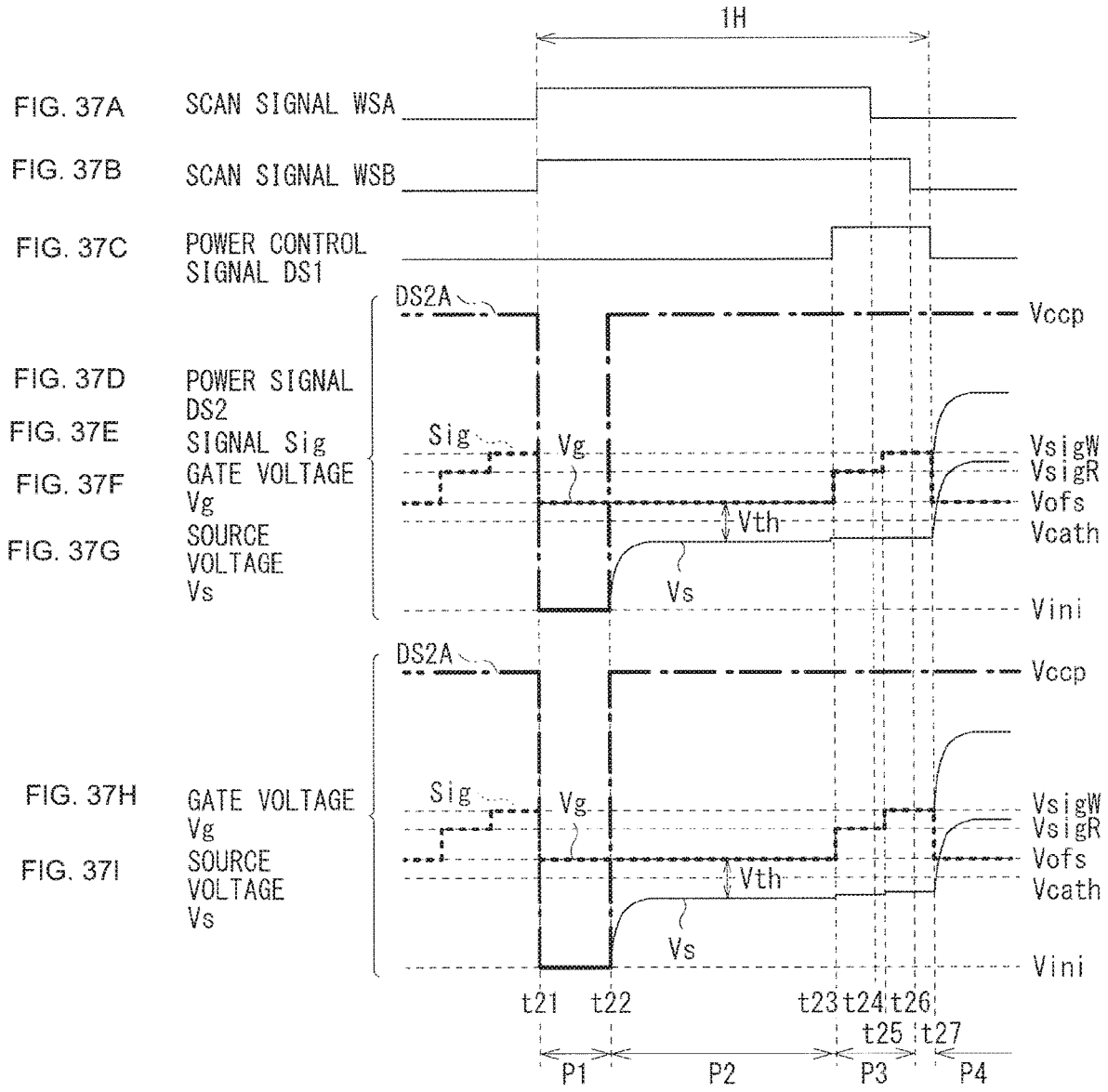
FIGS. 37A, 37B, 37C, 37D, 37E, 37F, 37G, 37H, and 37I are timing waveform diagrams illustrating one operation example of a drive unit illustrated in FIG. 33.

FIGS. 37A, 37B, 37C, 37D, 37E, 37F, 37G, 37H and 37I are timing charts illustrating operations of the sub-pixels 15R and 15W in the period of timing t21 to t27, in which FIG. 37A illustrates a waveform of the scan signal WSA, FIG. 37B illustrates a waveform of the scan signal WSB, FIG. 37C illustrates a waveform of the power control signal DS1, FIG. 37D illustrates a waveform of the power signal DS2, FIG. 37E illustrates a waveform of the signal Sig, FIG. 37F illustrates a waveform of the gate voltage Vg of the driving transistor DRTr in the sub-pixel 15R, FIG. 37G illustrates a waveform of the source voltage Vs of the driving transistor DRTr in the sub-pixel 15R, FIG. 37H illustrates a waveform of the gate voltage Vg of the driving transistor DRTr in the sub-pixel 15W, and FIG. 37I illustrates a waveform of the source voltage Vs of the driving transistor DRTr in the sub-pixel 15W. In FIGS. 37D, 37E, 37F and 37G, each waveform is illustrated by using the same voltage axis, and similarly, each waveform is illustrated by using the same voltage axis in FIGS. 37H and 37I. For convenience of description, the same waveforms as those of the power signal DS2 (FIG. 37D) and the signal Sig (FIG. 37E) are illustrated on the same voltage axis as that of FIGS. 37H and 37I.

In one horizontal period (1H), the drive section 60 performs the initialization operation of the sub-pixels 15R and 15W (initialization period P1), performs the Vth correction operation for suppressing an influence exerted on an image quality by element variations of the driving transistors DRTr (Vth correction period P2), and performs the writing operation of the pixel voltage Vsig to the sub-pixels 15R and 15W (writing period P3). Then, the light emitting elements 30 of the sub-pixels 15R and 15W emit light with luminance according to the written pixel voltage Vsig (light emitting period P4). In parallel with the above operations, the drive section 60 performs the initialization operation, the Vth correction operation, and the writing operation of the pixel voltage Vsig to the sub-pixels 15G and 15B. Then, the light emitting elements 30 of the sub-pixels 15G and 15B emit light. Descriptions are made in detail below.

In the period of timing t21 and t22 (initialization period P1), the drive section 60 first initializes the sub-pixels 15R and 15W. Specifically, at the timing t21, the data line drive section 67 first sets voltages of the signals Sig supplied to the sub-pixels 15R and 15W to the voltages Vofs (FIG. 37E). Further, the scanning line drive section 63 varies voltages of the scan signals WSA and WSB from a low level to a high level (FIGS. 37A and 37B). Thereby, the writing transistors WSTr in the sub-pixels 15R and 15W are turned on, and the gate voltages Vg of the driving transistors DRTr in the sub-pixels 15R and 15W are set to the voltages Vofs (FIGS. 37F and 37H). At the same time as the above, the power line drive section 66 varies the power signal DS2 from the voltage Vccp to the voltage Vini (FIG. 37D). Thereby, the driving transistors DRTr are turned on, and the source voltages Vs of the driving transistors DRTr are set to the voltages Vini (FIGS. 37G and 37I). As a result, in the sub-pixels 15R and 15W, the gate-source voltages Vgs (=Vofs-Vini) of the driving transistors DRTr are set to voltages larger than the threshold voltages Vth of the driving transistors DRTr, and the sub-pixels 15R and 15W are initialized.

Next, the drive section 60 performs the Vth correction operation in a period (Vth correction period P2) of timing t22 and t23. Specifically, the power line drive section 66 varies the power signals DS2 from the voltage Vini to the voltage Vccp at the timing t22 (FIG. 37D). Thereby, the driving transistors DRTr in the sub-pixels 15R and 15W perform operations at saturation regions, the current Ids flows from the drain to the source, and the source voltages Vs rise up (FIGS. 37G and 37I). In this way, the gate-source voltages Vgs of the driving transistors DRTr in the sub-pixels 15R and 15W converge so as to be equal to the threshold voltages Vth of the driving transistors DRTr (Vgs=Vth).

Next, in the period (writing period P3) of the timing t23 to t26, the drive section 60 performs a writing operation of the pixel voltages Vsig on the sub-pixels 15R and 15W. Specifically, at the timing t23, the power control line drive section 65 first varies a voltage of the power control signal DS1 from a low level to a high level (FIG. 37C. Thereby, the power supply transistor DSTr is turned off. At the same time as the above, the data line drive section 67 sets the signal Sig to have the pixel voltage VsigR (FIG. 37E). Thereby, the gate voltages Vg of the driving transistors DRTr in the sub-pixels 15R and 15W rise up from the voltage Vofs to the pixel voltage VsigR (FIGS. 37F and 37H). The source voltages Vs of the driving transistors DRTr in the sub-pixels 15R and 15W also rise up somewhat again accordingly (FIGS. 37G and 37I). At the timing t24, the scanning line drive section 63 then varies a voltage of the scan signal WSA from a high level to a low level (FIG. 37A). Thereby, the writing transistor WSTr in the sub-pixel 15R is turned off. Subsequently, a voltage between terminals of the capacitor Cs in the sub-pixel 15R, namely, the gate-source voltage Vgs of the driving transistor DRTr in the sub-pixel 15R is maintained. At the timing t25, the data line drive section 67 then sets a voltage of the signal Sig to the pixel voltage VsigW (FIG. 37E). Thereby, the gate voltage Vg of the driving transistor DRTr in the sub-pixel 15W is varied from the voltage VsigR to the pixel voltage VsigW (FIG. 37H).

The source voltage Vs of the driving transistor DRTr in the sub-pixel 15W also rises up somewhat again accordingly (FIG. 37I).

Next, at the timing t26, the scanning line drive section 63 varies a voltage of the scan signal WSB from a high level to a low level (FIG. 37B). Thereby, the writing transistor WSTr in the sub-pixel 15W is in an off state. Subsequently, a voltage between terminals of the capacitor Cs in the sub-pixel 15W, namely, the gate-source voltage Vgs of the driving transistor DRTr in the sub-pixel 15W is maintained.

In the period (light emitting period P4) at the timing t27 or later, the drive section 60 then causes the sub-pixels 15R and 15W to emit light. Specifically, at the timing t27, the power control line drive section 65 varies a voltage of the power control signal DS1 from a high level to a low level (FIG. 37C). Thereby, the power supply transistor DSTr is turned on and the current Ids flows through the driving transistors DRTr in the sub-pixels 15R and 15W. As the current Ids flows through the driving transistors DRTr, the source voltages Vs of the driving transistors DRTr rise up (FIGS. 37G and 37I, and the gate voltages Vg of the driving transistors DRTr rise up accordingly (FIGS. 37F and 37H). Through such a bootstrap operation, the source voltage Vs of the driving transistor DRTr becomes larger than the sum (Vel+Vcath) of the threshold voltage Vel and the voltage Vcath of the light emitting element 30. At this time, between the anode and the cathode of the light emitting element 30, a current flows and the light emitting element 30 emits light.

Then, in the display unit 1, after a predetermined period (one frame period) has elapsed, a transition is performed from the light emitting period P3 to the writing period P1. The drive section 60 so performs the driving as to repeat this series of operations.

Here, the initialization period P1 corresponds to one specific example of a "first sub-period" in one embodiment of the disclosure. The Vth correction period P2 corresponds to one specific example of a "second sub-period" in one embodiment of the disclosure. A period of timing t23 to t25 corresponds to one specific example of a "first writing period" in one embodiment of the disclosure. A period of timing t25 to t27 corresponds to one specific example of a "second writing period" in one embodiment of the disclosure. The voltage Vofs corresponds to one specific example of a "first voltage" in one embodiment of the disclosure. The voltage Vini corresponds to one specific example of a "second voltage" in one embodiment of the disclosure. The voltage Vccp corresponds to one specific example of a "third voltage" in one embodiment of the disclosure.

Figure 38:
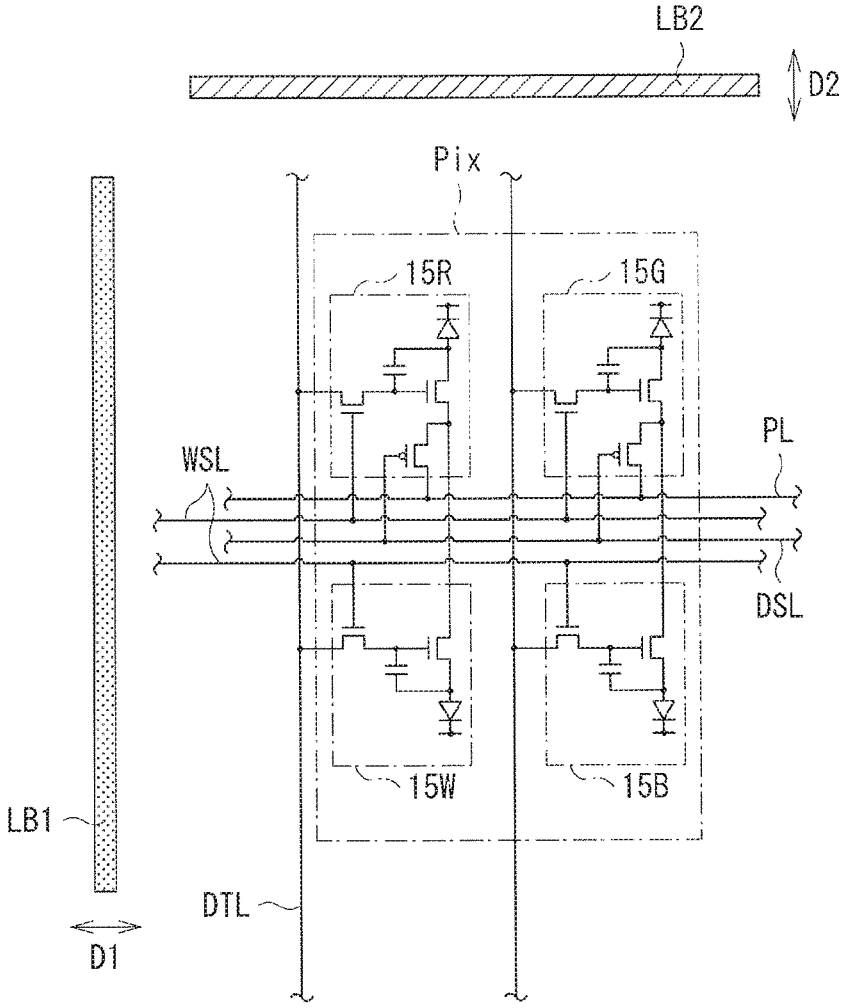
FIG. 38 is an explanatory view illustrating an arrangement of sub-pixels illustrated in FIG. 34.
Figure 39:
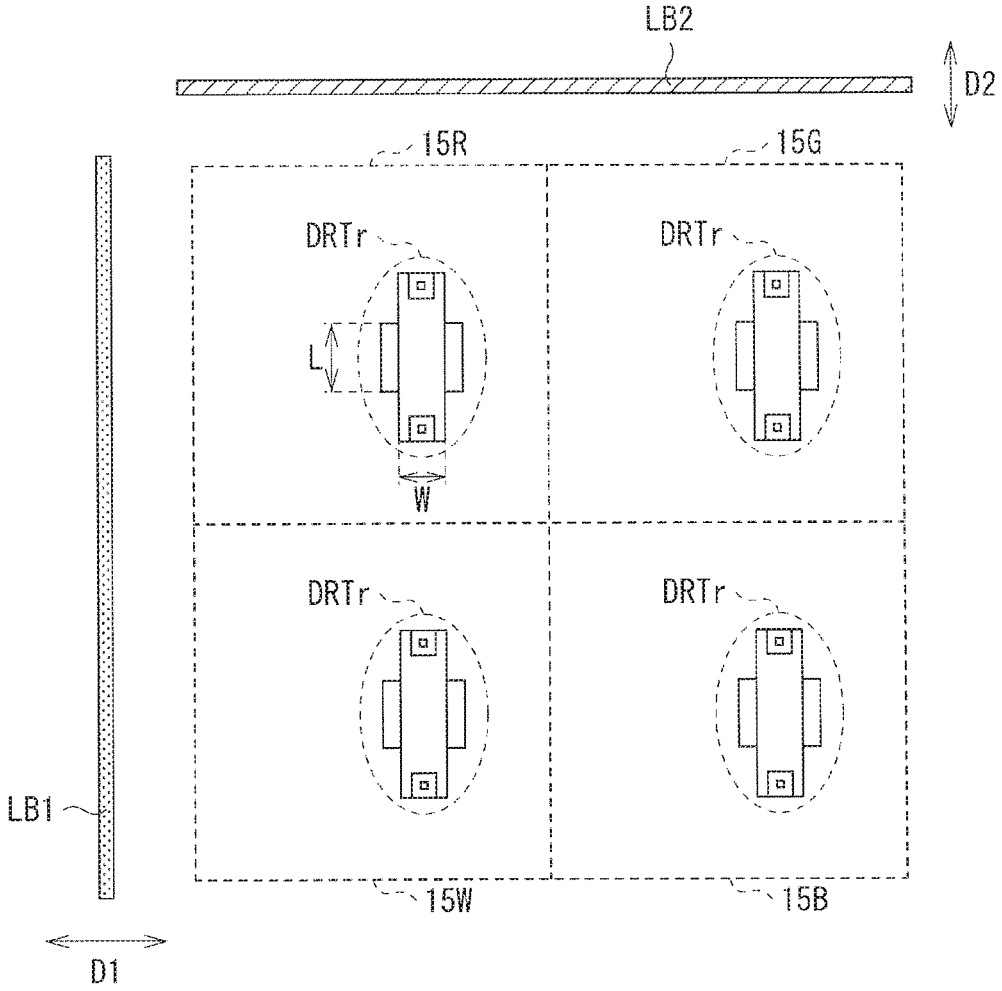
FIG. 39 is an explanatory view illustrating an arrangement of driving transistors in the sub-pixels illustrated in FIG. 34.

FIG. 38 illustrates a relationship between an arrangement of the sub-pixels 15 in the display section 50, and the scanning direction D1 through an ELA apparatus and the scanning direction D2 through an ion implantation apparatus. FIG. 39 illustrates a relationship between an arrangement of the driving transistors DRTr in respective sub-pixels 15 and the scanning directions D1 and D2.

In the display section 50, the sub-pixels 15R and 15W belonging to the same pixel Pix are provided side-by-side in a direction orthogonal to the scanning direction D1 and in the same direction as the scanning direction D2. Similarly, the sub-pixels 15G and 15B belonging to the same pixel Pix are provided side-by-side in a direction orthogonal to the scanning direction D1 and in the same direction as the scanning direction D2.

More specifically, as illustrated in FIG. 39, the driving transistors DRTr in the sub-pixels 15R and 15W belonging to the same pixel Pix are provided side-by-side in a direction orthogonal to the scanning direction D1 and in the same direction (longitudinal direction of FIG. 39) as the scanning direction D2. Similarly, the driving transistors DRTr in the sub-pixels 15G and 15B belonging to the same pixel Pix are provided side-by-side in a direction orthogonal to the scanning direction D1 and in the same direction (longitudinal direction of FIG. 39) as the scanning direction D2. The respective driving transistors DRTr are arranged so that a length (L) direction thereof may be matched with the scanning direction D2.

Thereby, the threshold voltages Vth of the driving transistors DRTr in the sub-pixels 15R and 15W belonging to the same pixel Pix are made substantially equal to each other. Also, the threshold voltages Vth of the driving transistors DRTr in the sub-pixels 15G and 15B belonging to the same pixel Pix are made substantially equal to each other.

As described above, in the present embodiment, the sub-pixels that are adjacent to each other in the vertical direction share the power supply transistor. Consequently, it is possible to reduce the number of transistors, power lines, and power control lines. Therefore, a resolution of the display unit is improved. Other effects are the same as those of the reference example described above.

Modification Example 2-1

In the embodiment described above, the pixel Pix is configured by four sub-pixels 15 of red (R), green (G), blue (B), and white (W); however, not limited thereto. A modification example is described in detail below.

Figure 40:
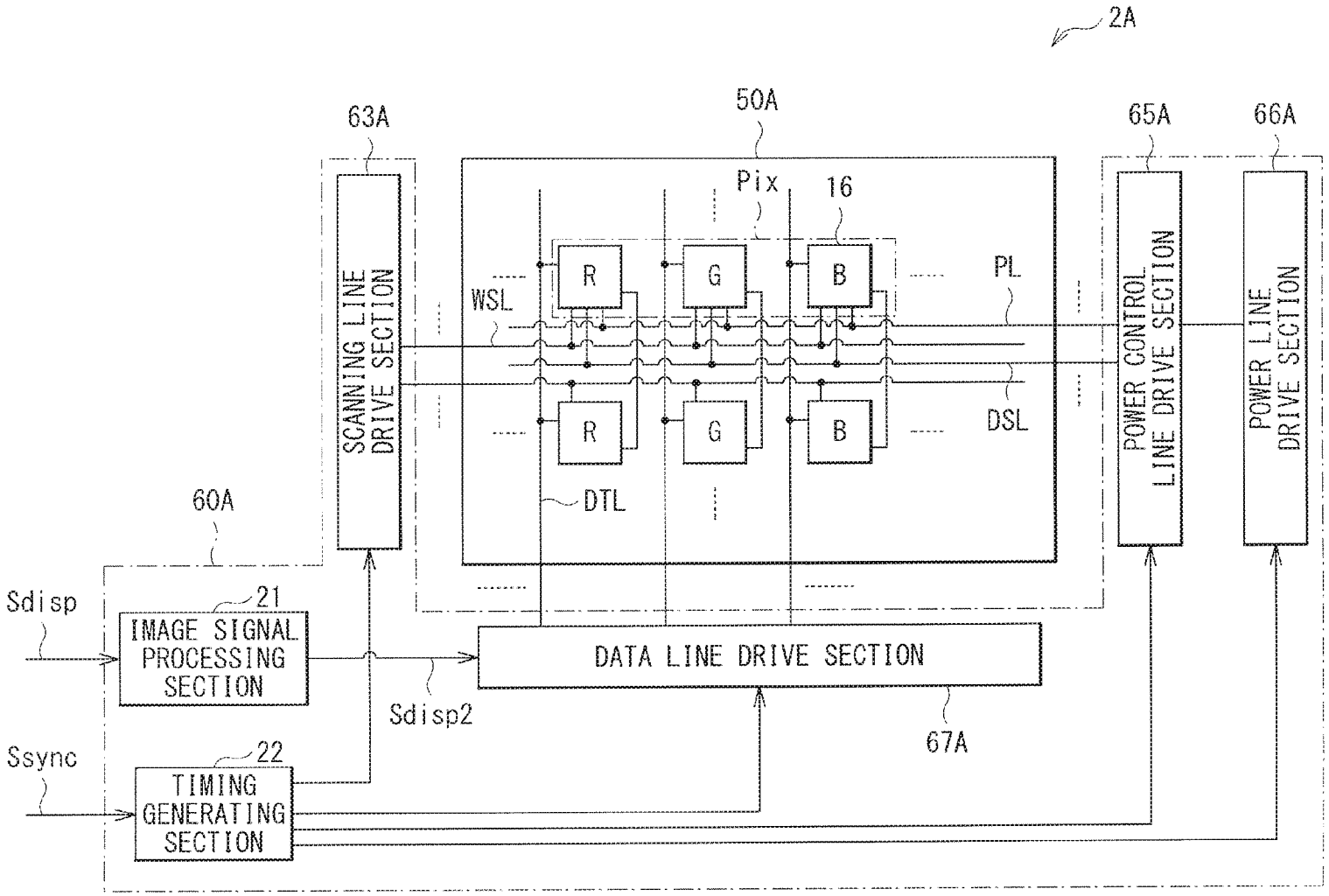
FIG. 40 is a block diagram illustrating one configuration example of a display unit according to the modification example of the embodiment.

FIG. 40 illustrates one configuration example of a display unit 2A according to the present modification example. The display unit 2A includes a display section 50A and a drive section 60A. Each pixel Pix of the display section 50A has three-color sub-pixels 16 of red (R), green (G), and blue (B). The drive section 60A includes a scanning line drive section 63A, a power control line drive section 65A, a power line drive section 66A, and a data line drive section 67A.

Figure 41:
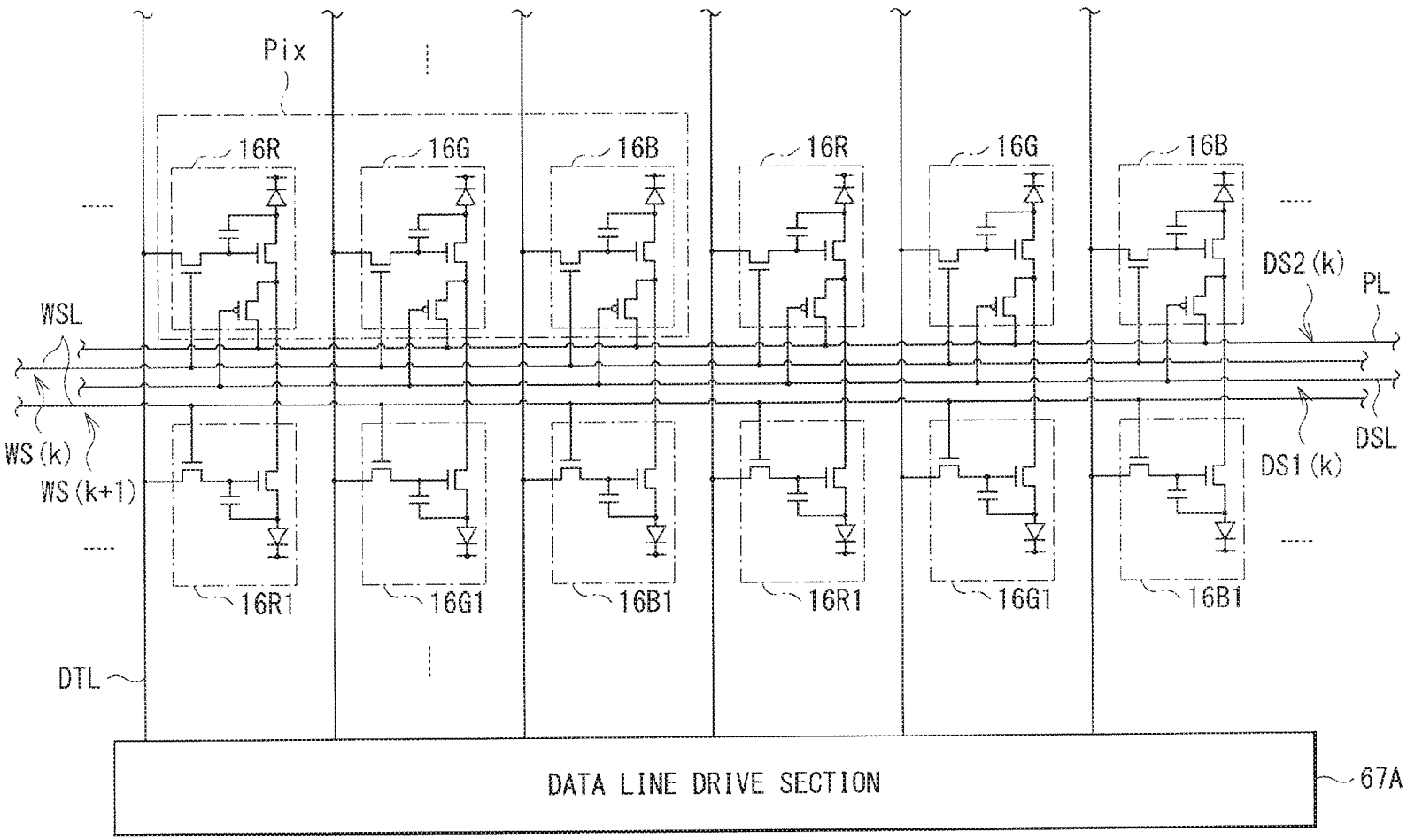
FIG. 41 is a circuit diagram illustrating a circuit configuration example of a display section illustrated in FIG. 40.

FIG. 41 illustrates one example of a circuit configuration of k-th row and (k+1)-th row pixels Pix in the display section 50A. In the display section 50A, three sub-pixels 16R, 16G, and 16B each having the power supply transistor DSTr of red (R), green (G), and blue (B) and three sub-pixels 16R1, 16G1, and 16B1 each having no power supply transistor DSTr of red (R), green (G), and blue (B) are provided side-by-side. Specifically, the sub-pixels 16R, 16G, and 16B are repeatedly arranged in this order in the horizontal direction. Further, in a row adjacent to that row, the sub-pixels 16R1, 16G1, and 16B1 are repeatedly arranged in this order in the horizontal direction. Similarly to the display section 50 according to the embodiment described above, in this display section 50A, two sub-pixels 16 adjacent in the vertical direction are configured so as to share the power supply transistor DSTr. Further, the three sub-pixels 16R, 16G, and 16B, or the three sub-pixels 16R1, 16G1, and 16B1 configure the pixel Pix.

Figures 42A, 42B, 42C, 42D:
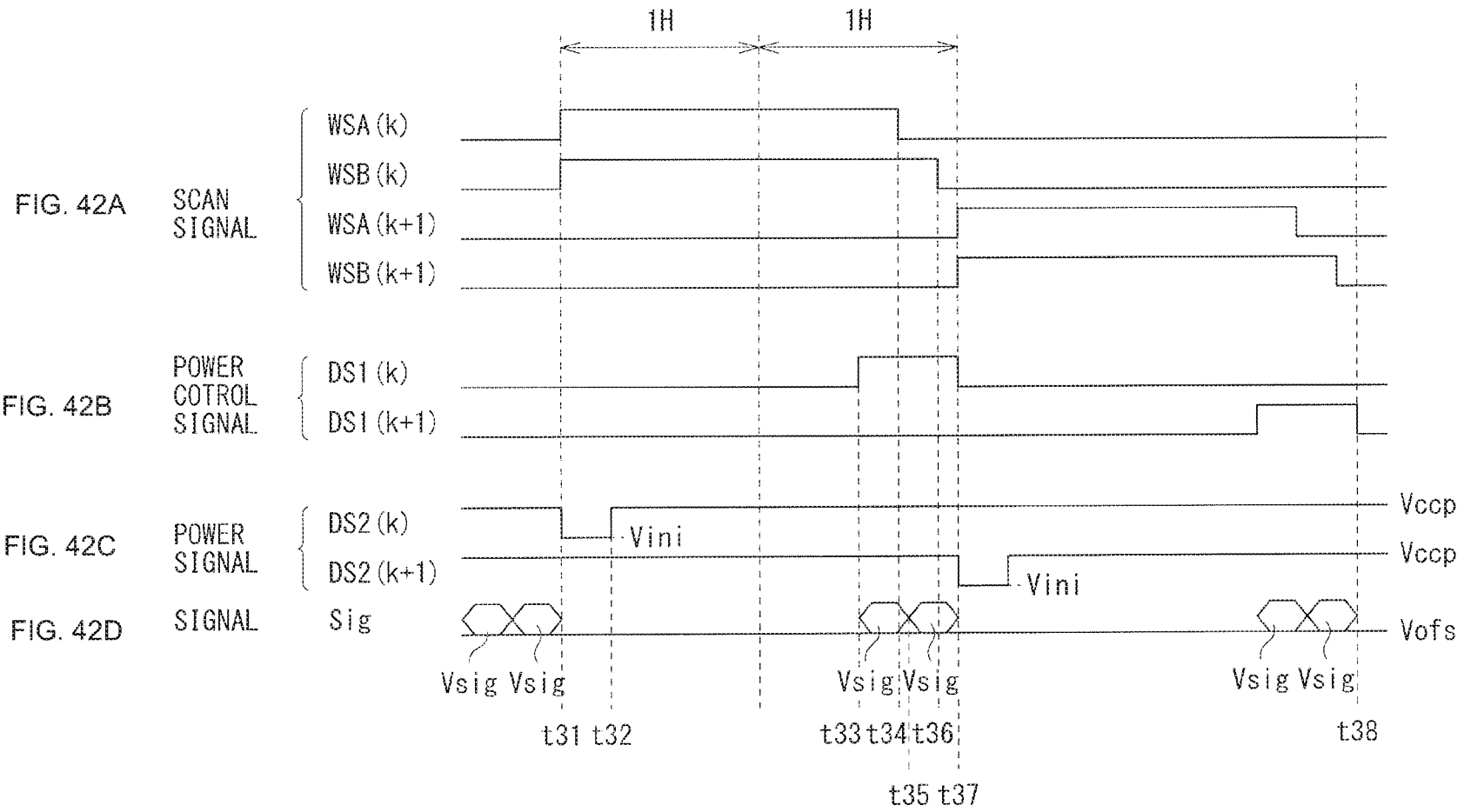
FIGS. 42A, 42B, 42C, and 42D are timing waveform diagrams illustrating one operation example of a drive section illustrated in FIG. 40.

FIGS. 42A, 42B, 42C, and 42D are timing charts illustrating operations of the drive section 60A, in which FIG. 42A illustrates waveforms of the scan signals WS, FIG. 42B illustrates waveforms of the power control signals DS1, FIG. 42C illustrates waveforms of the power signals DS2, and FIG. 42D illustrates a waveform of the signal Sig. In FIG. 42A, a scan signal WS(k) is the scan signal WS which drives k-th row pixels Pix, a scan signal WS(k+1) is the scan signal WS which drives (k+1)-th row pixels Pix, a scan signal WS(k+2) is the scan signal WS which drives (k+2)-th row pixels Pix, and a scan signal WS(k+3) is the scan signal WS which drives (k+3)-th row pixels Pix. In FIG. 42B, a power control signal DS1(*k*) is the power control signal DS1 which drives k-th row and (k+1)-th row pixels Pix, and a power control signal DS1(*k*+2) is the power control signal DS1 which drives (k+2)-th row and (k+3)-th row pixels Pix. Much the same is true on the power signal DS2 (FIG. 42C).

In two horizontal periods, the scanning line drive section 63A of the drive section 60A applies pulses to two scanning lines WSL. Similarly to a case of the embodiment described above (FIGS. 36A, 36B, 36C, and 36D), the power control line drive section 65A, the power line drive section 66A, and the data line drive section 67A supply each signal to the display section 50A in synchronization with the scan signals WS.

In this way, the drive section 60A drives the sub-pixels 16 in the k-th row and (k+1)-th row pixels Pix in a period of timing t31 to t37, and drives the sub-pixels 16 in the (k+2)-th row and (k+3)-th row pixels Pix in a period of timing t37 and t38.

Modification Example 2-2

In the embodiment described above, the sub-pixels 15 adjacent in the vertical direction share the power supply transistor DSTr; however, not limited thereto. In place of the above, for example, the share of the power supply transistor DSTr may be made unnecessary. A display unit 2B according to the present modification example is described in detail below.

Figure 43:
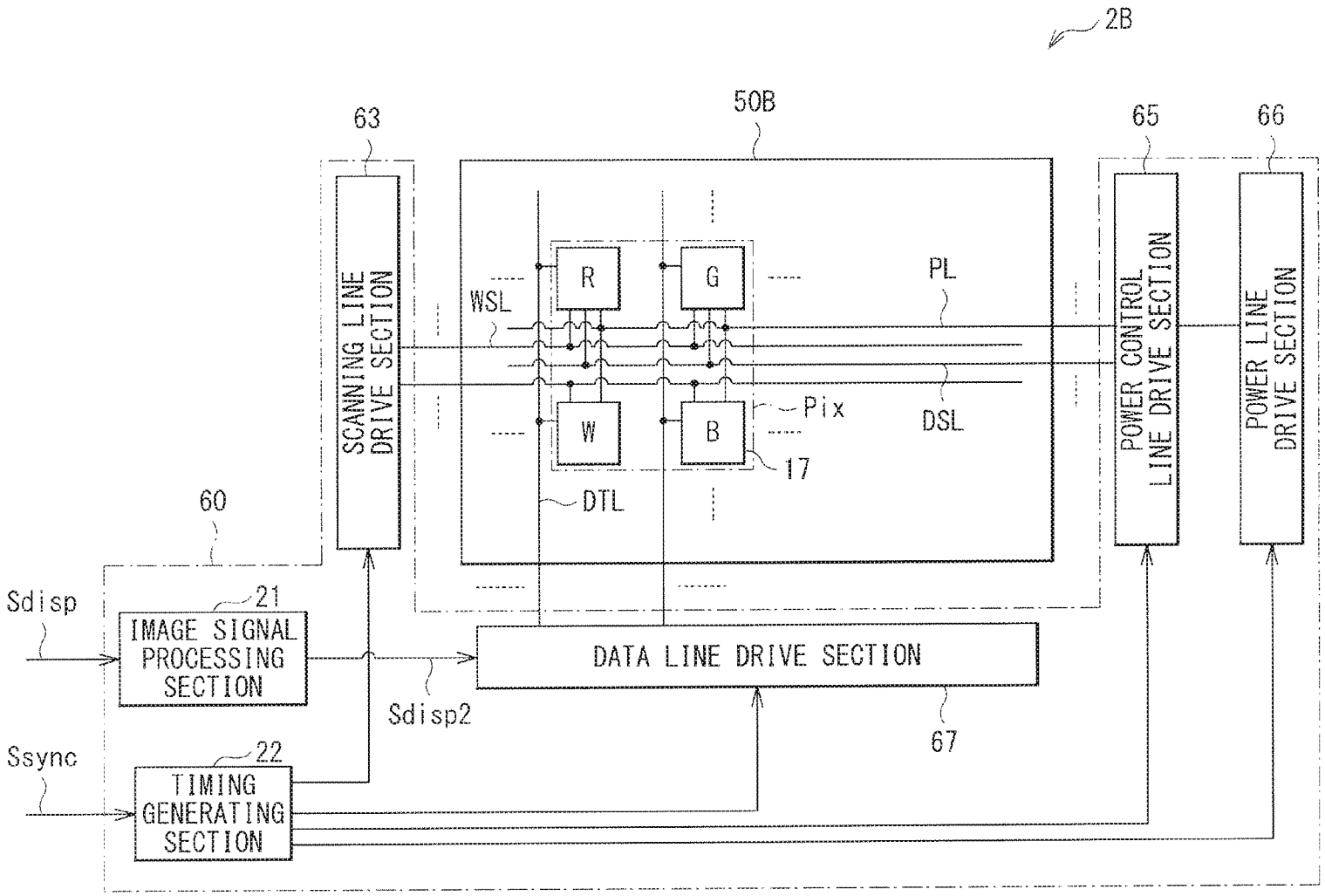
FIG. 43 is a block diagram illustrating one configuration example of a display unit according to another modification example of the embodiment.

FIG. 43 illustrates one configuration example of the display unit 2B. The display unit 2B includes a display section 50B.

Figure 44:
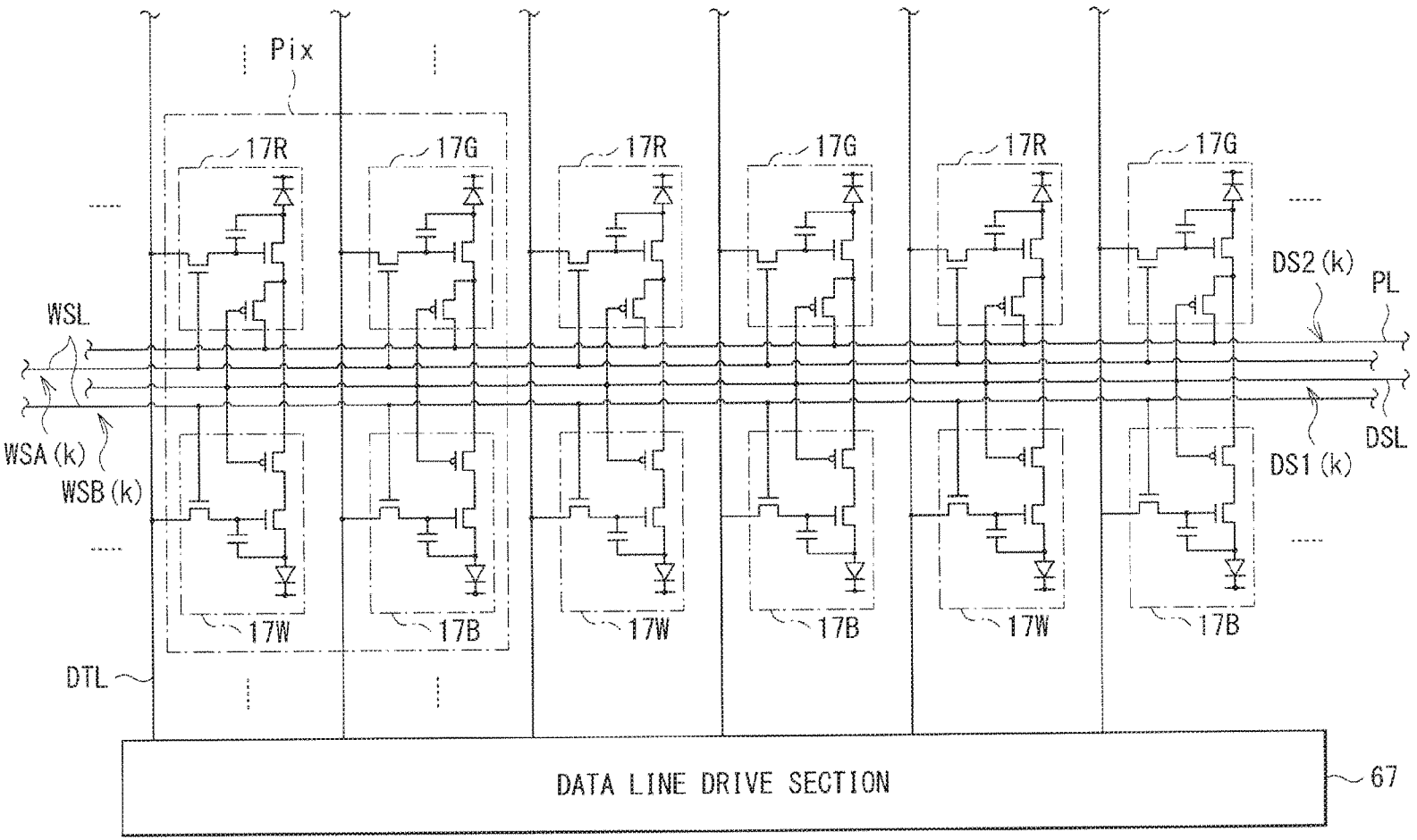
FIG. 44 is a circuit diagram illustrating a circuit configuration example of a display section illustrated in FIG. 43.

FIG. 44 illustrates one example of a circuit configuration of the display section 50B. Each pixel Pix has four sub-pixels 17 (17R, 17G, 17B, and 17W) of red (R), green (G), blue (B), and white (W). These four sub-pixels 17R, 17G, 17B, and 17W each have power the supply transistor DSTr. Further, in the power supply transistors DSTr in the four sub-pixels 17 belonging to the same pixel Pix, gates thereof are connected to the same power control line DSL, and sources thereof are connected to the same power line PL.

Even such a configuration, it is possible to reduce the number of power lines and power control lines. Therefore, a resolution of the display unit is improved.

Modification Example 2-3

Figure 45:
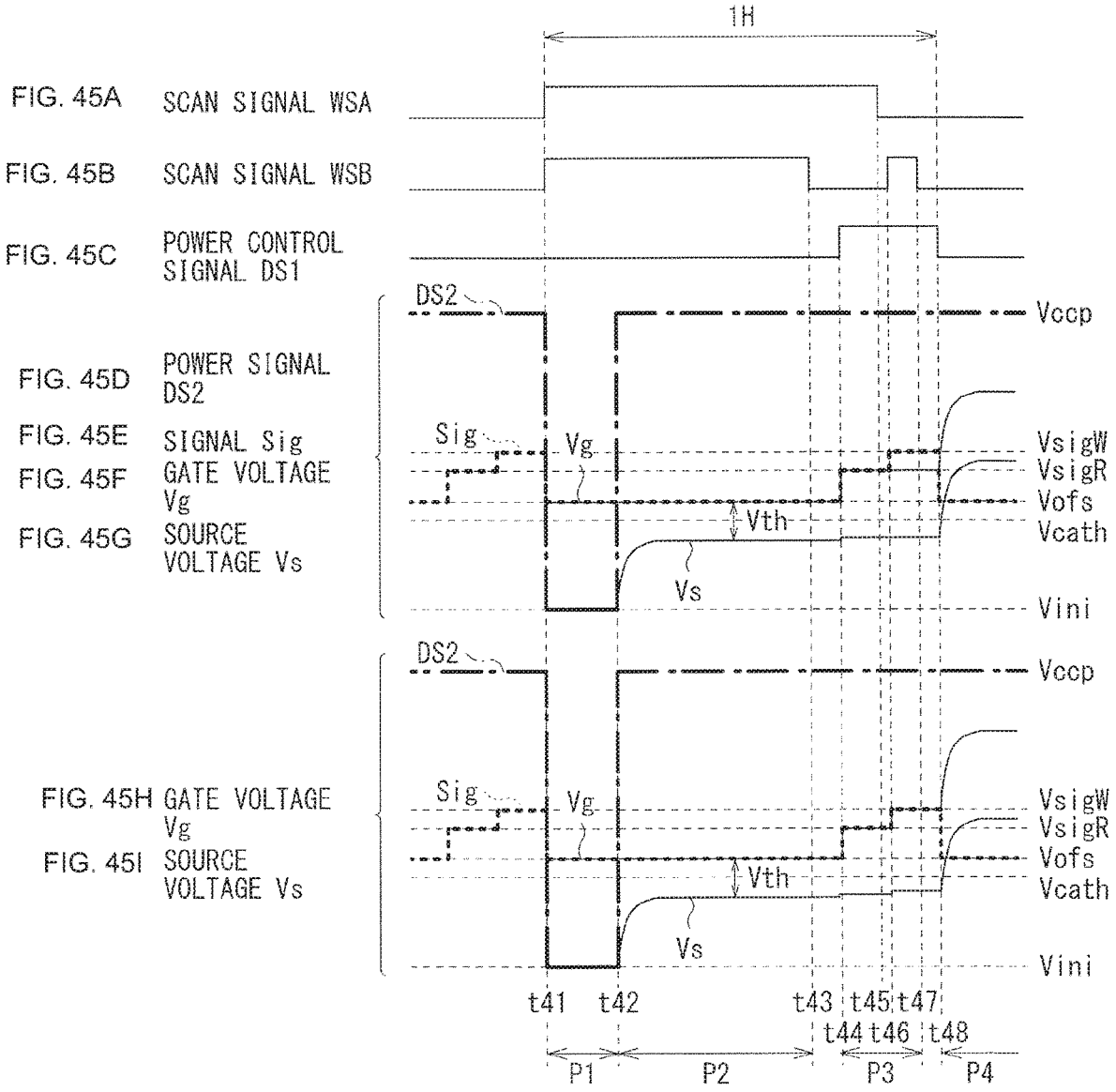
FIGS. 45A, 45B, 45C, 45D, 45E, 45F, 45G, 45H, and 45I are timing waveform diagrams illustrating one operation example of the drive unit illustrated in FIG. 43.

In the embodiment described above, in one horizontal period (1H), the two pulses in which start timing is the same and end timing is varied are applied to the two scanning lines WSL; however, not limited thereto. In place of the above, for example, as illustrated in FIGS. 45A, 45B, 45C, 45D, 45E, 45F, 45G, 45H, and 45I, a pulse of the scan signal WSB may be ended once (FIG. 45B), and after a pulse of the scan signal WSA is ended (FIG. 45B), the pulse of the scan signal WSB may be applied again (FIG. 45B). Thereby, the pixel voltage VsigW is written in the sub-pixel 15W without writing the pixel voltage VsigR.

Modification Example 2-4

In addition, one or more of the reference examples 1-3 to 1-5 described above may be applied to the present embodiment.

3. Application Example

Next, an application example of any one of the display units described in the above-described embodiment and the modification examples is described.

Figure 46:
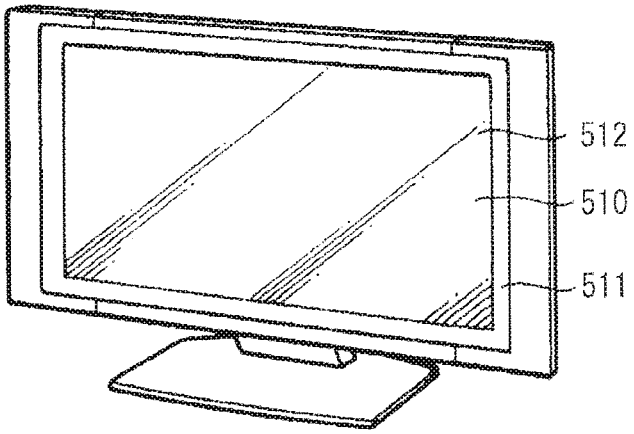
FIG. 46 is a perspective view illustrating an appearance configuration of a TV apparatus to which the display unit according to the embodiment is applied.

FIG. 46 illustrates an appearance of a TV apparatus to which the display unit according to any one of the embodiment and the modification examples is applied. This TV apparatus may have, for example, an image display screen section 510 including a front panel 511 and a filter glass 512. This TV apparatus is configured by the display unit according to any one of the embodiment and the modification examples described above.

In addition to this TV apparatus, the display unit according to any one of the embodiment and the modification examples described above is applicable to all kinds of electronic apparatus. Some examples of the electronic apparatus may include a digital camera, a notebook computer, a portable terminal device such as a mobile phone, a portable video game player, and a video camera. In other words, the display units according to the embodiment and the modification examples are applicable to all kinds of electronic apparatus which displays images.

As described above, the technology is described with reference to the example embodiment, the modification examples, and the application example to the electronic apparatus. The technology is not limited to the example embodiment and the modification examples, and various sorts of modification may be made.

Figure 47:
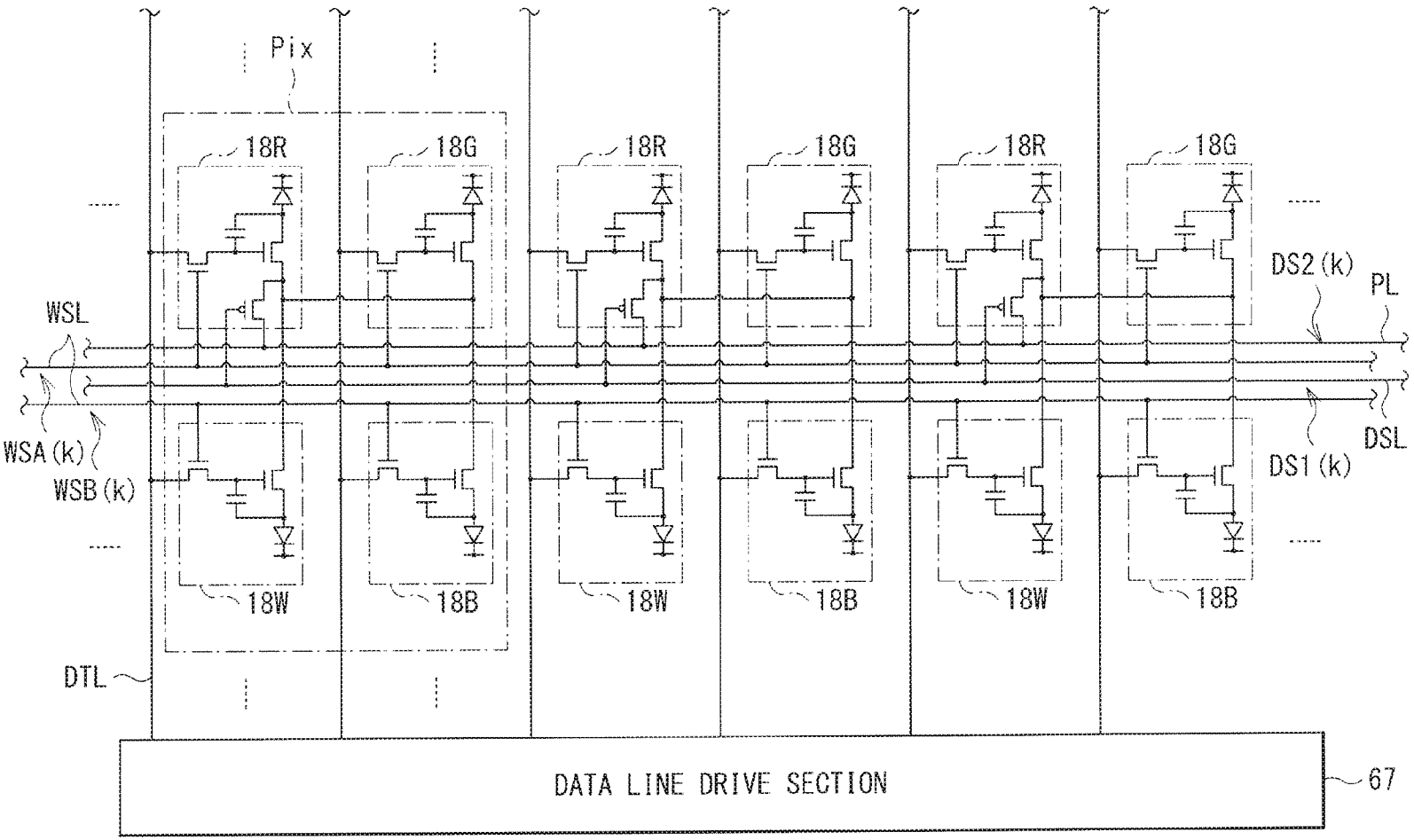
FIG. 47 is a circuit diagram illustrating a circuit configuration example of a display section according to the modification example.

In the embodiment described above, for example, the plurality of sub-pixels adjacent in the horizontal direction or in the vertical direction are configured so as to share the power supply transistor DSTr; however, not limited thereto. In place of the above, for example, as illustrated in FIG. 47, the plurality of sub-pixels adjacent in the horizontal direction and in the vertical direction may be configured so as to share the power supply transistor DSTr. In this example, four sub-pixels 18R, 18G, 18B, and 18W which are arranged in two rows and two columns in the pixel Pix share the power supply transistor DSTr.

Figure 48:
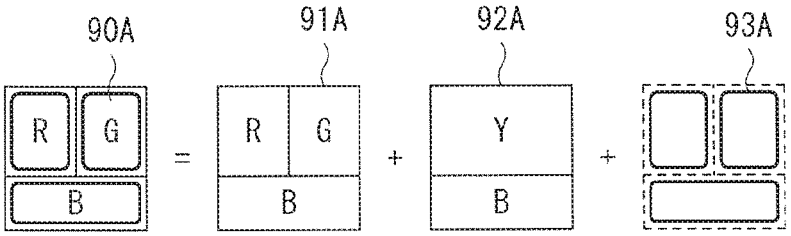
FIG. 48 is a schematic diagram illustrating a configuration of light emitting elements according to another modification example.
Figure 49:
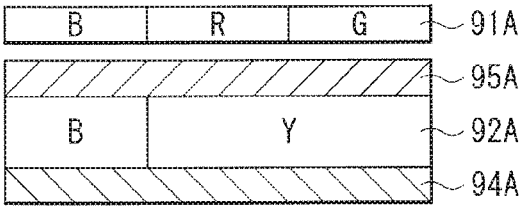
FIG. 49 is a cross-sectional view illustrating an essential-part cross-sectional structure of the light emitting elements illustrated in FIG. 48.
Figure 50:
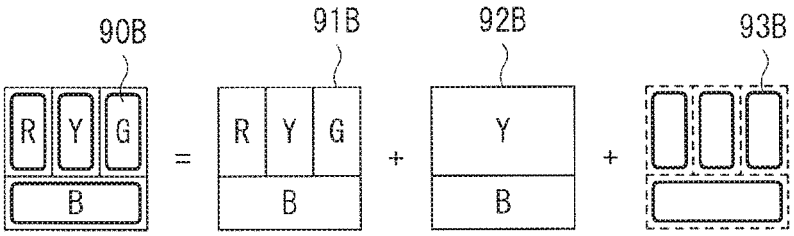
FIG. 50 is a schematic diagram illustrating a configuration of light emitting elements according to yet another modification example.
Figure 51:
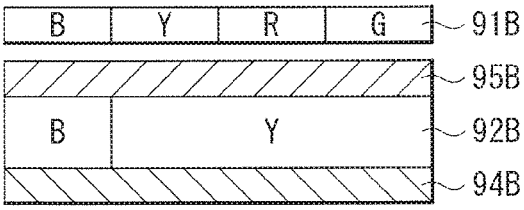
FIG. 51 is a cross-sectional view illustrating an essential-part cross-sectional structure of the light emitting elements illustrated in FIG. 50.

Further, in the embodiment described above, for example, the sub-pixels are arranged in two rows and two columns or in one row and three columns in the pixel Pix; however, not limited thereto. In place of the above, for example, as illustrated in FIG. 48, one sub-pixel (a blue sub-pixel in this example) among three sub-pixels of red (R), green (G), and blue (B) may be formed so as to be extended in the horizontal direction. In this case, for example, as in a light emitting layer 92A illustrated in FIGS. 48 and 49, a yellow light emitting layer which emits light of yellow (Y) may be formed in regions corresponding to color filters 91A of red (R) and green (G). Thereby, when light of yellow (Y) passes through the color filter 91A of red (R), light of red (R) may be emitted, and when light of yellow (Y) passes through the color filter 91A of green (G), light of green (G) may be emitted. Further, for example, as illustrated in FIG. 50, one sub-pixel (a blue sub-pixel in this example) among four sub-pixels of red (R), green (G), blue (B), and yellow (Y) may be formed so as to be extended in the horizontal direction. In this case, for example, as in a light emitting layer 92B illustrated in FIGS. 50 and 51, a yellow light emitting layer which emits light of yellow (Y) may be formed in regions corresponding to color filters 91B of red (R), green (G), and yellow (Y). Thereby, when light of yellow (Y) passes through the color filter 91B of red (R), light of red (R) may be emitted, when light of yellow (Y) passes through the color filter 91B of green (G), light of green (G) may be emitted, and when light of yellow (Y) passes through the color filter 91B of yellow (Y), light of yellow (Y) may be emitted. Alternatively, this color filter 91B of yellow (Y) may be made unnecessary.

Furthermore, the technology encompasses any possible combination of some or all of the various embodiments described herein and incorporated herein.

It is possible to achieve at least the following configurations from the above-described example embodiments of the disclosure.

(1) A display unit including:

a plurality of unit pixels each including a display element and a driving transistor that supplies a driving current to the display element, the unit pixels being arrayed to be scanned and driven in a first direction; and a single power line extending in a second direction that intersects with the first direction, the single power line being provided to be assigned for a pair of unit pixels that are two unit pixels of the plurality of unit pixels and are adjacent to each other in the first direction.

(2) The display unit according to (1), wherein one of the pair of unit pixels includes a power supply transistor configured to turn on to allow the power line to be connected to each of the driving transistors in the pair of unit pixels.

(3) The display unit according to (1), wherein each of the pair of unit pixels includes a power supply transistor configured to turn on to allow the single supply line to be connected to the driving transistor.

(4) The display unit according to (2) or (3), wherein the driving transistor in each of the pair of unit pixels includes:

a gate;

a source connected to the display element; and a drain connected to the power supply transistor.

(5) The display unit according to (4), further including a signal line, wherein each of the pair of unit pixels includes a writing transistor configured to turn on to allow the signal line to be connected to a gate of the driving transistor.

(6) The display unit according to (5), further including a drive section configured to drive the plurality of unit pixels, wherein the drive section, in a first period, allows both of the writing transistors in the pair of unit pixels to turn on, then allows one of the writing transistors to turn off at first timing and allows another of the writing transistors to turn off at second timing after the first timing.

(7) The display unit according to (6), wherein the drive section allows the signal line to be applied with a first pixel voltage in a first writing period including the first timing, and allows the signal line to be applied with a second pixel voltage in a second writing period including the second timing.

(8) The display unit according to (6) or (7), wherein each of the unit pixels further includes a capacitor provided between a gate and a source of the driving transistor, the drive section maintains a gate voltage of each of the driving transistors in the pair of unit pixels at a first voltage and maintains a source voltage of each of the driving transistors at a second voltage, during a first sub-period in the first period, and the drive section maintains the gate voltage of each of the driving transistors in the pair of unit pixels at the first voltage and varies the source voltage of each of the driving transistors through allowing a current to flow through each of the driving transistors in the pair of unit pixels, during a second sub-period coming after the first sub-period in the first period.

(9) The display unit according to (8), wherein the drive section applies the first voltage to the signal line and allows each of the writing transistors in the pair of unit pixels to stay on, both during the first and second sub-periods.

(10) The display unit according to (8) or (9), wherein the drive section applies the second voltage to the power line and maintains the source voltage of each of the driving transistors at the second voltage through allowing one or two power supply transistors in the pair of unit pixels to stay on, during the first sub-period, and the drive section applies a third voltage to the power line and allows the current to flow through each of the driving transistors in the pair of unit pixels through allowing the power supply transistor to stay on, during the second sub-period.

(11) The display unit according to any one of (1) to (10), wherein the driving transistors in the pair of unit pixels are arranged side by side in the first direction.

(12) The display unit according to any one of (1) to (11), wherein the first direction is a length direction of each of the driving transistors in the pair of unit pixels.

(13) The display unit according to any one of (1) to (12), wherein the second direction is a scanning direction of an Excimer Laser Anneal apparatus in manufacturing.

(14) The display unit according to any one of (1) to (13), wherein the first direction is a scanning direction of an ion implantation apparatus in manufacturing.

(15) The display unit according to any one of (1) to (14), wherein four unit pixels of the plurality of unit pixels configure one display pixel.

(16) The display unit according to (15), wherein the four unit pixels are arranged in two rows and two columns in the display pixel.

(17) The display unit according to any one of (1) to (14), wherein three unit pixels of the plurality of unit pixels configure one display pixel.

(18) A method of manufacturing a display unit, the method including:

forming a transistor on a substrate, in which a first direction to be scanned by an ion implantation apparatus intersects with a second direction to be scanned by an Excimer Laser Anneal apparatus; and forming a display element.

(19) The method of manufacturing the display unit according to (18), wherein, in the forming the transistor, respective driving transistors of a pair of unit pixels of a plurality of unit pixels are formed side-by-side in the first direction, the plurality of unit pixels each including the display element and the driving transistor that supplies a driving current to the display element, the unit pixels being arrayed to be scanned and driven in the first direction, and the pair of unit pixels being two unit pixels of the plurality of unit pixels and being adjacent to each other in the first direction.

(20) An electronic apparatus provided with a display unit and a control section configured to perform operation control of the display unit, the display unit including:

a plurality of unit pixels each including a display element and a driving transistor that supplies a driving current to the display element, the unit pixels being arrayed to be scanned and driven in a first direction; and a single power line extending in a second direction that intersects with the first direction, the single power line being provided to be assigned for a pair of unit pixels that are two unit pixels of the plurality of unit pixels and are adjacent to each other in the first direction.

It should be understood by those skilled in the art that various modifications, combinations, sub-combinations and alternations may occur depending on design requirements and other factors insofar as they are within the scope of the appended claims or the equivalents thereof.

What is claimed is:

1. A display device, comprising:

a plurality of pixels in a matrix; and a plurality of power lines, wherein the plurality of pixels comprises a red sub pixel, a green sub pixel, a blue sub pixel, and a white sub pixel, and each of the red sub pixel, the green sub pixel, the blue sub pixel, and the white sub pixel comprises:

a light emitting element; and a driving transistor configured to supply a drive current from one of the plurality of power lines to the light emitting element based on a data signal supplied from a data signal line, wherein a first terminal of the driving transistor in the red sub pixel and a first terminal of the driving transistor in the green sub pixel are connected to a first point of the plurality of power lines, a first terminal of the driving transistor in the blue sub pixel and a first terminal of the driving transistor in the white sub pixel are connected to a second point of the plurality of power lines, the second point is different from the first point, and the driving transistor is arranged so that a length direction of the driving transistor is matched with a direction in which the plurality of power lines extends.

2. The display device according to claim 1, wherein a first terminal of a first transistor in the red sub pixel and a first terminal of a first transistor in the green sub pixel are connected to the first point, and a first terminal of a first transistor in the blue sub pixel and a first terminal of a first transistor in the white sub pixel are connected to the second point.

3. The display device according to claim 1, wherein the driving transistor further comprises a capacitor configured to store a voltage corresponding to the data signal, a first electrode of the capacitor is connected to a control terminal of a first transistor, and a second electrode of the capacitor is connected to a second terminal of the first transistor.

4. The display device according to claim 3, wherein each of the first transistor in the red sub pixel and the first transistor in the green sub pixel is configured to supply a first compensation current from the first point to the second electrode of the capacitor, and each of the first transistor in the blue sub pixel and the first transistor in the white sub pixel is configured to supply a second compensation current from the second point to the second electrode of the capacitor.

5. The display device according to claim 1, wherein the driving transistor further comprises:

a capacitor configured to store a voltage corresponding to the data signal; and a second transistor configured to supply the data signal from the data signal line to the capacitor.

6. The display device according to claim 1, wherein a first pixel of the plurality of pixels comprises a first red sub pixel, a first green sub pixel, a first blue sub pixel, and a first white sub pixel, the first terminal of the driving transistor in the first red sub pixel and the first terminal of the driving transistor in the first green sub pixel are connected to the first point, and the first terminal of the driving transistor in the first blue sub pixel and the first terminal of the driving transistor in the first white sub pixel are connected to the second point.

7. The display device according to claim 1, wherein the red sub pixel is adjacent to the green sub pixel, and the blue sub pixel is adjacent to the white sub pixel.

8. The display device according to claim 1, wherein the light emitting element is configured to emit white light.

9. The display device according to claim 1, wherein a first transistor in the red sub pixel and a first transistor in the green sub pixel are arranged side by side in a specific direction, a first transistor in the blue sub pixel and a first transistor in the white sub pixel are arranged side by side in the specific direction, and the specific direction is a direction along the plurality of power lines.

10. The display device according to claim 1, wherein the red sub pixel further comprises a third transistor, the third transistor is shared between the red sub pixel and the green sub pixel, the white sub pixel further comprises a fourth transistor, and the fourth transistor is shared between the white sub pixel and the blue sub pixel.

11. The display device according to claim 10, wherein the third transistor is disposed between the first point and both a first transistor in the red sub pixel and a first transistor in the green sub pixel, and the fourth transistor is disposed between the second point and both a first transistor in the blue sub pixel and a first transistor in the white sub pixel.

12. The display device according to claim 1, further comprising a N channel Metal Oxide Semiconductor (MOS) type transistor.

* * * * *